US007238467B2

(12) United States Patent
Ikeda et al.

(10) Patent No.: US 7,238,467 B2
(45) Date of Patent: Jul. 3, 2007

(54) SILVER HALIDE EMULSION, METHOD OF PREPARING THE SAME AND SILVER HALIDE PHOTOSENSITIVE MATERIAL USING THE SAME

(75) Inventors: Tadashi Ikeda, Minami-Ashigara (JP); Yasushi Tanabe, Minami-Ashigara (JP); Hiroshi Kawakami, Minami-Ashigara (JP); Takeshi Suzumoto, Minami-Ashigara (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 10/893,885

(22) Filed: Jul. 20, 2004

(65) Prior Publication Data

US 2005/0019712 A1 Jan. 27, 2005

(30) Foreign Application Priority Data

| | | |
|---|---|---|
| Jul. 23, 2003 | (JP) | 2003-200390 |
| Aug. 4, 2003 | (JP) | 2003-285905 |
| May 25, 2004 | (JP) | 2004-155001 |

(51) Int. Cl.
*G03C 1/005* (2006.01)
*G03C 1/494* (2006.01)

(52) U.S. Cl. ..... 430/570; 430/567; 430/572; 430/574; 430/576

(58) Field of Classification Search ..... 430/567, 430/570, 572, 574, 576
See application file for complete search history.

(56) References Cited

U.S. PATENT DOCUMENTS

| | | | | |
|---|---|---|---|---|
| 6,117,629 | A | 9/2000 | Yamashita et al. | |
| 6,143,486 | A | 11/2000 | Parton et al. | |
| 6,331,385 | B1 * | 12/2001 | Deaton et al. | 430/572 |
| 6,558,893 | B1 | 5/2003 | Parton et al. | |
| 6,582,894 | B1 | 6/2003 | Hioki et al. | |
| 6,610,466 | B2 | 8/2003 | Sakurada et al. | |

* cited by examiner

*Primary Examiner*—Geraldina Visconti
(74) *Attorney, Agent, or Firm*—Sughrue Mion, PLLC

(57) ABSTRACT

A silver halide emulsion comprising silver halide grains covered with two dye layers in combination. The two dye layers comprises an inner dye layer adjoining to the silver halide grain, and containing at least one sensitizing dye capable of spectrally sensitizing silver halide, and an outer dye layer adjoining to the inner dye layer, and containing at least two dyes. The light absorption energy of the outer dye layer is equal to or higher than that of the inner dye layer, an energy-releasing wavelength of the outer dye layer overlaps with an energy-absorbing wavelength of the inner dye layer, the sensitizing dyes constituting the inner dye layer include an anion and/or betaine dyes, the dyes constituting the outer dye layer include an anion and cation dyes, and the anion dye is more than the cation dye in terms of an addition amount and/or an adsorption amount.

16 Claims, 1 Drawing Sheet

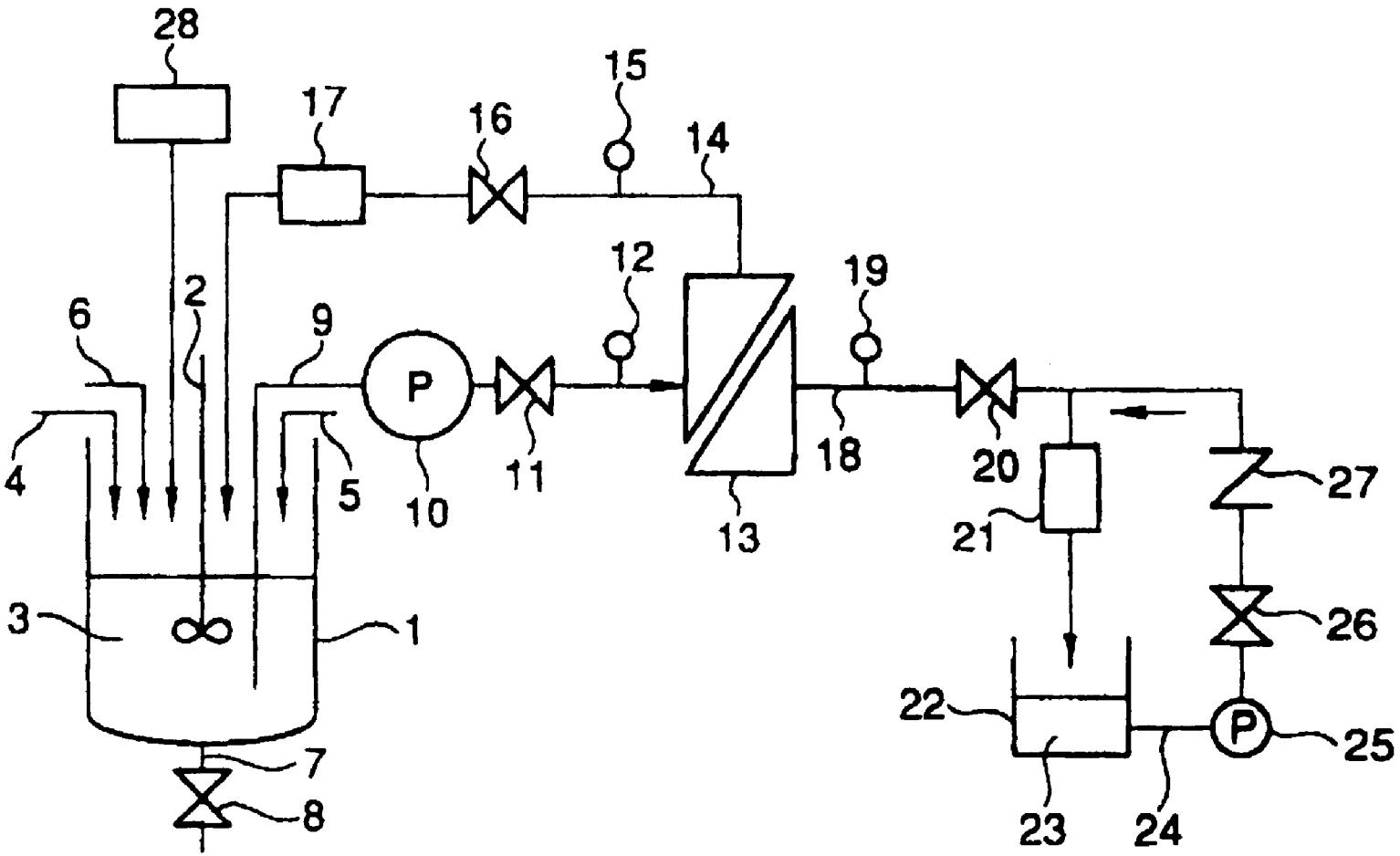
FIGURE

SILVER HALIDE EMULSION, METHOD OF PREPARING THE SAME AND SILVER HALIDE PHOTOSENSITIVE MATERIAL USING THE SAME

CROSS-REFERENCE TO RELATED APPLICATIONS

This application is based upon and claims the benefit of priority from the prior Japanese Patent Applications No. 2003-200390, filed Jul. 23, 2003, No. 2003-285905, filed Aug. 4, 2003; and No. 2004-155001, filed May 25, 2004, the entire contents of all of which are incorporated herein by reference.

BACKGROUND OF THE INVENTION

1. Field of the Invention

This invention relates to a silver halide photosensitive material containing at least one kind of silver halide emulsion which has enhanced light absorption, a method of preparing the same, and a silver halide photosensitive material containing the same, especially silver halide photosensitive material having a greatly improved spectral sensitivity resulting from an enhancement in light absorption, and also having improved preservability.

2. Description of the Related Arts

A great deal of effort has hitherto been made for increasing the speed of a silver halide photosensitive material. In silver halide emulsions, the light entering a photosensitive material is absorbed by silver halide grains or by sensitizing dyes adsorbed on the surfaces of the grains and then the light energy is transmitted to the silver halide grains. Thus, light sensitivity is achieved.

Silver halide grains can absorb only light of a wavelength shorter than the blue region. In order to make silver halide grains sense the light having a wavelength longer than that region, a technique of making sensitizing dyes adsorbed on the surfaces of silver halide grains absorb the light and transmitting the light energy to the grains is used. This so-called "spectrally sensitizing technique" has become an essential and important technique for enhancing the sensitivity of silver halide photosensitive materials. Tabular silver halide, which is widely used nowadays, has a high light permeability and a low absorptivity even in its intrinsic absorbing region. Therefore, spectral sensitization has an important role even in the intrinsic region.

The light absorptivity achieved by spectrally sensitizing dyes on the surfaces of silver halide grains can be improved by increasing the amount of dyes adsorbed per unit grain surface area by use of dyes having a high molecular extinction coefficient.

For this purpose, many photographic systems have employed so-called J-aggregating cyanine dyes, which have a high molecular extinction coefficient and which are believed to adsorb to and pack together on the dye molecules' "edge" surface which allows the maximum number of dye molecules to be placed on the grain surfaces.

Tabular silver halide has also been used as a measure for increasing the amount of sensitizing dyes which can adsorb. Increasing the surface area of grains by making the grains have a tabular form and allowing the aforementioned J-aggregating cyanine dyes to adsorb onto the surfaces of the grains can increase the light absorptivity. Therefore, tabular grains have been used in many photographic systems.

However, despite such efforts, there are limitations to the amount of sensitizing dyes which can adsorb to the surface of a silver halide grain. It is impossible to allow dyes to adsorb in an amount more than that achieved by monolayer saturation adsorption (i.e., monolayer adsorption). Therefore, in most photographic systems, it is still the case that not all the available light is being collected.

Described below are methods proposed as methods by which a greater light absorption can be achieved for solving that problem.

One method is an approach to make a plurality kinds of dyes adsorb onto silver halide grains by multi-layered adsorption, thereby causing Forster type excitation energy transfer. This was proposed by G. R. Bird in Photographic Science and Engineering, Vol. 18, page 562 (1974). Another approach proposed in U.S. Pat. Nos. 2,518,731, 3,622,316, 3,976,493 and 3,976,640 and Japanese Patent Application KOKAI Publication No. (hereinafter referred to as JP-A-) 63-138341 is to use dyes in which two dye chromophores are covalently connected. As a method for improve the Bird's proposal, Ukai et al. proposed in JP-A-64-91134 a method in which at least one substantially non-adsorbing dye containing at least two sulfo and/or carboxyl groups selected from cyanine dyes, merocyanine dyes and hemicyanine dyes is linked to an adsorbing dye. This method, however, is defective from the facts that when two kinds of dyes are linked, their performances are, contrary to expectations, disturbed mutually so that they cannot aggregate or adsorb properly on silver halide grains and therefore only an enhancement in sensitivity less than expected is obtained; a great increase in dye molecule volume caused by the linking reflects dye stain after development (unfavorable increase in D-min caused by a sensitizing dye remaining after development); and complication of production reflects a great increase in the cost of the linked dye, which also increases the production cost of photosensitive materials.

As a method using linked dyes, L. C. Vishwakarma, JP-A-6-57235 propose a method of using a dye in which a monomethine cyanine dye and a pentamethine oxonol dye are covalently connected. However, in this case, spectral sensitization due to Forster type excitation energy transfer between dyes was not effected because the luminescence of the oxonol dye did not overlap with the absorption of the cyanine dye. Therefore, higher sensitization by the light converging function of the connected oxonol dye cannot be aimed.

Another approach is a method in which, contrary to the aforementioned methods, two dye chromophores are not connected.

As this approach, Sugimoto et al. disclose in JP-A's-63-138341 and 64-84244 spectral sensitization utilizing energy transfer from luminescent dyes using an emulsion spectrally sensitized with an adsorbing sensitizing dye used in combination with a non-adsorbing luminescent dye which is located in gelatin. As a similar approach, R. Steiger et al. propose, in U.S. Patent No. (hereinafter referred to as USP) U.S. Pat. No. 4,040,825 and U.S. Pat. No. 4,138,551 and R. Steiger, Photographic Science and Engineering, Vol. 27(2), page 59 (1983), silver halide photosensitive material spectrally sensitized with an adsorbing sensitizing dye used in combination with a second dye which is bonded to gelatin.

However, the problem with this approach is that although the dyes are less likely to interfere with one another, efficient energy transfer will not occur unless the dye not adsorbed to the grain is in close proximity to the dye adsorbed on the grain (less than 50 angstroms separation) (see T. Forster, Annalen der Physiks, Vol. 6 (2), page 55 (1948) and T. Forster, Discussions Faraday Society., Vol. 27, page 7 (1959)). Most non-adsorbing dye will not be close enough to the silver halide grain for energy transfer and, therefore, will act only as a filter dye leading to a speed loss. An analysis of this problem is given by Steiger et al. (see R. Steiger, Photographic Science and Engineering, Vol. 27(2), page 59 (1983)).

A better method proposed is to form two or more dye layers on silver halide grains. P. B. Gilman discloses, in P. B. Gilman, Photographic Science and Engineering, Vol. 20(3), page 97 (1976), a method in which a cation dye is made adsorb as a first layer which adsorbs directly to a silver halide grain and an anion dye which can absorb the light of a wavelength longer than the dye of the first layer is used. However, this method cannot cause the Forster type efficient excitation energy transfer from the dyes of the second layer to the dyes of the first layer.

G. R. Bird et al. propose in JP-A-64-91134 a similar system which is so designed that the dyes in the second or outer layer (namely, the outer dye layer) can absorb the light of a wavelength shorter than the dye of the first layer (namely, the inner dye layer which is adsorbed directly to the silver halide grain). However, this proposed method makes color reproduction very poor because it forms a sensitization region of an extremely wide wavelength range and therefore the same silver halide grain senses both green light and red light.

Yamashita et al. also disclose a method in which two or more kinds of cyanine dyes are used and multi-dye layers satisfying the necessary condition provided by G. R. Bird et al. are formed on a silver halide grain. They disclose in JP-A's-10-123650 and 10-239789 that the necessary condition is to use a dye having an aromatic group and that a preferred necessary condition is to use a cation and anion dyes both having an aromatic group. However, this approach is disadvantageous in that to make the dyes have aromatic groups can lead to large amounts of retained dye after processing, which affords greatly increased D-min. In silver halide color photosensitive material, a silver halide-containing layer is made to contain an emulsion including an emulsified and dispersed coupler capable of forming color by being coupled with an oxidized developing agent during development. However, the method is disadvantageous in that the multi-layeredly adsorbed layers are damaged if that emulsion is made to exist together with them.

Yamashita et al. disclose, as an approach which can improve the above-mentioned disadvantage, a method in which a cation and anion dyes having poly-electric charges are combined to form multi-dye layers (see JP-A-10-171058). A concept and a method the same as those mentioned above are disclosed by R. L. Parton et al. in JP-A's-2000-89405 and 2001-117192. It is also disclosed in JP-A-2001-117191 that a preferable multi-dye layers can be formed when at least one of the dyes is further substituted with a hydrogen bonding donor substituent.

These approaches are superior, as approaches for forming multi-dye layers, to those heretofore proposed, but are not yet satisfactory. In other words, despite some improvement accomplished, it is still the case that when a color coupler emulsion is made exist, the multiple adsorbed layers formed cannot be maintained, leading to decrease in dye adsorption amount.

That is, the interaction between the outer layer dye that is not adsorbed directly to the silver halide grain and the inner layer dye that is adsorbed directly to the grain is still weak, and therefore desorption of the outer layer dye arises when the emulsion is left to stand for a long time in a dissolved state or the photosensitive material is store under a high temperature and a high humidity. This leads to decrease in absorbing intensity together with decrement in speed. Especially in a silver halide color photosensitive material, various water-insoluble photographically useful compounds are dissolved in a high boiling organic solvent, and added in a form of an aqueous dispersion in which the organic solvent is emulsified. It is well known for the relevant technicians that the sensitizing dye that absorbs to silver halide grains is apt to be desorbed by the dispersion. Various improvements have been done for suppressing the desorption. However, even with such improving techniques, the interaction between the inner layer dye and the outer layer dye in the multi-layered dye layer is still weak compare with that between sensitizing dyes that absorb directly to silver halide grains, as mentioned above. Accordingly, significant desorption of the outer layer dyes arises when the emulsion to which the aqueous dispersion is added is left to stand for a long time in a dissolved state or the photosensitive material is stored in a high temperature and a high humidity conditions. As a result, even if the absorbing intensity and speed are greatly increased by forming the outer dye layer, actually, almost all of it are lost. In the course of preparation, it is necessary for an emulsion in which sensitizing dyes are adsorbed to store in a dissolved state before coating the emulsion.

On the contrary, a technique of using an aqueous dispersion of water-insoluble photographically useful compounds such as couplers which was prepared by using a specific surfactant and a specific high boiling organic solvent, is disclosed in for example JP-A-2002-148767. Although such improving technique attain a certain improvement, it is not still unsatisfactory for applying it to a practical production.

BRIEF SUMMARY OF THE INVENTION

The objects of the present invention are to provide a method for greatly improving the light absorption performance even in the presence of a photographically useful compounds such as a color coupler emulsion, thereby bringing the performance close to the state in which all the available light are collected, and to provide a silver halide photographic emulsion having an efficiently enhanced photographic sensitivity and a silver halide photographic photosensitive material using the emulsion.

The above objects are attained by the following means.

(1) A silver halide emulsion comprising silver halide grains each of which are covered with at least two dye layers in combination, wherein the at least two dye layers comprising: (a) an inner dye layer adjoining to the silver halide grain, and containing at least one kind of spectrally sensitizing dye capable of spectrally sensitizing silver halide, and (b) an outer dye layer adjoining to the inner dye layer (a), and containing at least two kinds of dyes, wherein the light absorption energy of the outer dye layer is equal to or higher than the light absorption energy of the inner dye layer, an energy-releasing wavelength of the outer dye layer overlaps with an energy-absorbing wavelength of the inner dye layer, the spectrally sensitizing dyes constituting the inner dye layer include an anion dye and/or a betaine dye, the at least two kinds of dyes constituting the outer dye layer include an anion dye and a cation dye, and the anion dye in the outer dye layer is more than the cation dye in the outer dye layer in terms of an addition amount and/or an adsorption amount.

(2) The silver halide emulsion according to the above (1) wherein the spectrally sensitizing dye constituting the inner dye layer is a cyanine dye exhibiting J band type absorption on the silver halide grain.

(3) The silver halide emulsion according to the above (1) or (2) wherein both the cation dye and the anion dye constituting the outer dye layer are dyes exhibiting J band type absorption in an aqueous gelatin solution.

(4) The silver halide emulsion according to any one of the above (1) to (3) wherein both the cation dye and the anion dye constituting the outer dye layer are cyanine dyes.

(5) The silver halide emulsion according to any one of the above (1) to (4) wherein the at least two dye layers were formed by a process comprising: forming the inner dye layer, and then adding a compound having a group that firmly adsorb to silver halide, preferably a compound represented by formula (M) to be described later, and then forming the outer dye layer.

(6) The silver halide emulsion according to any one of the above (1) to (5) wherein the silver halide grains comprise tabular silver halide grains.

(7) The silver halide emulsion according to the above (6) wherein the tabular silver halide grains include tabular silver halide grains each containing a region having, along edges thereof, a maximum surface iodide concentration, and containing another region having, at a corner thereof, a lower surface iodide concentration than the iodide concentration of the region having a maximum surface iodide concentration.

(8) The silver halide emulsion according to the above (6) or (7) wherein 50% or more of the total projected area of all the silver halide grains are occupied by tabular grains each having (111) main planes, the tabular silver halide grains having an epitaxial junction portion, and the tabular silver halide grains having a latent image-forming chemical sensitization portion on the surfaces thereof, wherein the latent image-forming chemical sensitization portion contains at least one same kind of silver salt as a silver salt(s) forming the epitaxial junction portion, the latent image-forming chemical sensitization portion is located closest to a peripheral edge of the (111) main plane of the tabular grain, and is confined to a portion occupying less than 50% of an area of the main plane.

(9) A silver halide emulsion prepared by mixing silver halide grains each of which are covered with at least two dye layers in combination, wherein the at least two dye layers comprising: (a) an inner dye layer adjoining to the silver halide grain, and containing at least one kind of spectrally sensitizing dye capable of spectrally sensitizing silver halide, and (b) an outer dye layer adjoining to the inner dye layer (a), and containing at least two kinds of dyes, wherein the light absorption energy of the outer dye layer is equal to or higher than the light absorption energy of the inner dye layer, an energy-releasing wavelength of the outer dye layer overlaps with an energy-absorbing wavelength of the inner dye layer; and a hydrophilic dispersion of a water-insoluble photographically useful compound containing a surfactant and a high-boiling organic solvent, wherein a $\gamma$ value in the hydrophilic dispersion is 0.020 or more but less than 0.390 wherein the $\gamma$ value is a ratio of an amount of the surfactant to an amount of the high-boiling organic solvent.

(10) The silver halide emulsion according to the above (9) wherein the $\gamma$ value in the silver halide emulsion is 0.020 or more but less than 0.390.

(11) The silver halide emulsion according to the above (9) or (10) further having the features described in any one of above (1) to (7).

(12) A method of preparing the silver halide emulsion according to the above (9) or (10) wherein the method comprises: dissolving the water-insoluble photographically useful compound into the high-boiling organic solvent to obtain a solution, and dispersing the solution and the surfactant to a hydrophilic colloid thereby to obtain the hydrophilic dispersion of a water-insoluble photographically useful compound.

(13) The method of preparing the silver halide emulsion according to the above (12) wherein the method further comprises, for obtaining the hydrophilic dispersion of a water-insoluble photographically useful compound, performing ultrafiltration and/or ion exchange.

(14) A silver halide photosensitive material having at least one emulsion layer containing the silver halide emulsion according to any one of above (1) to (11) or the silver halide emulsion prepared by the method according to (12) or (13).

(15) The silver halide photosensitive material according to the above (14) wherein the $\gamma$ value in an emulsion layer containing the silver halide emulsion is 0.020 or more but less than 0.390.

(16) The silver halide photosensitive material according to the above (14) wherein the $\gamma$ value in the photosensitive material is 0.020 or more but less than 0.390.

According to the present invention, a silver halide emulsion, particularly a silver iodobromide emulsion, which has high spectral sensitivity and excellent storability, and a method of preparing such an emulsion may be provided. Further, a silver halide photosensitive material, particularly a silver halide color photosensitive material, having a high speed and excellent storability may be provided.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawing, which is incorporated in and constitute a part of the specification, illustrates presently preferred embodiment of the invention, and together with the general description given above and the detailed description of the preferred embodiment given below, serve to explain the principles of the invention.

The single FIGURE is a schematic view of ultrafiltration for a hydrophilic dispersion of a water-insoluble photographically useful compound.

DETAILED DESCRIPTION OF THE INVENTION

The present invention will be described in detail below.

As mentioned above, in preferred embodiments of the present invention silver halide grains have dye layers that are held together by non-conjugated attractive forces. Examples of non-conjugated attractive forces include electrostatic attraction, hydrophobic interactions, hydrogen-bonding, van der Waals interactions, dipole-dipole interactions, dipole-induced dipole interactions, London dispersion forces, cation-$\pi$ interactions or any combinations thereof.

In the present invention, the surface of a silver halide grain is covered with at least two dye layers. The at least two dye layers comprise (a) an inner dye layer adjoining to the silver halide grain and (b) an outer dye layer adjoining to and outside this inner dye layer (a). In the present invention, the inner dye layer (a) is referred to one forming a monomolecular layer in which at least one kind of a spectrally sensitizing dye is adsorbed in an amount equal to a saturated adsorption amount or an amount close to the saturated adsorption amount. The outer dye layer (b) is referred to one that is present outside this inner dye layer (a). The amount of the dye contained in the outer dye layer is 70% to 100%, preferably 75% to 95%, more preferably 80% to 90% of the monolayer saturated adsorption amount.

The amount of the dye which saturatedly covers on the silver halide surface may be determined from a dye adsorption isotherm obtained by preparing a dye concentration series, causing a silver halide emulsion to adsorb the dye, then centrifugally precipitating silver halide grains, determining the amount of the dye adsorbed on the silver halide grains and plotting that amount versus the unabsorbed dye concentration. When a plurality of kinds of dyes are adsorbed on the silver halide surface the saturated adsorption amount is an adsorption amount per area reached by a dye having the smallest dye-occupied area on the silver halide grain. The dye-occupied area can be determined from an adsorption isothermal line showing the relationship between free dye concentration and adsorbed dye amount, and a grain surface area. The adsorption isothermal line can be determined with reference to, for example, A. Herz et al. "Adsorption from Aqueous Solution", Advances in Chemistry Series, No. 17, page 173 (1968).

In a preferred embodiment of the present invention, the inner dye layer (a) is a saturation or near saturation monolayer of one or more kinds of dyes capable of spectrally sensitizing silver halide which have a negative net charge or in which one substituent has a negative charge and the net charge is zero. The dyes of the outer layer (b) are not necessarily a spectral sensitizer and are composed of a combination of at least two kinds of dyes: a dye having a positive net charge and a dye having a negative net charge in an amount larger than the other.

The sum of the amount of the sensitizing dyes that is composed of the inner dye layer (a) and the amount of the dyes that is composed of the outer dye layer (b) is preferably 1.2 times or more, more preferably 1.4 times or more, and much more preferably 1.6 times or more of the monolayer saturated adsorption amount. Although there is no specific upper limit of the sum of the amount of the sensitizing dyes that is composed of the inner dye layer (a) and the amount of the dyes that is composed of the outer dye layer (b), the upper limit is preferably 2.6 times or less, more preferably 2.3 times or less, more preferably 2.0 times or less in view of energy transfer efficiency and stain after development processing and the like. When the sum of the sensitizing dyes that is composed of the inner dye layer (a) and the dyes that is composed of the outer dye layer exceeds 2 times of the monolayer saturated adsorption amount, the outer dye layer (b) is, form the view point of the saturated adsorption amount, is composed of a plurality of sub outer dye layers, i.e., a first sub outer dye layer, a second sub outer dye layer, and so on. In this case, the kind of the dye that is composed of the first sub outer dye layer and the kind of the dye that is composed of the second or later sub outer dye layer may be the same or different.

The actual adsorption amount of spectrally sensitizing dyes added to a silver halide emulsion can be measured easily by a method using high performance liquid chromatography (HPLC).

A silver halide emulsion in which a sensitizing dye of the present invention has been added is subjected to centrifugal sedimentation under light-shielded conditions and the precipitated silver halide grains on which dyes have been adsorbed are freeze dried. The central portion of a freeze dried pellet of the silver halide grains on which dyes have adsorbed is sampled in an appropriate amount and then is dissolved in a 2:1:1 mixed solution of 10% aqueous sodium thiosulfate solution/dimethylformamide (DMF)/methanol. Subsequently, this solution is diluted twice with an HPLC eluant and then is injected into an inlet of an HPLC equipped with a guard column. Thus, separation and quantitative measurement were conducted at 25° C. The conditions of HPLC measurement are as follows. The column was Capcell Pak C1 4.6 mmϕ×250 mm manufactured by Shiseido Co., Ltd. The eluent was a 1:1 mixed solution of liquid I and liquid II. Liquid I is a solution prepared by dissolving 0.475 g of guanidine hydrochloride in 950 milliliter (hereinafter referred to as "mL") of water, adding to the resulting solution 25 mL of PIC B8 (Waters Corp. of USA), and adding to the resulting solution a 1:4 mixed solution of acetonitrile/methanol until the total volume becomes 1 liter (hereinafter referred to as "L"). Liquid II is a solution prepared by adding a 1:4 mixed solution of acetonitrile/methanol to a mixed solution of 0.475 g of guanidine hydrochloride, 50 mL of water and 25 mL of PIC B8 until the total volume becomes 1 L.

Regarding the outer layer dye, dyes having a net charge opposite to the inner layer dye and a technique including a combination of a positively charged dye and a negatively charged dye have already been disclosed in JP-A-64-84244, etc. However, in the production of silver halide photosensitive materials, use of a surfactant is essential for the application of a silver halide emulsion on a support. In the production of color photosensitive materials, water-insoluble photographically useful compounds such as a coupler are dissolved in a high-boiling organic solvent and a hydrophilic dispersion into which the solution is dispersed by emulsification in the presence of a surfactant, is allowed to co-present. When a positively charged dye is used as the outer layer dye as in the product mentioned above, most of the outer layer dyes desorbed due to the co-presence of an emulsified product of a coupler or this surfactant.

Even in the case where positively charged dyes and negatively charged dyes are used as outer layer dyes, the techniques which have ever disclosed including the aforementioned patent documents only disclose a technique which uses a small amount of a negatively charged dye as supplement to a positively charged dye when a negative or zero net charge dye is used as a inner layer dye. In such a case, the co-presence of an emulsified product of a coupler and the surfactant will cause a great desorption of outer layer dyes and therefore such a system is far from a technique which can be employed for practical production.

On the other hand, no example is known in which a positively charged dye is used as an outer layer dye together with a negatively charged dye in an amount larger than that of the positively charged dye.

For the purpose of fixing an outer layer dye utilizing electrostatic attraction when a negatively charged dye is used as an inner layer dye, to use only or mainly a positively charged dye as the outer layer dye would seem reasonable. However, such an attempt will result in formation of only multi-layered dye adsorption which is so weak that the dye will suffer from desorption caused by an emulsified product of a coupler and a surfactant as previously described.

The present inventors have found that when, as the outer layer dyes, a positively charged dye is used in combination with a negatively charged dye in an amount larger than that of the positively charged dye, almost no reduction in absorption or sensitivity due to desorption of dyes is caused even if an emulsified product of a color coupler and a surfactant is present or if the liquid emulsion in which the emulsified product of a color coupler and a surfactant is co-present is stored for a long time or if a sample to which the co-presented product is coated is stored at high temperature and high humidity. In addition, to our surprise, when this method was used, the co-presence of the emulsified product of a color coupler and a surfactant resulted not in a decrease but in an increase of absorption and adsorption of the dyes. When a surfactant or emulsion of a color coupler was absent, the negatively charged dye used to adsorb in an amount up to that of the positively charged dye. However, the negatively charged dye, which has not been able to adsorb in the presence of an emulsified product of a color coupler and a surfactant, became able to adsorb in the present invention.

On the other hand, as examples of using a positively charged dye as an inner layer dye, disclosed are an example using a negatively charged dye and an example using both a positively charged dye and a negatively charged dye, as an outer layer dye. However, use of a positively charged dye as an inner layer dye readily causes fogging even in a monolayer coating or less and therefore it cannot be applied for high-speed silver halide emulsions at all. No commercially available high-speed silver halide photosensitive materials use a positively charged dye as an inner layer dye. Therefore, even if a negatively charged dye is used as an outer layer dye, fogging will occur if a positively charged dye is used in an inner layer. Because of only such fogging, this type of material can not be used in practice.

Further, the present inventors also found that in an emulsion comprising silver halide grains each of which are covered with at least two dye layers in combination, wherein the two dye layers comprising an inner layer adjoining to each of the silver halide grains and containing at least one kind of a spectrally sensitizing dye capable of spectrally sensitizing silver halide, and an outer dye layer adjoining to the inner dye layer and containing at least two kinds of dyes; desorption of the sensitizing dye, especially the desorption of the sensitizing dye in the outer layer, which is caused by the presence of an emulsified dispersion of a coupler, may be reduced by controlling the amount of a surfactant and the amount of a high-boiling organic solvent in the emulsified dispersion, and/or in an emulsion containing the emulsified dispersion and the silver halide grains to which spectrally sensitizing dyes are adsorbed in multi-layered manner, and/or in a hydrophilic colloid layer containing the emulsion.

Further, in addition to the combined use, as the outer layer dyes, of a positively charged dye with a negatively charged dye in an amount larger than that of the positively charged dye, the control of the amount of a surfactant and the amount of a high-boiling organic solvent mentioned above is applied in combination, the desorption of the sensitizing dye and the resulting decrements in absorption intensity and speed can be largely suppressed to the extent that is sufficient for practical use, even if the silver halide emulsion is left to stand in a liquid state for a long time while co-presenting the emulsified dispersion of a coupler and etc., or even if a photosensitive material having at least one layer comprising the emulsified dispersion and the silver halide emulsion is left to stand in high temperature and high humid conditions.

A ratio of a surfactant to a high-boiling organic solvent in the present invention is one represented by $\gamma=A/B$, wherein A (g) is the amount in gram of the surfactant, and B (mL) is the amount in volume of the high-boiling organic solvent. When this ratio is applied to a hydrophilic dispersion of a water-insoluble photographically useful compound and to an emulsion comprising the hydrophilic dispersion and silver halide emulsion containing silver halide grains on each surface of which at least two dye layers are covered which are comprising an inner dye layer and an outer dye layer, the amounts are those per unit weight thereof. When this ratio is applied to a specific emulsion layer in a photosensitive material and to a photosensitive layer, the amounts are those per unit area thereof.

The amounts of the surfactant and high-boiling organic solvent in the photosensitive material, those in a specific emulsion layer, and those in an emulsion and emulsified dispersion of a coupler and etc., can be determined by taking a unit area of the whole coatings except a support and by taking a unit area of only the specific emulsion layer from the coatings, respectively, and extracting and isolating the surfactant and high-boiling organic solvent, and serving them to liquid chromatography, etc. The amounts of the surfactant and high-boiling organic solvent in an emulsion and in an emulsified dispersion of a coupler and etc., can be determined by extracting and isolating the surfactant and high-boiling organic solvent from the emulsion and emulsified dispersion, and serving them to liquid chromatography, etc.

In order for the sensitizing dyes on the surface of a silver halide emulsion to keep its stable adsorption condition and to improve a sensitivity-to-granularity ratio or a preservability, it is preferable that $\gamma$ be maintained at not less than 0.020 but less than 0.390, more preferably not less than 0.039 but less than 0.293, and still more preferably not less than 0.049 but less than 0.234. In order not to lead to coating failure, $\gamma$ value should not be too small.

The term "water-insoluble" referred to in the this specification means that when a required amount of a photographically useful compound is added to a photographic element, the compound cannot be added entirely as an aqueous solution into a coating composition, even if the coating composition is diluted to a limit concentration within an applicable range, owing to the insufficient water solubility. Usually, the term "water-insoluble" is used for a compound having solubility to 100 g of water at 20° C. of 10 or less. A excellent advantage may be exhibited in the present invention, for a compound having solubility to 100 g of water at 20° C. of 5 or less.

The water-insoluble photographically useful compound that can be used in the present invention may include, for example, dye-image-forming couplers, dye-image-providing redox compounds, stain inhibitors, antifoggants, ultraviolet absorbers, anti-fading agents, color mixing prevention agents, nucleating agents, silver halide solvents, bleach accelerators, filter dyes and precursors thereof, dyestuffs, pigments, sensitizers, hardeners, bleaching agents, desensitizers, antistatic agents, antioxidants, scavengers for oxidized developing agents, mordants, matte agents, development accelerators, development inhibitors, thermal solvents, color-tone-adjusting agents, lubricants and polymer latexes for dispersion of these compounds, which are used as a medium for dispersing them, water-insoluble inorganic salts (such as zinc hydroxide), and film strength improvers. These water-insoluble photographically useful compounds are generally emulsified or dispersed into solid fine particles by mechanical force as oil-in-water dispersions (emulsions) or solid fine particles dispersions that are dispersed in water or hydrophilic colloid, and these dispersions are used for photographic emulsion layers or other layers. The water-insoluble photographically useful compounds are described, for example, in Research Disclosure (R. D.) Nos. 17643, 18716, 307105, and 40145, the contents of which are incorporated herein by reference.

There are no limitations on the amount of the aqueous dispersion to be added, but it is preferably not less than 0.01 $g/m^2$ but less than 500 $g/m^2$ in terms of coating amount.

As an example of water-insoluble photographically useful compounds, a dye-image-forming coupler may be mentioned. Usually, for photographic use, a dye-image-forming coupler, a high-boiling organic solvent (having a boiling point above 80° C., and preferably above 175° C.), and, to impart solubility, a low-boiling organic solvent (having a boiling point from 30 to 160° C.), are mixed into a solution, and the composition and a hydrophilic colloidal solution are emulsified in the presence of a surfactant.

Regarding the dye-image-forming coupler and the high-boiling organic solvent, a higher solubility of the former in the latter is preferred. The melting point of the coupler at a pressure of 1 atmosphere is preferably up to 155° C., more preferably up to 125° C., and still more preferably up to 100° C. A technique of using a plurality of couplers and lowering the melting point by using the melting point lowering effect to improve the solubility is preferably used. In the present invention, the melting point for the mixture of a plurality of water-insoluble photographically useful compounds, except for the high-boiling organic solvent and the dispersion aid, is preferably lower than the volume weighted mean value of the melting point of each of the compounds by more than 2° C., more preferably, by more than 4° C.

The hydrophilic binder to which a composition. containing the water-insoluble photographically useful compound of the present invention is dispersed preferably contains a water-soluble protective colloid. As the protective colloid, known compounds can be used, and they can include, for example, polyvinyl alcohol, polyethylene oxide, polyvinyl pyrrolidone, polyacrylic acid, polyacryl amide, polysaccharides, casein and gelatin. Gelatin is particularly preferred. Water is used for a dispersing medium of the hydrophilic dispersion.

For a surfactant contained in a hydrophilic dispersion of a water-insoluble photographically useful compound used in the present invention, known surfactants may be used. Examples of conventionally disclosed dispersion aids can include anionic dispersants, such as alkylphenoxyethoxyethanesulfonic acid salt, polyoxyethylene alkylphenylethersulfonic acid salt, alkylbenzenesulfonic acid salt, alkylnaphthalenesulfonic acid salt, alkylsulfuric acid ester salt, alkyl sulfosuccinic acid salt, sodium oleylmethyltauride, maleic acid/acrylic acid copolymer, carboxymethylcellulose, and cellulose sulfate; nonionic dispersants, such as polyoxyethylenealkyl ether, sorbitan fatty acid ester, polyoxyethylenesorbitan fatty acid ester, and polyalkyleneoxide block polymer; cationic dispersants; and betain-series dispersants. The amount of the surfactant used in the conventional method 30% by weight or less of the materials to be dispersed, which are the sum of a water-insoluble photographically useful compound and a high-boiling organic solvent when the high-boiling organic solvent is used, while a water-insoluble photographically useful compound when a high-boiling organic solvent is not used. There is no lower limit of the amount of a surfactant to be used, 0.01% by weight or more is preferable.

By the "high-boiling organic solvent" used in the present invention is meant a lipophilic solvent having a boiling point of about 175° C. or more at a normal pressure, and water immiscible (solubility to water at 25° C. is 5% by weight or less, preferably 1% by weight or less). As long as the high-boiling organic solvent suits the purpose of it use, it may be either liquid or solid under normal temperature and normal pressure, or may have either a low molecular weight or high molecular weight (or may be polymer). Typical structures include phthalates, trimellitates, phosphates, phosphonates, phosphinates, phosphine oxides, aliphatic acid esters (e.g. monobasic aliphatic acid esters, dibasic aliphatic acid esters, tribasic aliphatic acid esters and polyol esters), benzoates, phenols, alcohols, amides, anilines, polyacrylates, polyacrylic amides and condensed polyesters. Specific compounds are well known to skilled persons in the art.

The high-boiling organic solvent is constituted of a polar structure (carboxylic acid ester, carboxylic acid amide, phosphoric acid ester, phosphonic acid ester, phosphonic acid amide, phosphinic acid ester, phosphinic acid amide, phosphoryl, a hydroxyl group bonding to a carbon atom, a halogen atom bonding to a carbon atom, an oxygen atom bonded to carbon atoms at both ends, or a nitrogen atom bonding to three carbon atoms) and a hydrophobic group (alkyl, alkenyl, alkinyl, aralkyl, aryl, alkylene, alkenylene, alkinylene, aralkylene, or arylene), but it does not include any functional groups other than those mentioned above. Moreover, the high-boiling organic solvent in the present invention does not contain structures of hydroquinone, catechol, hindered phenol or hindered amine.

In the present invention, compounds which are known to persons skilled in the art to have the functions enumerated below as their major functions are not included in the high-boiling organic solvent. For example, anti-fading agents(e.g., radical scavengers and energy quenchers), ultraviolet absorbers, scavengers for oxidized developing agents (e.g., color mixing prevention agents, toe-deflection controlling agents and competing compounds), scavengers for developing agents, post-development image intensification inhibitors, inhibitors to stain caused by light, heat or moisture, and bleach stain inhibitors are not included in the high-boiling organic solvent.

The amount of the high-boiling organic solvent to be added has no limitation, but it is preferably not less than 0.001 $mL/m^2$ but less than 200 $mL/m^2$ in terms of the application amount.

To provide a layer containing the hydrophilic dispersion of the water-insoluble photographically useful compound to make a photographic photosensitive material, it can be achieved by dispersing the thus obtained dispersion in an appropriate binder to prepare a approximately uniform coating composition, and then coating the composition on a desired support.

There is no particular restriction on the binder, as long as it is a hydrophilic colloid which can be used in a light-sensitive emulsion layer or a light-insensitive layer, and gelatin or a synthetic polymer, such as polyvinyl alcohol and polyacryl amide is generally used.

For the coating composition, it is preferred that the prepared dispersion be rapidly mixed with other coating ingredients, and coated within a residence time of 20 minutes after mixing. In this process, even a dispersion, which is unstable in a dispersed state and tends to cause coagulation or change of particle size, after preparation, can be taken into the coating film with no substantial deterioration. For promoting mixing with other coating ingredients, it is preferred to directly mix a liquid flow going out from the liquid outlet of the dispersing device with a liquid flow of other coating ingredients in-line, without storage, for example, by using a static mixer. The mixing is conducted within generally 10 minutes, preferably, within 5 minutes and, more preferably, within 1 minute after the preparation. For example, the time from the preparation up to the coating of the coating composition is defined in JP-A-3-223839.

Next, an emulsification method preferred in the present invention will be described.

As the emulsification method, agitation with a stirrer, high-speed shearing using a homomixer, milling by means of a colloid mill are commonly used. Further, a method utilizing ultrasonic waves may also be employed. Further, there are methods, wherein colliding a liquid flow under pressure against a wall, or colliding liquids flow against each other, thereby dispersing the material finely by impact shocks or shearing forces, as in a Manton-Gaulin homogenizer. Further, JP-A-6-308691 discloses use of a high-pressure homogenizer. In addition, methods using an ultrasonic homogenizer and a flow-jet mixer are also available.

Further, as described, for example, in U.S. Pat. Nos. 4,933,270 and 4,957,867, a method for precipitating a dispersion from a homogeneous system has been proposed. Further, a method for dividing droplets through a porous glass membrane and an emulsification method using electrocapillarity have been proposed.

As the step for controlling the ratio γ of the surfactant and the high-boiling organic solvent surface area ratio in the silver halide photographic photosensitive material, ultrafiltration may be employed for the hydrophilic dispersion of the water-insoluble photographically useful compound before its coating. The dehydration and desalting techniques by ultrafiltration for use in the present invention are described in Research Disclosure, Vol. 102, Item 10298, and ibid., Vol. 131, Item 13122. These techniques are also disclosed in U.S. Pat. Nos. 4,334,012, 5,164,092 and 5,242,597, European Patents 795,455 and 843,206, JP-A's-8-278580 and 11-231449.

The membrane module obtained by integrating the membrane used as the ultrafiltration membrane for use in the present invention into a container includes a tubular module, a hollow yarn module, a pleated module, a spiral module, a flat membrane module and a plate & frame module. Among these, a hollow yarn module and a flat membrane module are preferred.

For the ultrafiltration membrane for use in the present invention, various materials can be used. As for the main material for useful ultrafiltration membranes, for example, polyacrylonitrile, polysulfone, polyimide, polyethersulfone, cellulose acetate, polyvinyl chloride, polyvinyl acetate, polyvinyl alcohol and ceramics such as aluminum oxide are preferably used.

A fractional molecular weight is an index for the performance of the ultrafiltration membrane for use in the present invention. The fractional molecular weight is a molecular weight of giving a blocking percentage (a percentage obtained by dividing the difference between the concentration of supplied solution and the concentration of permeated solution by the concentration of supplied solution) of 90% or more. A fractional molecular weight of not passing a water-insoluble component containing a water-insoluble photographically useful compound but passing unnecessary surfactant is preferred. If the fractional molecular weight is small, the flow rate of the solution permeated through the ultrafiltration membrane decreases. Therefore, an optimal fractional molecular weight must be selected. The useful fractional molecular weight is from 1,000 to 1,000,000, preferably from 3,000 to 100,000.

A schematic view depicting one example of removing a surfactant in a hydrophilic dispersion of a water-insoluble photographically useful compound by ultrafiltration in the present invention is shown in FIGURE. In FIGURE, a dispersion solution containing a hydrophilic dispersion of the water-insoluble photographically useful compound in a reactor 1 is stirred by a stirrer 2 and transferred to an ultrafiltration membrane 13 through a liquid supply pipeline 9, a pump 10 and a supply valve 11. The dispersion solution containing a hydrophilic dispersion of the water-insoluble photographically useful compound passes through the ultrafiltration membrane while partially discharging water, salts and the like through a liquid permeation pipeline 18, a permeation valve 20 and a permeation flow meter 21. At this time, a check valve 27 is closed. The remaining dispersion solution containing a hydrophilic dispersion of the water-insoluble photographically useful compound is returned to the original reactor 1 through a liquid reflow pipeline 14, a reflow valve 16 and a reflow meter 17. Before and after the passing of the dispersion solution containing a hydrophilic dispersion of the water-insoluble photographically useful compound through the ultrafiltration membrane, pressure gauges 12, 15 and 19 are provided. In order to return the dispersion solution containing a hydrophilic dispersion of the water-insoluble photographically useful compound remaining on the ultrafiltration membrane, a part of the permeated solution may be passed to the ultrafiltration module through a backwash pipeline 24, a backwash pump 25, a backwash valve 26, a check valve 27, a permeation valve 20 and a liquid permeation pipeline 18 after the completion of ultrafiltration, so that the dispersion solution containing a hydrophilic dispersion of the water-insoluble photographically useful compound adsorbed to the ultrafiltration membrane can be returned to the original reactor through the liquid reflow pipeline 14, the reflow valve 16 and the reflow meter 17. The permeated solution as an aqueous solution for backwash may be replaced by water, an aqueous solution prepared by diluting the permeated solution with water, or an aqueous solution after the pBr is adjusted.

In the ultrafiltration of the present invention, the reflow and permeation flow rates can be controlled by controlling the reflow valve or permeation valve. The permeation flow rate can be increased by increasing the flow rate of pump or by throttling the reflow valve to increase the reflow rate and elevating the supply pressure. For increasing the permeation amount, a method of connecting two or more ultrafiltration modules in parallel or in series and thereby increasing the membrane area is preferred.

As the step for controlling the ratio γ of the surfactant and the high-boiling organic solvent in the silver halide photographic photosensitive material or in the hydrophilic dispersion of a water-insoluble photographically useful compound, the hydrophilic dispersion of the water-insoluble photographically useful compound may be subjected to ion exchange before its application. Methods available for ion exchange include a method in which the hydrophilic dispersion of the water-insoluble photographically useful compound is dissolved, the resulting solution is mixed and stirred with ion exchange resin, and after being left to stand, the ion exchange resin is removed by filtration or the like, and a method in which the water dispersion is caused to pass through a column in which ion exchange resin is packed. The ion exchange resin to be used include cation exchange resin and anion exchange resin. Examples of the cation exchange resin include styrene-based resin, methacrylic acid-based resin and acrylic acid-based resin. Examples of the anion exchange resin include styrene-based resin and acrylic acid-based resin. Specific examples of the anion exchange resin include AMBERLITE IRA-900. The ion exchange resin may be used in the form of chelate resin, ion exchange fiber or synthetic absorbent. Alternatively, an inorganic ion exchanger such as zeolite may be used in place of the ion exchange resin.

It is necessary to know the total absorption of an emulsion obtained by adding a dye group of an outer dye layer against the total absorption of an emulsion caused by a dye or dye group of an inner dye layer as the result of the outer dye layer formation using a combination of a dye having a positive net charge and a dye having a negative net charge in an amount larger than that of the other dye in addition to the inner dye layer formation using one or more spectrally sensitizing dyes having a negative net charge or having one negatively charged substituent but having a net charge of zero.

In the dye layer-covered silver halide grains having at least two dye layers in combination comprising an inner dye layer (a) and an outer dye layer (b) the light absorption energy of the outer dye layer is equal to or higher than that of the inner dye layer.

This measurement of absorption can be done with variety of methods known in the art, but a particularly convenient and applicable method is to measure the absorption as a function of wavelength of a sample for use in photographic exposure evaluation, namely, an emulsion coating film formed on a planar support. The inventors measured samples by means of an autographic spectrophotometer U-3500 equipped with an integrating sphere available from Hitachi, Ltd. modified so that a sample can be set in the integrating sphere.

In the exposure during the photographic speed measurement, an equienergy spectral exposure device was used. A sample is exposed to light through a proper filter. Therefore, not all of the increase in absorptivity resulting from the forming of the outer dye layer is reflected to sensitivity. A portion of the absorptivity increase which is reflected to sensitivity is obtained as the sum of the absorptivities against the quantity of the transmitted light resulting from correction of the transmitted light quantity through a filter in 1-nm increments because the quantity of the light actually applied varies depending on wavelength. In other words, the increase of sensitivity depends on the number of photons of light absorbed per unit time per unit area when the light is applied through a filter. The "relative absorption" recited in the working examples of the present invention is a relative value, per unit time per unit area, of "the number of photons of light absorbed of the coatings of emulsion containing an outer dye layer in addition to an inner dye layer" to "the number of photons of light absorbed of the coating of emulsion containing the inner dye layer alone" which is set to a value of 100. Enhancement of the "relative absorption" is a quantitative measure of the effective light absorption effect.

The sensitizing dye to be used for inner dye layer formation of the present invention is a spectrally sensitizable dye having a negative net charge and/or a betain dye which has one negatively charged substituent but has a net charge of zero. Preferred is a cyanine dye, a merocyanine dye, a complex cyanine dye, a complex merocyanine dye, a holopolar cyanine dye or a hemicyanine dye. More preferred is a cyanine dye or merocyanine dye which exhibits a J band type absorption on silver halide grains. Particularly preferred is a cyanine dye represented by the following formula (SI) which exhibits a J band type absorption on silver halide grains.

(SI)

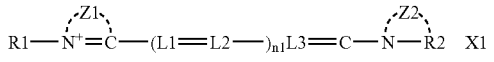

In the formula, Z1 and Z2 each represent the atoms which are necessary to complete a thiazole nucleus, a selenazole nucleus, an oxazole nucleus, an imidazole nucleus, an indole nucleus, a tetrazole nucleus or a quinoline nucleus and which may be substituted and tow substituents may be bonded to form a condensed ring (e.g., a benzene ring.

R1 and R2 each independently represent a substituted or unsubstituted aliphatic group, wherein at least one of R1 and R2 has a negative charge and X1 represents a cationic counterion as necessary to neutralize the charge.

L1, L2 and L3 each represent a substituted or unsubstituted methine group. n1 represents an integer of from 0 to 3, preferably an integer of from 0 to 2, and more preferably 0 or 1.

Examples of the negatively charged substituent include groups containing a sulfo group or a carboxy group, e.g. 2-sulfoethyl group, a 3-sulfopropyl group, a 4-sulfobutyl group, a 3-sulfobutyl group, a carboxymetyl group, a 2-carboxyethyl group and a 3-carboxypropyl group.

Specific examples of such sensitizing dyes include cyanine dyes disclosed in the patent specifications described in Research Disclosure, 176, Item 17643 (RD 17643), ibid., 187, Item 18716 (RD 18716) and ibid., 308, Item 308119 (RD 308119), the contents of which are incorporated herein by reference. The sensitizing dye for forming the inner dye layer may include only one kind of dye or of a combination of two or more kinds of dyes. Alternatively, a sensitizing dye may be used in combination with a compound which is called a "supersensitizing agent" in the art. Especially, when using mainly a sensitizing dye which is nobler than Ered=−1.3 V vs SCE, it is preferable to use a supersensitizing technique. The Ered and Eox of sensitizing dyes can be measured by phase discrimination secondary higher harmonic AC voltammetry disclosed by T. Tani, K. Ohzeki, K. Seki in Journal of the Electrochemical Society, Vol. 138, page 1411 and by J. Lenhard in Journal of Imaging Science, Vol. 30, page 27.

In the inner dye layer, at least one kind of a sensitizing dye is included, and the sensitizing dye to be used may be only one kind or may be a plurality of kinds.

The amount of the dye in the inner dye layer is preferably a saturated or nearly saturated amount at which an optimum performance can be achieved when no outer dye layer is provided. Particularly, a nearly saturated amount is preferred. It is more preferable that a compound containing a group which adsorbs firmly to silver halide, such as a mercapto group or a thiocarbonyl group, before addition of the dye of the outer dye layer be added but after the formation of the inner dye layer. Especially, mercapto compounds represented by the following formula (M) are particularly preferred.

(M)

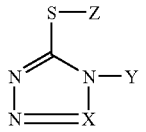

In the formula, Y represents a lower alkyl or lower alkenyl group having a total carbon number of 10 or less which may have a substituent or an aryl group having a total carbon number of 12 or less which may have a substituent; Z represents a hydrogen atom, an alkali metal atom, an ammonium group or a protective group which can be removed under an alkaline or acidic condition; and X represents a nitrogen atom or CH.

The compound represented by the formula (M) may be added in an amount of 0.05 millimole to 1 millimole, preferably 0.1 millimole to 0.6 millimole per mole of silver halide.

The addition method of the compound represented by the formula (M) is completely the same as that of the sensitizing dye to be described later. That is, the compound may be added directly to an emulsion or may be added to an emulsion after dissolving it to a water or a water-miscible solvent, such as methanol, ethanol, propanol, acetone, acetonitril or N,N-dimethylformamide, which is used alone or in combination of these. The compound may be added to an emulsion as a dispersion by micro-dispersing it into a hydrophilic colloid in a micro grain state or in an associated state.

The time period for adding the compound represented by the formula (M) from the addition of the dye for the inner dye layer is desirably 30 minutes to 90 minutes. In this connection, the reason why the time period of 30 minutes or later is that it is preferable for the inner dye layer dye to firmly adsorb silver halide. On the other hand, the reason why the time period of up to 90 minutes is that it is preferable for not to cause fog. Another step may be intervened after the completion of the addition of the inner dye layer dye to the initiation of the addition of the compound represented by the formula (M).

The following are specific examples of the compounds represented by formula (M), but the invention is not limited to these examples.

M-1

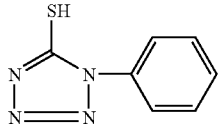

M-2

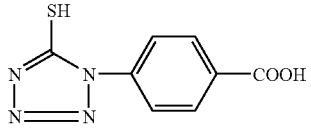

-continued

M-3

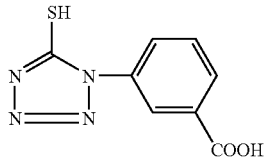

M-4

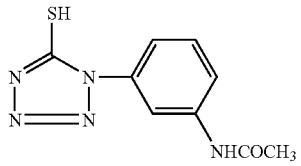

M-5

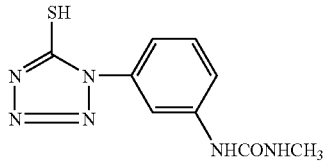

M-6

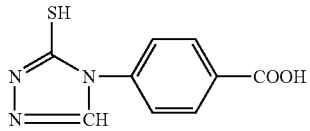

M-7

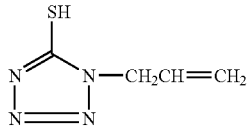

M-8

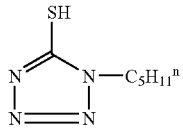

The outer dye layer of the present invention absorbs light at energy equal to or higher than the inner dye layer and the energy-releasing wavelength of the outer dye layer overlaps the energy-absorbing wavelength of the inner dye layer. The dyes constituting the outer dye layer include at least one kind of an anion dye having a negative net charge and one kind of a cation dye having a positive net charge, and the amount of the anion dye is larger than the amount of the cation dye. If these requirements are satisfied, these dyes constituting the outer dye layer are not necessarily required to be spectrally sensitizing dyes.

Preferable dyes include cyanine dyes, merocyanine dyes, complex cyanine dyes, complex merocyanine dyes, arylidene dyes, hemicyanine dyes, holopolar cyanine dyes, styryl dyes, oxonol dyes, anthraquinone dyes, triphenylmethane dyes, azo dyes, azomethine dyes and their combinations. It is more preferable that both the cation dye and the anion dye be cyanine dyes or merocyanine dyes which exhibit J band type absorption in a gelatin solution.

It is particularly preferable that the cation dye be a cyanine dye which is represented by the following formula (SII) and exhibits J band type absorption in a gelatin solution and that the anion dye be a cyanine dye which is represented by the aforementioned dye (SI) exhibits J band type absorption in a gelatin solution.

(SII)

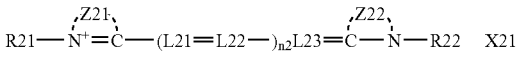

In the formula, Z21 and Z22 have the same meanings as Z1 and Z2; R21 and R22 represent substituted or unsubstituted aliphatic groups; at least one of R21 and R22 has at least one positive charge so that the formula (SII) preferably has a net charge of +2 to +5, more preferably +3 to +4; X21 represents one or more anionic counterions as necessary to neutralize the charge. L21, L22 and L23 each independently represents a substituted or unsubstituted methine group. n2 has the same meaning as n1.

Examples of the positively charged substituent include e.g., 3-(trialkylammonio)propyl, 4-(alkylammonio)butyl, 3-(alkylammonio)butyl, 3-guanidinopropyl, 4-guanidinobutyl, and substituents which are positively charged by protonation, e.g., 3-aminopropyl, 3-alkylaminopropyl, 3-dialkylaminopropyl, 4-dialkylaminobutyl. Here, the alkyl is preferably an alky having a small carbon number, e.g. methyl, ethyl and propyl.

The J-aggregates are preferred from the viewpoint of high light absorption coefficient and absorption sharpness, and accordingly it is extremely useful for the dye of the inner dye layer. Moreover, the J-aggregates exhibit high fluorescence yield and small Stokes shift, so that it is desirable in the transfer of light energy absorbed by the dyes of the outer layer to the dye of the inner layer which has close light absorption wavelength according to the Forster Model energy transfer mechanism.

The "dye that exhibits J band type absorption in an aqueous gelatin solution" used herein is a dye which exhibits at least a part of J band absorption when being dissolved in a concentration of $1.0\times10^{-4}$ mol/L in 1% aqueous deionized gelatin solution. It is more preferable that the absorption peak intensity of the J band absorption be not less than the absorption intensity at an absorption peak wavelength such as molecular absorption or dimer absorption. It is still more preferable that the absorption peak intensity of the J band absorption be at least twice the absorption intensity at an absorption peak wavelength such as molecular absorption or dimer absorption.

The specification of the present invention discloses that heterocyclic nuclei and substituents may be substituted. However, generally, unless otherwise stated, these include any group which do not destroy properties necessary for the photographic usefulness. Examples of such substituents include halogen, e.g., fluoro, chloro, bromo and iodo; alkoxy, particularly those with 8 or less carbon atoms, e.g. methoxy, ethoxy, propoxy and butoxy; alkylthio, particularly those with 6 or less carbon atoms, e.g., methylthio and ethylthio; substituted and unsubstituted aryl, particularly those having from 6 to 16 carbon atoms, e.g., phenyl, anisyl, tolyl and p-chlorophenyl; substituted or unsubstituted heterocycle, particularly those having 2 to 16 carbon atoms and having a 5 or 6-membered ring containing 1 to 3 heteroatoms selected from N, O, or S, e.g., pyridyl, thienyl, furyl, pyrrolyl and furfuryl; acyl, particularly those having 10 or less carbon atoms, e.g., acetyl, propionyl, benzoyl, mesityl and benzenesulfonyl; acylamino, particularly those having 10 or less carbon atoms, e.g., acetylamino, propionylamino, benzoylamino and methylsulfonylamino; and acylaminocarbonyl, particularly those having 10 or less carbon atoms, e.g., acetylaminocarbonyl, propionylaminocarbonyl and methylsulfonylaminocarbonyl. Further, with regard to any alkyl group, it will be understood that these can be branched.

The amount of the dye for use in the outer dye layer formation is preferably not less than 0.5, more preferably not less than 0.7 times, and much more preferably not less than 1.0 times the amount of the dye in the inner dye layer. In order to increase the light absorption, it is preferable to increase the amount of the dye for forming the outer dye layer and form multi-layered dye layers. However, in practice, it is invincible to adjust the energy transfer efficiency to 1 and if too many layers are formed, the reflection to photographic sensitivity will be reduced. Furthermore, since the amount of the dye will become too large, the amount of the dye remaining after development processing will become large, which will result in unfavorable increase in Dmin. Therefore, it is realistic that the amount of the dye for use in the outer dye layer formation is set to twice the amount of the dye in the inner dye layer, at most.

The anion dye for use in the outer dye layer formation is preferably a dye having a net charge of −1. The cation dye is preferably a dye having a net charge of +2 or more. The cation dye is more preferably a dye having a net charge of +3 or +4.

Regarding the proportions of the anion dye and cation dye for use in the outer dye layer formation in the present invention, it is essential only that the anion dye be more than the cation dye in molar ratio. However, the ratio of the anion dye to the cation dye is preferably 1.1 times or more but not more than 5 times, more preferably 1.2 times or more but not more than 3 times, and particularly preferably 1.5 times or more but not more than 2.5 times.

At least one kind of an anion dye and at least one kind of a cation dye used in the outer dye layer. The anion dye may be only one kind or a plurality to kinds. Similarly, the cation dye used may also be only one kind or a plurality of kinds.

When the dyes for forming the outer dye layer are used in the same amount as the dyes for forming the inner dye layer so that the ratio of the anion dye to the cation dye for the outer dye layer formation is 2:1, a two dye layer system will be formed if all the outer dyes are adsorbed. In this case, when a surfactant or color coupler emulsion is not present, almost all the added cation dye adsorbs onto the inner dye, but anion dye does not adsorb in any amount more than the amount of cation dye even if the cation dye is trivalent or tetravalent. In other words, anion dye can adsorb in an amount as much as half the added anion dye at most. However, when a surfactant or color coupler emulsion is present, cation dye adsorbs in an amount at least 90% of the added cation dye though the adsorption amount thereof slightly decreases. Anion dye also can adsorb in an amount of 80% or more of the added anion dye. Moreover, even if a liquid emulsion is preserved for a long time or a sample resulting from application of this emulsion onto a support is preserved at high temperature under high humidity, namely, at 50° C. and a relative humidity of 80%, an extremely small decrease in absorption caused by dye occurs and the product is comparable of ordinary commercially available photosensitive material having only the inner dye layer.

Further, when the ratio γ of a surfactant and high-boiling organic solvent in a hydrophilic dispersion such as an emulsion of a color coupler, is controlled within the scope specified in the invention, as much as 80% or more of the anion dye added for the outer dye layer adsorb without decrement in the adsorption amount of the cation dye. The change in speed and absorption intensity of a liquid emulsion under storage and of a coated sample stored in high temperature and high humidity.

On the other hand, in the method using only a cation dye or a combination of a cation dye and an anion dye considerably less than the cation dye disclosed in patents such as JP-A-2000-89405, it is able to make almost all the added cation dye and almost all the added anion dye adsorb when a surfactant or a color coupler emulsion is not present. However, when a surfactant or color coupler emulsion is added to the above system, a part of the inner layer dye, in addition to most of the cation dye, desorbs in a short time. For some dyes, e.g., a dye designed so that a hydrogen bond, in addition to charge interaction, may have an effect, the dye desorption at this stage is controlled to about 50%. However, when it is preserved in the form of a liquid emulsion such as that mentioned above for several hours or a sample resulting from application of this emulsion onto a support is preserved at high temperature under high humidity, a great decrease in absorption will occur and therefore it is far from its employment for practical production.

As mentioned above, in the present invention, the outer dye layer absorbs light with the same energy as or higher energy than the inner dye layer, and the energy-releasing wavelength of the outer dye overlaps the energy-absorbing wavelength of the inner dye layer. Thus, the maximum absorption wavelength of the outer dye layer is the same as or shorter than the maximum absorption wavelength of the inner dye layer. The interval between the both wavelength is preferably 0 nm to 50 nm, more preferably 0 nm to 35 nm, and much more preferably 5 nm to 30 nm.

Herein the light-absorbing energy of the outer dye layer means the light-absorbing energy by the dyes of (or constituting) the outer dye layer. The light-absorbing energy of the inner dye layer means the light-absorbing energy by the dye-of (or constituting) the inner dye layer.

In the present invention, a reduction potential and oxidation potential of the dye of the inner dye layer and the dyes of the outer dye layer may be arbitral. In particular, however, the reduction potential of the dye of the inner layer is preferably noble to the value of the reduction potential of the dyes of the outer layer minus 0.2 V, more preferably noble to the value of the reduction potential of the dye of the outer layer minus 0.1 V, and most preferably noble to the reduction potential of the dyes of the outer layer.

Various methods may be used for measuring the reduction potential, the aforementioned phase discrimination secondary higher harmonic AC voltammetry is preferable because an accurate value may be obtained.

It is preferred that the dyes of the outer layer be luminescent in gelatin films. The luminescent yield of the dyes of the outer layer in gelatin films is preferably 0.05 or higher, more preferably 0.1 or higher, still more preferably 0.2 or higher and most preferably 0.5 or higher. With respect to the type of luminescent dye, one having a skeletal structure of dye for use for dye laser is preferred. This type of luminescent dye is described in order in, for example, Mitsuo Maeda, Laser Kenkyu (Study of Laser), vol. 8, pages 694, 803 and 958 (1980) and vol. 9, page 85 (1981) and "Dye Lasers" written by F. Sehaefer, Springer (1973), the entire contents of which are incorporated herein by reference.

When there occurs an energy transfer from the dyes of the outer layer to the dye of the inner layer according to nonequilibrium excitation energy transfer mechanism, it is preferred that the life of excitation in gelatin dry films of only the dye of the outer layer be prolonged. In this instance, the luminescent yield of dyes of the outer layer may be high or low. The life of fluorescence in gelatin dry films of only the dyes of the outer layer is preferably 10 ps or greater, more preferably 40 ps or greater, and still more preferably 160 ps or greater. The life of fluorescence of the dyes of the outer layer, although there is no particular upper limit, is preferably 1 ms or less.

It is preferred that the overlapping of the absorption of the dyes of the outer layer and the that of the dye of the inner layer be extensive. Assuming that the emission spectrum of the dyes of the outer layer at a portion of longer wavelength than 390 nm is $S(\nu)$ and the absorption spectrum of the dye of the inner layer at a portion of longer wavelength than 390 nm is $A(\nu)$, the product thereof, $S(\nu)\cdot A(\nu)$, is preferably 0.001 or greater, more preferably 0.01 or greater, still more preferably 0.1 or greater, and most preferably 0.5 or greater. Herein, $\nu$ represents wave number ($cm^{-1}$), and with respect to each of these spectra, the spectral area at the portion of longer wavelength than 390 nm has been normalized to 1.

The energy transfer efficiency associated with the transfer of excitation energy of the dyes of the outer layer to the dye of the inner layer is preferably 30% or greater, still more preferably 60% or greater, and most preferably 90% or greater.

Herein, the terminology "excitation energy of the dyes of the outer layer" means the energy possessed by the dyes being in the excited state resulting from the absorption of light energy by the dye of the outer layer. It is assumed that the transfer of the excitation energy possessed by a certain molecule to another molecule occurs through the excited electron transfer mechanism, energy transfer mechanism of Forster Model, energy transfer mechanism of Dextor Model, etc. In the multi-layered adsorption system under the present study as well, it is preferred that the conditions for inducing efficient transfer of excitation energy that can be anticipated according to the above mechanisms be satisfied. It is more preferred that the conditions for inducing the energy transfer mechanism of Forster Model be satisfied. For enhancing the efficiency of energy transfer of Forster Model, it is effective to lower the refractive index in the vicinity of emulsion grain surfaces.

The efficiency of energy transfer from the dyes of the outer layer to the dye of the inner layer can be determined through an analysis of rate of fluorescence decay with respect to the dye of the outer layer and a dynamics analysis of light excited state with respect to the rate of fluorescence rise of the dye of the inner layer, etc.

Further, the efficiency of energy transfer from the dyes of the outer layer to the dye of the inner layer can also be determined as the ratio of efficiency of spectral sensitization at excitation of the dyes of the outer layer/efficiency of spectral sensitization at excitation of the dye of the inner layer.

The sensitizing dyes for use in the present invention may be added to a silver halide emulsion by a normal method well-known to persons skilled in the art. Concretely, the dyes may be added directly to the emulsion or alternatively they may be dissolved in a single or mixed solvent of water, ethanol, ethanol, propanol, acetone, methyl cellosolve, 2,2,3,3-tetrafluoropropanol, acetonitrile, N,N-dimethylformamide, etc., and then added to the emulsion. In addition, the following methods may be employed: the method disclosed in U.S. Pat. No. 3,469,987, in which a dye is dissolved in a volatile organic solvent, the solution is finely dispersed in water or a hydrophilic colloid and the dispersion is added to the emulsion; the methods disclosed in JP-B-46-23389, JP-B-44-27555, JP-B-57-22091 and so forth, in which a sensitizing dye is dissolved in an acid and the solution is added to the emulsion, or a dye is made into an aqueous solution in the presence of an acid or base and the solution is added to the emulsion, or a dye is dispersed in a hydrophilic colloid and the dispersion is added to the emulsion; the method disclosed in, for example, U.S. Pat. Nos. 3,822,135 and 4,006,025, in which a dye is made into an aqueous solution or a colloid fine dispersion in the presence of a surfactant, and the solution or dispersion is added to the emulsion; and the method disclosed in JP-A's-53-102733 and 58-105141, in which a sensitizing dye is directly dispersed finely in a hydrophilic colloid and the dispersion is added to the emulsion. Particularly preferred is the method in which a sensitizing dye is directly dispersed finely in a hydrophilic colloid and the dispersion is added to the emulsion.

The sensitizing dye used for the present invention may be added to a silver halide emulsion at any step known to be useful during the preparation of emulsion. For example, the sensitizing dye may be added at a step of formation of silver halide grains and/or in a period before desalting or at a step of desilverization and/or in a period after desalting and before initiation of chemical ripening, as disclosed in, for example, U.S. Pat. Nos. 2,735,766, 3,628,960, 4,183,756, and 4,225,666, JP-A's-58-184142 and 60-196749, etc., or the dye may be added in any period or at any step before coating of the emulsion, such as immediately before or during chemical ripening, or in a period after chemical ripening but before coating, as disclosed in, for example, JP-A-58-113920. Further, a sole kind of sensitizing dye alone or sensitizing dyes different in structure in combination may be added as divided portions, for example, during a single step, or a part is added during grain formation, and the remaining during chemical ripening or after completion of the chemical ripening, or a part is added before or during chemical ripening and the remaining after completion of the chemical ripening, as disclosed in, for example, U.S. Pat. No. 4,225,666 and JP-A-58-7629. The kinds of compounds or the kinds of the combinations of compounds added as divided portions may be changed.

It is particularly preferable for the sensitizing dye for use in the inner dye layer formation to be added before the start of the chemical ripening. It is more preferable for the sensitizing dye for use in the outer dye layer formation to be added not before the mid-point of the chemical ripening, especially after the completion of the chemical ripening. The order of the addition of the anion dye and the cation dye for use in the outer dye layer formation may be arbitrary, but it is preferable to add them simultaneously or add the cation dye earlier. When the cation dye is added earlier, the timing of the addition of the anion dye is preferably within 10 minutes, more preferably within 5 minutes, and still more preferably within 1 minute of the addition of the cation dye.

Furthermore, a given amount of dye may be added within a short period of time, or may be added continuously or intermittently within a long period of time, for example, during the period after the nucleation in the grain formation process and before completion of the grain formation for the dye for inner dye layer formation or during almost all over the process from the mid-point of chemical ripening to the coating for outer dye layer formation. The addition speed in such cases may be an isokinetic flow rate. Alternatively, the flow rate may be varied. However, it is more preferable to add at least a part of the given amount of dye in one portion at the start of the addition. The addition timing of the compound represented by the formula (M) is preferably after the addition of the dye of the inner dye layer but before the addition of the dye of the outer dye layer, more preferably 30 minutes after the addition of the dye for inner dye layer or later.

Moreover, it is more preferable that a supersensitizing agent, which is sometimes added during the inner dye layer formation, be added after or at the same time as the addition of a spectrally sensitizing dye.

The temperature at which the sensitizing dye is added may be arbitrary but usually is from 20° C. to 75° C. The addition and the ripening may be conducted at constant temperature. Alternatively, the temperature may be varied during the addition or the temperature during the addition may differ from the ripening temperature after the addition. It is preferable for the dye for inner dye layer formation to be added at a temperature of 40° C. or higher, more preferably at a temperature of from 50° C. to 75° C. On the other hand, it is preferable for the dye for outer dye layer formation to be added and ripened at a temperature of up to 60° C., more preferably up to 50° C.

Specific examples of the preferable sensitizing dye will be shown in Tables 1, 2 and 3, but the present invention does not limited to these.

TABLE 1

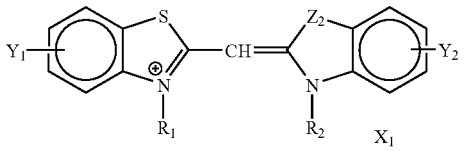

| Dye | $Z_2$ | $Y_1$ | $Y_2$ | $R_1$ | $R_2$ | $X_1$ |
|---|---|---|---|---|---|---|
| SI-1 | S | 5-Cl | 5-Cl | $—(CH_2)_3SO_3^-$ | $—(CH_2)_3SO_3^-$ | $HN^+Et_3$ |
| SI-2 | S | 5-Cl | 5,6-diCi | $—(CH_2)_3SO_3^-$ | $—(CH_2)_3SO_3^-$ | $HN^+Et_3$ |
| SI-3 | S | 5-Cl | 4,5-Benzo | $—(CH_2)_3SO_3^-$ | $—(CH_2)_3SO_3^-$ | $HN^+Et_3$ |
| SI-4 | S | 5-(2-Thienyl) | 5-(2-Thienyl) | $—(CH_2)_3SO_3^-$ | $—(CH_2)_3SO_3^-$ | $HN^+Et_3$ |
| SI-5 | S | 5-CONHPh | 5-CONHPh | $—(CH_2)_4SO_3^-$ | $—(CH_2)_4SO_3^-$ | $HN^+Et_3$ |
| SI-6 | S | 5-Br | 5-Br | $—(CH_2)_3SO_3^-$ | $—(CH_2)_3SO_3^-$ | $K^+$ |
| SI-7 | S | 5,6-diCl | 5-Cl-Pyrrolyl) | $—(CH_2)_3SO_3^-$ | $—(CH_2)_3SO_3^-$ | $HN^+Et_3$ |
| SI-8 | O | 5-Cl | Benzo[b]furano[2,3-f] | $—(CH_2)_3SO_3^-$ | $—(CH_2)_3SO_3^-$ | $HN^+Et_3$ |
| SI-9 | O | 5-Ph | Benzo[b]furano[2,3-f] | $—(CH_2)_3SO_3^-$ | $—(CH_2)_3SO_3^-$ | $HN^+Et_3$ |
| SII-1 | S | 5-(2-Thienyl) | 5-(2-Thienyl) | $—(CH_2)_3N^+Me_3$ | $—(CH_2)_3N^+Me_3$ | $3Br^-$ |
| SII-2 | S | 5,6-diCl | 5,6-diCl | $—(CH_2)_3N^+Me_3$ | $—(CH_2)_3N^+Me_3$ | $3Br^-$ |
| SII-3 | S | 5-(2-Thienyl) | 5-CONHPh | $—(CH_2)_4N^+Me_3$ | $—(CH_2)_4N^+Me_3$ | $3Br^-$ |

TABLE 1-continued

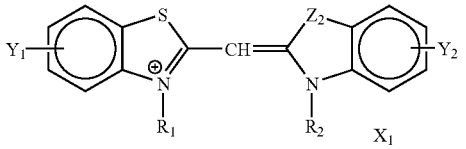

| Dye | $Z_2$ | $Y_1$ | $Y_2$ | $R_1$ | $R_2$ | $X_1$ |
|---|---|---|---|---|---|---|
| SII-4 | S | 5-(2-Thienyl) | 5-(2-Thienyl) | —$(CH_2)_4$—$G^+$ | —$(CH_2)_4$—$G^+$ | $3Br^-$ |
| SII-5 | S | 5-Cl | 5-Cl | —$(CH_2)_4$—$G^+$ | —$(CH_2)_4$—$G^+$ | $3Br^-$ |

In the formula Et means ethyl, Ph means phenyl, Me means methol, and $G^+$means guanidium (NHC $(=N^+H_2)NH_2$).

TABLE 2

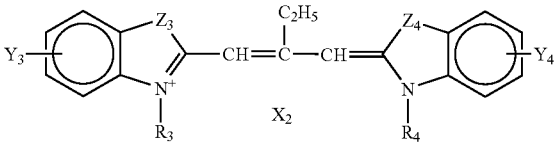

| Dye | $Z_3$ | $Z_4$ | $Y_3$ | $Y_4$ | $R_3$ | $R_4$ | $X_2$ |
|---|---|---|---|---|---|---|---|
| SI-11 | O | O | 5-Cl | 5-Ph | —$(CH_2)_3SO_3^-$ | —$(CH_2)_3SO_3^-$ | $HN^+Et3$ |
| SI-12 | O | O | 5-Cl | 5-Ph | —$(CH_2)_3SO_3^-$ | —$(CH_2)_2SO_3^-$ | $HN^+Et_3$ |
| SI-13 | O | O | 5-Cl | 5-Ph | —$(CH_2)_3SO_3^-$ | —$MPRS^-$ | $HN^+Et_3$ |
| SI-14 | O | O | 5-Ph | 5-Ph | —$(CH_2)_3SO_3^-$ | —$(CH_2)_3SO_3^-$ | $HN^+Et_3$ |
| SI-15 | O | O | 5-Ph | 5-Ph | —Et | —$MPRS^-$ | |
| SI-16 | O | O | 5-Ph | 5-Ph | —$MPRS^-$ | —$MPRS^-$ | $HN^+Et_3$ |
| SI-17 | O | O | 5-(p-Br)Ph | 5-(p-Br) Ph | —$(CH_2)_3SO_3^-$ | —$(CH_2)_3SO_3^-$ | $HN^+Et_3$ |
| SI-18 | O | O | 5-CONHPh | 5-CONHPh | —$(CH_2)_3SO_3^-$ | —$(CH_2)_3SO_3^-$ | $HN^+Et_3$ |
| SI-19 | O | O | 4,5-Benzo | 5,6-Benzo | —$(CH_2)_3SO_3^-$ | —$(CH_2)_3SO_3^-$ | $HN^+Et_3$ |
| SI-20 | O | S | 5-Ph | 5,6-diMe | —$(CH_2)_3SO_3^-$ | —$(CH_2)_3SO_3^-$ | $HN^+Et_3$ |
| SI-21 | O | S | 5-Ph | 5,6-diMe | —$(CH_2)_2SO_3^-$ | —$(CH_2)_4SO_3^-$ | $HN^+Et_3$ |
| SI-22 | O | S | 5-Ph | 5-Cl-6-Me | —$MPRS^-$ | —$MPRS^-$ | $HN^+Et_3$ |
| SI-23 | O | S | 5-Ph | H | —Et | —$CH_2CON^-SO_2Me$ | |
| SI-24 | O | S | Benzo[b]furano[2,3-f] | 5-I | —$(CH_2)_3SO_3^-$ | —$(CH_2)_3SO_3^-$ | $HN^+Et_3$ |
| SI-25 | O | S | Benzo[b]furano[2,3-f] | 5-(2-Thienyl) | —$(CH_2)_3SO_3^-$ | —$(CH_2)_3SO_3^-$ | $HN^+Et_3$ |
| SI-26 | O | S | Benzo[b]furano[2,3-f] | 5-(1-Pyrrolyl) | —$(CH_2)_3SO_3^-$ | —$(CH_2)_3SO_3^-$ | $HN^+Et_3$ |
| SI-27 | O | S | Benzo[b]furano[2,3-f] | 4,5-Benzo | —$(CH_2)_3SO_3^-$ | —$(CH_2)_3SO_3^-$ | $HN^+Et_3$ |
| SI-28 | O | S | 5-Ph | Benzo[b]-furano[2,3-f] | —$(CH_2)_3SO_3^-$ | —$(CH_2)_3SO_3^-$ | $HN^+Et_3$ |
| SI-29 | O | S | Benzo[b]furano[3,1-f] | 5-(1-Pyrrolyl) | —$(CH_2)_3SO_3^-$ | —$(CH_2)_3SO_3^-$ | $HN^+Et_3$ |
| SI-30 | S | S | 5-Cl | 5-Cl | —$(CH_2)_3SO_3^-$ | —$(CH_2)_3SO_3^-$ | $HN^+Et_3$ |
| SI-31 | S | S | 5-Cl | 5-Cl | —Et | —$MPRS^-$ | |
| SI-32 | S | S | 5-CONHPh | 5-CONHPh | —$(CH_2)_3SO_3^-$ | —$(CH_2)_3SO_3^-$ | $HN^+Et_3$ |
| SI-33 | S | S | 5-(2-Thienyl) | 5-(2-Thienyl) | —$(CH_2)_3SO_3^-$ | —$(CH_2)_3SO_3^-$ | $HN^+Et_3$ |
| SI-34 | S | S | 5-Cl | 5-Cl | —$(CH_2)_3SO_3^-$ | —$(CH_2)_3SO_3^-$ | $K^+$ |
| SI-35 | S | S | 5-Br | 5-Br | —$(CH_2)_3SO_3^-$ | —$(CH_2)_3SO_3^-$ | $HN^+Et_3$ |
| SI-36 | S | S | 5-Br | 5-Br | —$(CH_2)_3SO_3^-$ | —$(CH_2)_3SO_3^-$ | $K^+$ |
| SI-37 | S | S | 5-I | 5-I | —$(CH_2)_3SO_3^-$ | —$(CH_2)_3SO_3^-$ | $HN^+Et_3$ |
| SI-38 | S | S | 4,5-Benzo | 4,5-Benzo | —$(CH_2)_3SO_3^-$ | —$(CH_2)_3SO_3^-$ | $HN^+Et_3$ |
| SI-39 | O | O | 4,5-Benzo | 5,6-Benzo | —$(CH_2)_4SO_3^-$ | —$MPRS^-$ | $HN^+Et_3$ |

In the table, Et means ethyl, Ph means phenyl, Me means methyl and —$MPRS^-$ means - $(CH_2)_2(CH_3)SO_3^-$.

TABLE 3

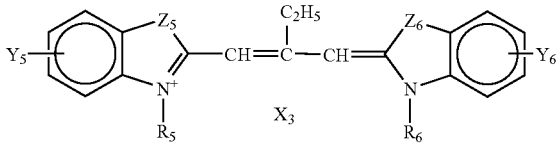

| Dye | $Z_5$ | $Z_6$ | $Y_5$ | $Y_6$ | $R_5$ | $R_6$ | $X_3$ |
|---|---|---|---|---|---|---|---|
| SII-11 | O | O | 5-Ph | 5-Ph | —$(CH_2)_3N^+Me_3$ | —$(CH_2)_3N^+Me_3$ | $3Br^-$ |
| SII-12 | O | O | 5-Ph | 5-Ph | —$(CH_2)_4N^+Me_3$ | —$(CH_2)_4N^+Me_3$ | $3Br^-$ |
| SII-13 | O | O | 5-Ph | 5-Ph | —$(CH_2)_5N^+Me_3$ | —$(CH_2)_5N^+Me_3$ | $3Br^-$ |
| SII-14 | O | O | 5-CONHPh | 5-CONHPh | —$(CH_2)_4N^+Me_3$ | —$(CH_2)_4N^+Me_3$ | $3Br^-$ |
| SII-15 | O | O | 5-(p-Cl)Ph | 5-(p-Cl)Ph | —$(CH_2)_4N^+Me_3$ | —$(CH_2)_4N^+Me_3$ | $3Br^-$ |
| SII-16 | O | O | 5-(p-Br)Ph | 5-(p-Br)Ph | —$(CH_2)_3N^+Me_3$ | —$(CH_2)_3N^+Me_3$ | $3Br^-$ |
| SII-17 | O | O | 5-Ph | 5-Ph | —$(CH_2)_3N^+Me_3$ | —$(CH_2)_4$—$G^+$ | $3Br^-$ |
| SII-18 | O | O | 5-Ph | 5-Ph | —$(CH_2)_4$—$G^+$ | —$(CH_2)_4$—$G^+$ | $3Br^-$ |
| SII-19 | O | O | 5-Ph | 5-Ph | —Et | —$(CH_2)_4$—$G^+$ | $2Br^-$ |
| SII-20 | O | O | 5-(p-Br)Ph | 5-Ph | —$(CH_2)_3Me$ | —$(CH_2)_3N^+Me_3$ | $2Br^-$ |
| SII-21 | O | S | Benzo[b]furano[2,3-f] | 5-I | —$(CH_2)_3N^+Me_3$ | —$(CH_2)_3N^+Me_3$ | $3Br^-$ |
| SII-22 | O | S | Benzo[b]furano[2,3-f] | 5-(2-Thienyl) | —$(CH_2)_3N^+Me_3$ | —$(CH_2)_3N^+Me_3$ | $3Br^-$ |
| SII-23 | O | S | Benzo[b]furano[2,3-f] | 5-(1-Pyrrolyl) | —$(CH_2)_3N^+Me_3$ | —$(CH_2)_3N^+Me_3$ | $3Br^-$ |
| SII-24 | O | S | Benzo[b]furano[2,3-f] | 5-(2-Thienyl) | —$(CH_2)_3N^+Me_3$ | —$(CH_2)_3N^+Me_3$ | $3Br^-$ |
| SII-25 | O | S | Benzo[b]furano[2,3-f] | 5-(2-Thienyl) | —$(CH_2)_3N^+Me_3$ | —$(CH_2)CHMe_2$ | $2Br^-$ |
| SII-26 | O | S | Benzo[b]furano[2,3-f] | 5-Br | —$(CH_2)_3N^+Me_3$ | —$(CH_2)_3N^+Me_3$ | $3Br^-$ |
| SII-27 | O | S | Benzo[b]furano[2,3-f] | 4,5-Benzo | —$(CH_2)_3N^+Me_3$ | —$(CH_2)_3N^+Me_3$ | $3Br^-$ |
| SII-28 | O | S | 5-Ph | Benzo[b]-furano[2,3-f] | —$(CH_2)_3N^+Me_3$ | —$(CH_2)_3N^+Me_3$ | $3Br^-$ |
| SII-29 | O | S | Benzo[b]furano[3,1-f] | 5-(1-Pyrrolyl) | —$(CH_2)_3N^+Me_3$ | —$(CH_2)_3N^+Me_3$ | $3Br^-$ |
| SII-30 | O | S | 4,5-Benzo | 4,5-Benzo | —$(CH_2)_3N^+Me_3$ | —$(CH_2)_3N^+Me_3$ | $3Br^-$ |
| SII-31 | O | S | Benzo[b]furano[3,1-f] | 4,5-Benzo | —$(CH_2)_3N^+Me_3$ | —$(CH_2)_3N^+Me_3$ | $3Br^-$ |
| SII-32 | O | S | Benzo[b]furano[3,1-f] | 5-(2-Thienyl) | —$(CH_2)_3N^+Me_3$ | —$(CH_2)_3N^+Me_3$ | $3Br^-$ |
| SII-33 | S | S | 5-Cl | 5-Cl | —$(CH_2)_3N^+Me_3$ | —$(CH_2)_3N^+Me_3$ | $3Br^-$ |
| SII-34 | S | S | 5-(2-Thienyl) | 5-(2-Thienyl) | —$(CH_2)_3N^+Me_3$ | —$(CH_2)_3N^+Me_3$ | $3Br^-$ |
| SII-35 | S | S | 5-CONNPh | 5-CONHPh | —$(CH_2)_3N^+Me_3$ | —$(CH_2)_3N^+Me_3$ | $3Br^-$ |
| SII-36 | S | S | 5-Br | 5-Br | —$(CH_2)_3N^+Me_3$ | —$(CH_2)_3N^+Me_3$ | $3Br^-$ |

In the talbe, Et means ethyl, Ph means phenl, Me means methyl, and $G^+$ means guanidium ($NHC(=N^+H_2)NH_2$).

The silver halide grains used in the silver halide emulsion of the present invention is silver bromide, silver chloride, silver iodobromide, silver iodochlorobromide, silver chlorobromide, silver iodochloride and etc., but those containing at least silver iodide are preferable. Shape of silver halide grain may be regular crystal such as octahedral, cubic or tetradecahedral, but tabular grain is more preferable.

The tabular silver halide grains used in the present invention preferably includes silver halide grains having different surface iodide concentrations, one of which is a region having a maximum surface iodide concentration along edges thereof, and the other of which is a region having a lower surface iodide concentration than the iodide concentration of the region having the maximum surface iodide concentration at a corner(s) thereof.

In the above tabular silver halide grains, silver iodide concentration of the region having the maximum surface iodide concentration is preferably 0.6 to 15 mol %, more preferably 1 to 10 mol %. The term "along the edges" where this region having a maximum surface iodide concentration is present means an area near fringe portion, specifically, within 20% of the projected area portion in terms of area from the fringe of the grain. Further, the term "corner" means a three-dimensional portion surrounded by edges constituting a corner and perpendicular lines to the edges, the perpendicular lines are drawn from a point of 50% (preferably 75%) from a center of a grain on a line connecting between the center and each corner of the grain. Regarding the iodide concentrations of the region of along edges and the region of a corner, that of the edge region is higher than or same as that of the corner region. The difference between the regions 0 to 10 mol %, preferably 5 mol % or less.

The tabular silver halide grains used in the present invention include those having (111) main planes in an amount of 50% or more of the total projected area of all the silver halide grains. The tabular grains each also have an epitaxial junction portion(s). The tabular grains each also have a latent image-forming chemical sensitization portion(s) on the surface thereof. The latent image-forming chemical sensitization portion contains at least one same kind of silver salt as the silver salt(s) constituting the epitaxial junction portion. In addition the latent image-forming chemical sensitization portion is located closest to the peripheral edge of the (111) main plane of the tabular grain. In addition, the latent image-forming chemical sensitization portion is limited to a portion occupying less than 50% of the area of the main plane.

In the tabular silver halide grains mentioned above, the epitaxial junction portion may be present at any portion of the grain, but apex (or corner) portion, periphery (or edge) portion and/or main plane portion is preferable. The epitaxial portion is one or more per grain. The composition of halide and others in the epitaxial junction portion is AgCl, AgBrCl, AgBrClI, AgI, or AgSCN. The silver amount of the epitaxial junction portion is preferably 2 to 30%, more preferably 5 to 15% of the total grain amount. The term "latent image-forming chemical sensitization portion is located closest to the peripheral edge" means that the latent image-forming chemical sensitization portion is present on the border area to the epitaxial junction portion. The latent image-forming chemical sensitization portion may be one region or may be divided into a plurality of regions. The latent image-forming chemical sensitization portion may be on the border (i.e., on a line) to the epitaxial junction portion. Accordingly, the lower limit of the latent image-forming chemical sensitization portion occupying the area of a main plane exceeds 0%. Preferable kind of silver salts are AgBr, AgBrI, AgBrCl or AgBrClI. In this connection, the latent image-forming chemical sensitization portion may be identified through observation of a grain by stopping development thereof at its early stage or of a blackened development initiating point by development with arrested developer.

Although the emulsion of the present invention preferably contains the silver halide grains meeting the above conditions, the following fist to fourth emulsions described below may also be used. These first to fourth emulsions, unless contradict to the above conditions, further meet the conditions of the surface iodide concentrations and/or the latent image-forming chemical sensitization portion and others mentioned above.

Firstly, a silver halide emulsion (a first emulsion) preferably used in the present invention, namely, an emulsion which contains tabular silver halide grains of silver iodobromide or silver chloroiodobromide whose silver chloride content is 10 mol % or less, each having (111) faces as parallel main planes will first be described.

This emulsion has (111) main plane surfaces opposite to each other and side faces connecting the main planes. The tabular grain emulsion is constituted of silver iodobromide or silver chloroiodobromide. Silver chloride may be contained in the emulsion. The silver chloride content is preferably 8 mol % or less, and more preferably 3 mol % or less, or 0 mol %. With respect to the silver iodide content it is 40 mol % or less, preferably 20 mol % or less. Regardless of the silver iodide content, a variation coefficient of the distribution of silver iodide content among the grains is preferably 20% or less, particularly preferably 10% or less.

Tabular silver halide grain (hereinafter sometimes referred to as simply "tabular grain") means a grain having an aspect ratio of 2 or more. The aspect ratio refers to the quotient of the diameter of a circle with an area equal to the projected area divided by the grain thickness. The projected area, thickness an aspect ratio of tabular grains can be measured from an electron micrograph obtained by the carbon replica method in which the tabular grains together with reference latex spheres are shadowed. The tabular grains, as viewed from a direction perpendicular to the main plane, generally have the shape of a hexagon, a triangle or a circle. With respect to the configuration of tabular grains, it is preferred that the ratio of hexagonal shape to all grain shapes be high. In the tabular grains of hexagonal shape, it is preferred that the ratio of neighboring-side lengths (loner side/shorter side) be 2 or less.

The average equivalent circle diameter of the tabular grains is preferably 0.1 μm to 20.0 μm, more preferably 0.2 μm to 10.0 μm. Further, the average thickness of the tabular grains is preferably 0.01 μm to 0.5 μm, more preferably 0.02 μm to 0.4 μm.

The average equivalent sphere diameter of the grains is preferably 0.1 μm to 5.0 μm, more preferably 0.2 μm to 3 μm. The term "equivalent sphere diameter" means a diameter of a sphere having an area equal to the volume of each grain. Further, the average aspect ratio is preferably 2 to 200, more preferably 2 to 100.

The above silver halide grains are preferably monodisperse. The coefficient of variation of the equivalent sphere diameters of all the silver halide grains is 30% or less, preferably 25% or less. Further, the coefficient of variation of the equivalent circle diameters is also important. The coefficient of variation of the equivalent circle diameters of all the silver halide grains of the present invention is preferably 30% or less, more preferably 25% or less, further preferably 20% or less. Furthermore, the coefficient of variation of the thickness is preferably 30% or less, more preferably 25% or less, further preferably 20% or less.

The space between twin planes of the tabular grain may be set to 0.012 μm or less as described in U.S. Pat. No. 5,219,720, and the value of "(111) main plane distance/twin plane space" may be set to 15 or more as described in JP-A-5-249585. They can be selected according to the object.

Since the higher aspect ratio can obtain the more remarkable effect, at least 50% of the total projected area of the tabular grain emulsion is preferably occupied with grains having an aspect ratio of 2 or more, preferably an aspect ratio of 5 or more, and more preferably an aspect ratio of 8 or more. Since a too large aspect ratio also increases the coefficient of variation of the grain size distribution, usually the aspect ratio is preferably 200 or less.

The dislocation lines of tabular grains can be observed by a direct method using a transmission electron microscope, described in J. F. Hamilton, Phot.Sci.Eng., 11,57, (1967) and T. Shiozawa, J. Soc. Phot.Sci. Japan, 35, 213 (1972), for example. Specifically, silver halide grains taken out from the emulsion with care so as not to apply strong pressure to the grains to generate new dislocation lines are put on a mesh for electron microscope observation. Then, the sample is observed by transmission electron radiography in the state where the sample is cooled to prevent damage (e.g., print-out) by electron beam, are observed by the transmission method. The greater the thickness of the above grains, the more difficult the transmission of electron beams. Therefore, the use of an electron microscope of high voltage type (at least 200 kV on the grains of 0.25 μm in thickness) is preferred for ensuring clearer observation. The thus obtained photograph of grains enables determining the position and number of dislocation lines in each grain viewed in the direction perpendicular to the main planes.

The number of dislocation lines of the tabular grains according to the present invention is preferably at least 10 per grain on the average and more preferably at least 20 per grain on the average. When dislocation lines are densely present or when dislocation lines are observed in the state of crossing each other, it happens that the number of dislocation lines per grain cannot accurately be counted. However, in this instance as well, rough counting on the order of, for example, 10, 20 or 30 dislocation lines can be effected, so that a clear distinction can be made from the presence of only a few dislocation lines. The average number of dislocation lines per grain is determined by counting the number of dislocation lines of each of at least 100 grains and calculating a number average thereof.

Dislocation lines can be introduced in, for example, the vicinity of the periphery of tabular grains. In this instance, the dislocation is nearly perpendicular to the periphery, and each dislocation line extends from a position corresponding to x % of the distance from the center of tabular grains to the side (periphery) to the periphery. The value of x preferably ranges from 10 to less than 100, more preferably from 30 to less than 99, and most preferably from 50 to less than 98. In this instance, the figure created by binding the positions from which the dislocation lines start is nearly similar to the configuration of the grain. The created figure may be one which is not a complete similar figure but deviated. The dislocation lines of this type are not observed around the center of the grain. The dislocation lines are crystallographically oriented approximately in the (211) direction. However, the dislocation lines often meander and may also cross each other.

Dislocation lines may be positioned either nearly uniformly over the entire zone of the periphery of the tabular grains or local points of the periphery. That is, referring to, for example, hexagonal tabular silver halide grains, dislocation lines may be localized either only in the vicinity of six apexes or only in the vicinity of one of the apexes. Contrarily, dislocation lines can be localized only in the sides excluding the vicinity of six apexes.

Furthermore, dislocation lines may be formed over regions including the centers of two mutually parallel main planes of tabular grains. In the case where dislocation lines are formed over the entire regions of the main planes, the dislocation lines may crystallographically be oriented approximately in the (211) direction when viewed in the direction perpendicular to the main planes, and the formation of the dislocation lines may be effected either in the (110) direction or randomly. Further, the length of each dislocation line may be random, and the dislocation lines may be observed as short lines on the main planes or as long lines extending to the side (periphery). The dislocation lines may be straight or often meander. In many instances, the dislocation lines cross each other.

The position of dislocation lines may be localized on the periphery, main planes or local points as mentioned above, or the formation of dislocation lines may be effected on a combination thereof. That is, dislocation lines may be concurrently present on both the periphery and the main planes.

The tabular grains preferably has a homogeneous distribution of dislocation lines among the grains. The emulsion is preferably occupied by silver halide grains having 10 or more dislocation lines per grain in an amount of 100 to 50% (in number of grains), preferably 100 to 70%, especially preferably 100 to 90%.

The silver iodide content on the grain surface of a tabular grain emulsion of the present invention is preferably 5 mol % or less. The silver iodide content on the grain surface of the present invention is measured by using XPS (X-ray Photoelectron Spectroscopy). The principle of XPS used in an analysis of the silver iodide content near the surface of a silver halide grain is described in Junnich Aihara et al., "Spectra of Electrons" (Kyoritsu Library 16: issued Showa 53 by Kyoritsu Shuppan). A standard measurement method of XPS is to use Mg-Kα as excitation X-rays and measure the intensities of photoelectrons (usually I-3d5/2 and Ag-3d5/2) of iodine (I) and silver (Ag) released from silver halide grains in an appropriate sample form. The content of iodine can be calculated from a calibration curve of the photoelectron intensity ratio (intensity (I)/intensity (Ag)) of iodine (I) to silver (Ag) formed by using several different standard samples having known iodine contents. XPS measurement for a silver halide emulsion must be performed after gelatin adsorbed by the surface of a silver halide grain is decomposed and removed by, e.g., proteinase. A tabular grain emulsion in which the silver iodide content on the grain surface is 10 mol % or less is an emulsion whose silver iodide content is 10 mol % or less when the emulsion grains are analyzed by XPS. If obviously two or more types of emulsions are mixed, appropriate preprocessing such as centrifugal separation or filtration must be performed before one type of emulsion is analyzed.

It is preferred that the silver iodide distribution have an intragranular structure. The silver iodide distribution can have a double structure, a treble structure, a quadruple structure or a structure of higher order. The silver iodide content may continuously change in the grain. The boundary of silver iodide content between structures can be a continuously gradually changing boundary. For example, a triple structured grain consisting of silver bromide/silver iodobromide/silver bromide and higher structured grain are preferable. The silver iodide content of an inner layer is preferably higher than that of the surface by preferably 5 mol % or more, more preferably 7 mol % or more. The boundary of silver iodide content between the structure may be either clear or may gradually change continuously. Commonly, when measured by using a powder X-ray diffraction method, the silver iodide content does not show any two distinct peaks; it shows an X-ray diffraction profile whose tail extends in the direction of high silver iodide content.

Next, a description will be made to a silver halide emulsion (a second emulsion) that is preferably used in the invention, that is, grains having (111) faces as their parallel main planes wherein there is at least one epitaxial junction per grain at an apex portion and/or a side face portion and/or a main plane portion of a hexagonal silver halide grain, and wherein a ratio of the length of an edge having the maximum length to the length of an edge having the minimum length, is 2 or less. The grain with an epitaxial junction refers to a grain having main body of the silver halide grain to which a crystal portion (that is, an epitaxial portion) is joined, wherein the joined crystal portion usually protrudes from the main body of the silver halide grain. It is preferable that the ratio of the joined crystal portion (epitaxial portion) to the amount of the total silver contained in the grain is 2% or more and 30% or less, and more preferably or more 5% and 15% or less. The epitaxial portion may be located anywhere in the main body of the grain, but it is preferably located at a grain main plane portion and/or a grain edge portion and/or a grain corner portion. The number of the epitaxial portion is preferably at least one. The composition of the epitaxial portion is preferably AgCl, AgBrCl, AgBrClI, AgBrI, AgI, AgSCN and the like. When there is an epitaxial portion, a dislocation line may be present inside the grain, but it does not have to be present.

Next, a description will be made to methods for preparing the first emulsion and the second emulsion silver halide grains.

The preparation process of the present invention comprises (a) a base grain forming process and a grain forming process (process (b)) following step (a). Basically, it is preferable that process (a) is followed by process (b), but only process (a) may be carried out. Process (b) may be any of (b1) a step of introducing dislocation, (b2) a step of introducing dislocation at a corner portion restrictedly, and (b3) an epitaxial junction step. Process (b) may contain either one step or a combination of two or more steps.

First, (a) base grain forming process will be described. A base portion is preferably at least 50%, more preferably 60% or more of the amount of the total silver used for the grain formation. The average content of iodine relative to the amount of silver in the base portion is preferably 0 mol % or more and 30 mol % or less, and more preferably 0 mol % or more and 15 mol % or less. The base portion may have a core-shell structure, as needed. In this case, the core portion of the base portion is preferably 50% or more and 70% or less of the amount of the total silver contained in the base portion. The average iodine composition of the core portion is preferably 0 mol % or more and 30 mol % or less, and more preferably 0 mol % or more and 15 mol % or less. The iodine composition of the shell portion is preferably 0 mol % or more and 3 mol % or less.

The step (a) usually comprising forming silver halide nuclei and then allowing the silver halide grains to grow, thereby obtaining grains with a desired size is general as a method for preparing a silver halide emulsion. Further, with respect to the formation of tabular grains, steps of, at least, nucleation, ripening and growing are contained. These steps will be described in U.S. Pat. No. 4,945,037 in detail.

1. Nucleation Step

The nucleation of tabular grains is in general carried out by a double jet method comprising adding a silver salt aqueous solution and an alkali halide aqueous solution to a reaction vessel containing a protective colloid aqueous solution, or a single jet method comprising adding a silver salt aqueous solution to a protective colloid solution containing alkali halide. If necessary, a method comprising adding an alkali halide aqueous solution to a protective colloid solution containing silver salt may be used. Further, if necessary, a method comprising adding a protective colloid solution, a silver salt solution and an alkali halide aqueous solution to the mixer disclosed in JP-A-2-44335, and immediately transfer the mixture to a reaction vessel may be used for the nucleation of tabular grains. Further, as disclosed in U.S. Pat. No. 5,104,786, nucleation can be performed by passing an aqueous solution containing alkali halide and a protective colloid solution through a pipe and adding a silver salt aqueous solution thereto. Further, nucleation in which the chloride content is 10 mol % or more with respect to the silver amount used for nucleation as described in U.S. Pat. No. 6,022,681 may be conducted.

In the nucleation, it is preferable that dispersing medium is formed under a condition of pBr of 1 to 4 while using gelatin as a dispersing medium. Types of gelatin include alkali-processed gelatin, low molecular weight gelatin (mol. wt.: 3,000 to 40,000), oxidation-processed gelatin as described in U.S. Pat. Nos. 4,713,320 and 4,942,120 and low molecular weight oxidation-processed gelatin, all of which may be used. The low molecular weight oxidation processed gelatin is especially preferably used.

The concentration of the dispersing medium is preferably 10% by weight or less, more preferably 1% by weight or less.

The temperature in the nucleation is preferably from 5 to 60° C, but when fine tabular grains having an average grain diameter of 0.5 μm or less are produced, the temperature is more preferably from 5 to 48° C.

The pH of the dispersing medium is preferably 1 to 10, and more preferably 1.5 to 9.

It is also possible to add a polyalkyleneoxide compound as described in U.S. Pat. Nos. 5,147,771, 5,147,772, 5,147,773, 5,171,659, 5,210,013, 5,252,453, and 3,089,578 in the nucleation step, or a later ripening step and a growing step.

2. Ripening Step

In the nucleation described in 1 above, fine grains other than tabular grains are formed (in particular, octahedral and single twin grains). Accordingly, the grains other than tabular grains are necessary to be vanished before entering a growing step described infra to obtain nuclei having the forms of becoming tabular grains and good monodispersibility. For this purpose, it is well known that Ostwald ripening is conducted subsequent to the nucleation.

The pBr is adjusted just after nucleation, then the temperature is raised and ripening is carried out until the hexagonal tabular grain ratio reaches the maximum. At this time, protective colloid may be added additionally. The concentration of protective colloid to the dispersion medium solution at this time is preferably 10% by weight or less. The above-described alkali-processed gelatin, amino group-modified gelatin describe in JP-A-11-143002 such as succinated gelatin or trimellitated gelatin in which 95% or more amino groups are modified, imidazol group modified gelatin described in JP-A-11-143003, and oxidation-processed gelatin, are used. Succinated gelatin or trimellitated gelatin are preferably used.

The temperature during ripening is from 40 to 80° C., preferably from 50 to 80° C., and the pBr is from 1.2 to 3.0. The pH is preferably 1.5 to 9.

A silver halide solvent may be used for rapidly vanishing grains other than tabular grains. The concentration of the silver halide solvent at this time is preferably from 0.3 mol/L or less, more preferably 0.2 mol/L or less. For use as a direct reversal emulsion, silver halide solvents that are used under a neutral or acid condition such as thioether compounds and the like are preferable to $NH_3$ that is used under an alkaline condition.

Thus, almost pure tabular grains are obtained by the ripening.

After the ripening is completed, if the silver halide solvent is unnecessary in the next growing stage, the silver halide solvent is removed as follows.

(i) In the case of alkaline silver halide solvents such as $NH_3$, an acid having great solubility product with Ag+ such as $HNO_3$ is added to be nullified.

(ii) In the case of thioether based silver halide solvent, an oxidizing agent such as $H_2O_2$ is added to be nullified as disclosed in JP-A-60-136736.

3. Growing Step

The pBr during the crystal growing stage subsequent to the ripening step is preferably maintained at 1.4 to 3.5. When the concentration of gelatin in a dispersion medium solution before entering the growing step is low (1% by weight or less), gelatin is additionally added in some cases. The concentration of gelatin in a dispersing medium solution at that time is preferably from 1 to 10% by weight. The gelatin used in this time includes alkali-processed gelatin, succinated gelatin or trimellitated gelatin whose 95% or more of the amino groups are modified, and oxidation-processed gelatin. Succinated gelatin and trimellitated gelatin are especially preferably used.

The pH during growth is 2 to 10, preferably 4 to 8. Provided that in the presence of succinated gelatin or trimellitated gelatin, the pH is preferably 5 to 8. It is preferable that the addition rates of $Ag^+$ and halide ions during crystal growing are controlled so that the crystal growing rate becomes 20 to 100%, preferably 30 to 100% of crystal critical growing rate. In this case, the addition rates of silver ions and halide ions are increased with crystal growth. For this purpose, either the addition rates of silver salt and halide salt solutions may be increase as described in Japanese Patent Application KOKOKU Publication No. (hereinafter referred to as JP-B-) 48-36890 and JP-B-52-16364, or the concentrations of the solutions may be increased. A double jet method in which the silver salt solution and that of the halide salt solution are added simultaneously, may be conducted. Simultaneous addition of an aqueous silver nitrate solution and an aqueous solution containing bromide and a silver iodide fine grain emulsion as described in U.S. Pat. Nos. 4,672,027 and 4,693,964 is preferable. In this case, the temperature during growth is preferably 50° C. to 90° C., more preferably 60° C. to 85°

C. The AgI fine grain emulsion may be one prepared in advance or may be added while being prepared continuously. For the preparation method of this case JP-A-10-43570 may be referred to in this case.

The average grain size of the AgI emulsion to be added is 0.005 μm or more and 0.1 μm or less, and preferably 0.007 μm or more and 0.08 μm or less. The iodine composition of the base grains can be varied by adjusting the amount of the AgI emulsion to be added.

It is also possible to add silver iodobromide fine grains instead of adding an aqueous silver salt solution and an aqueous halide salt solution. In this case, base grains having a desired iodine composition are obtained by rendering the iodine amount of the fine grains equal to the iodine amount of the desired base grains. Although the silver iodobromide fine grains may be those prepared in advance, it is more preferable that the fine grains may be added while being prepared continuously. The size of the silver iodobromide fine grains to be added is 0.005 μm or more and 0.1 μm or less, and preferably 0.01 μm or more and 0.08 μm or less. The temperature during the growth is 50° C. or more and 90° C. or less, and preferably from 60° C. to 85° C.

Next, step (b) will be described.

First, step (b1) will be described. Step (b1) comprises a first shell step and a second shell step. A first shell is formed on the base described above. The ratio of the first shell is 1% or more and 30% or less of the total silver amount, and the average silver iodide content of the first shell is 20 mol % or more and 100 mol % or less. More preferably, the ratio of the first shell is 1% or more and 20% or less of the total silver amount, and the average silver iodide content of the first shell is preferably 25 mol % or more and 100 mol % or less. The growth of the first shell on a base is basically performed by the addition of an aqueous silver nitrate solution and an aqueous halogen solution containing both iodide and bromide by the double-jet method, or by the addition of an aqueous silver nitrate solution and an aqueous halogen solution containing iodide by the double-jet method. Alternatively, an aqueous halogen solution containing iodide is added by the single-jet method.

Any of these methods may be applied, and any combination thereof may also be applied. As is clear from the average silver iodide content of the first shell, silver iodide can also precipitate in addition to a silver iodobromide mixed crystal during the formation of the first shell. In either case, the silver iodide vanishes and entirely changes into a silver iodobromide mixed crystal during the formation of the second shell.

A preferable method for the formation of the first shell is a method comprising adding a silver iodobromide or silver iodide fine grain emulsion, ripening and dissolving. Another preferable method is a method comprising adding a silver iodide fine grain emulsion, followed by the addition of an aqueous silver nitrate solution or addition of aqueous silver nitrate solution and an aqueous halogen solution. In this case, the dissolution of the silver iodide fine grain emulsion is accelerated by the addition of the aqueous silver nitrate solution. The silver amount of the added silver iodide fine grain emulsion is used to obtain the first shell, and the silver iodide content thereof is assumed to be 100 mol %. The amount of silver of the added aqueous silver nitrate solution is used to calculate the second shell. It is preferable that the silver iodide fine grain emulsion is added abruptly.

"To add a silver iodide fine grain emulsion abruptly adding" is to add the silver iodide fine grain emulsion preferably within 10 minutes, and more preferably, within 7 minutes. This condition may vary in accordance with, e.g., the temperature, pBr, and pH of the system to which the emulsion is added, the type and concentration of a protective colloid agent such as gelatin, and the presence/absence, type, and concentration of a silver halide solvent. However, a shorter addition time is more preferable as described above. During the addition, it is preferable that an aqueous solution of silver salt such as silver nitrate is not substantially added. The temperature of the system during the addition is preferably 40° C. or more and 90° C. or less, and most preferably, 50° C. or more and 80° C. or less.

A silver iodide fine grain emulsion essentially need only be silver iodide and can contain silver bromide and/or silver chloride as long as a mixed crystal can be formed. The emulsion is preferably 100% silver iodide. The crystal structure of silver iodide can be a β body, a γ body, or, as described in U.S. Pat. No. 4,672,026, an α body or an α body similar structure. In the present invention, the crystal structure is not particularly restricted but is preferably a mixture of β and γ bodies, and more preferably, a β body. The silver iodide fine grain emulsion can be either an emulsion formed immediately before addition described in U.S. Pat. No. 5,004,679, or an emulsion subjected to a regular washing step. In the present invention, an emulsion subjected to a regular washing step is used. The silver iodide fine grain emulsion can be readily formed by a method described in, e.g., aforementioned U.S. Pat. No. 4,672,026. A double-jet addition method using an aqueous silver salt solution and an aqueous iodide salt solution in which grain formation is performed with a fixed pI value is preferred. The pI is the logarithm of the reciprocal of the $I^-$ ion concentration of the system. The temperature, pI, and pH of the system, the type and concentration of a protective colloid agent such as gelatin, and the presence/absence, type, and concentration of a silver halide solvent are not particularly limited. However, a grain size of preferably 0.1 μm or less, and more preferably, 0.07 μm or less is convenient for the present invention. Although the grain shapes cannot be perfectly specified because the grains are fine grains, the variation coefficient of a grain size distribution is preferably 25% or less. The effect of the present invention is particularly remarkable when the variation coefficient is 20% or less. The sizes and the size distribution of the silver iodide fine grain emulsion are obtained by laying silver iodide fine grains on a mesh for electron microscopic observation and directly observing the grains by a transmission method instead of a carbon replica method. This is because measurement errors are increased by observation done by the carbon replica method since the grain sizes are small. The grain size is defined as the diameter of a circle having an area equal to the projected surface area of the observed grain. The grain size distribution also is obtained by using this equivalent-circle diameter of the projected surface area. In the present invention, the most effective silver iodide fine grains have a grain size of 0.06 to 0.02 μm and a grain size distribution variation coefficient of 18% or less.

After the grain formation described above, a silver iodide fine grain emulsion is preferably subjected to regular washing described in, e.g., U.S. Pat. No. 2,614,929, and adjustments of the pH, the pI, the concentration of a protective colloid agent such as gelatin, and the concentration of the contained silver iodide are performed. The pH is preferably 5 to 7. The pI value is preferably the one at which the solubility of silver iodide is a minimum or the one higher than that value. As the protective colloid agent, a common gelatin having an average molecular weight of approximately 100,000 is preferably used. A low-molecular-weight gelatin having an average molecular weight of 20,000 or less also is preferably used. It is sometimes convenient to use a mixture of gelatins having different molecular weights. The gelatin amount is preferably 10 to 100 g, and more preferably, 20 to 80 g per kg of an emulsion. The silver amount is preferably 10 to 100 g, and more preferably, 20 to 80 g, in terms of silver atoms, per kg of an emulsion. As the gelatin amount and/or the silver amount, it is preferable to choose values suited to abrupt addition of the silver iodide fine grain emulsion.

When the silver iodide fine grain emulsion is added, it is necessary to sufficiently raise the efficiency of stirring of the system. The rotating speed of stirring is preferably set to be higher than usual. The addition of an antifoaming agent is effective to prevent the formation of foam during the stirring. More specifically, an antifoaming agent described in, e.g., examples of U.S. Pat. No. 5,275,929 is used.

As a more preferable method for forming the first shell, it is possible to form a silver halide phase containing silver iodide while causing iodide ions to generate abruptly by using an iodide ion releasing agent described in U.S. Pat. No. 5,496,694, instead of the conventional iodide ion supply method (the method of adding free iodide ions).

The iodide ion-releasing agent releases iodide ions through its reaction with an iodide ion release control agent (a base and/or a nucleophilic reagent). Preferable examples of this nucleophilic reagent used include the following chemical species, e.g., hydroxide ion, sulfite ion, hydroxylamine, thiosulfate ion, metabisulfite ion, hydroxamic acids, oximes, dihydroxybenzenes, mercaptanes, sulfinate, carboxylate, ammonia, amines, alcohols, ureas, thioureas, phenols, hydrazines, hydrazides, semicarbazides, phosphines and sulfides.

The release rate and timing of iodide ions can be controlled through the control of the concentration and addition method of a base or a nucleophilic reagent or the control of the temperature of the reaction solution. A preferable base is alkali hydroxide.

To generate iodide ions abruptly, the concentrations of the iodide ion-releasing agent and iodide ion release control agent are preferably $1\times10^{-7}$ to 20 M, more preferably, $1\times10^{-5}$ to 10 M, further preferably, $1\times10^{-4}$ to 5 M, and particularly preferably, $1\times10^{-3}$ to 2 M.

If the concentration exceeds 20 M, the addition amounts of the iodide ion-releasing agent and iodide ion release control agent having large molecular weights adversely become too great compared to the capacity of the grain formation vessel. If the concentration is less than $1\times10^{-7}$ M, the iodide ion-releasing reaction rate adversely becomes too low, and this makes it difficult to abruptly generate the iodide ion-releasing agent.

The temperature is preferably 30 to 80° C., more preferably, 35 to 75° C., and particularly preferably, 35 to 60° C. At high temperatures exceeding 80° C., the iodide ion-releasing reaction rate generally becomes extremely high. At low temperatures below 30° C., the iodide ion-releasing reaction temperature generally becomes extremely low. Both cases are undesirable because the use conditions are restricted.

When a base is used to release iodide ions, a change in the solution pH can also be used. If this is the case, the pH range for controlling the rate and timing of releasing iodide ions is preferably 2 to 12, more preferably 3 to 11, and particularly preferably 5 to 10. Most preferably, the pH after adjustment is 7.5 to 10.0. Under a neutral condition of pH 7, hydroxide ions having a concentration determined by the ion product of water function as control agents.

A nucleophilic reagent and a base can be used jointly. When this is the case, the pH can be controlled within the above range to thereby control the rate and timing of releasing iodide ions.

The second shell is formed on the above-described base and a tabular grain having the first shell. The ratio of the second shell is 10 mol % or more and 40 mol % or less of the total silver amount, and the average silver iodide content of the second shell is 0 mol % or more and 5 mol % or less. More preferably, the ratio of the second shell is 15 mol % or more and 30 mol % or less of the total silver amount, and the average silver iodide content of the fourth shell is 0 mol % or more and 3 mol % or less. The growth of the second shell on a base and a tabular grain having the first shell can be performed either in a direction to increase the aspect ratio of the tabular grain or in a direction to decrease it. The growth of the second shell is basically performed by addition of an aqueous silver nitrate solution and an aqueous halogen solution containing bromide using the double-jet method. Alternatively, it is also possible to add an aqueous silver halogen solution containing bromide and then add an aqueous silver nitrate solution by the single-jet method. The temperature and pH of the system, the type and concentration of a protective colloid agent such as gelatin, and the presence/absence, type, and concentration of a silver halide solvent may vary over a broad range. With respect to pBr, the pBr at the end of the formation of the second shell layer is preferably higher than that in the initial stages of the formation of that layer. Preferably, the pBr in the initial stages of the formation of the layer is 2.9 or less, and the pBr at the end of the formation of the layer is 1.7 or more. More preferably, the pBr in the initial stages of the formation of the layer is 2.5 or less, and the pBr at the end of the formation of the layer is 1.9 or more. Most preferably, the pBr in the initial stages of the formation of the layer is 1 or more and 2.3 or less and the pBr at the end of the formation of the layer is 2.1 or more and 4.5 or less.

It is preferable that there are dislocation lines in the portion of step (b1). The dislocation lines are preferably present in the vicinities of the side faces of tabular grains. The vicinities of the side faces refer to the six side faces of a tabular grain and the area inside the faces, that is, the portion grown in step (b1).

Next, step (b2) will be described.

Step (b2) includes the following embodiments: as a first embodiment, a method comprising dissolving only the vicinities of apexes with iodide ions; as a second embodiment, a method comprising adding a silver salt solution and an iodide salt solution simultaneously; as a third embodiment, a method comprising substantially dissolving only the vicinities of apexes with a silver halide solvent; and as a forth embodiment, a method via halogen conversion.

The first embodiment, the method of dissolving with iodide ions will be described below.

When iodide ions are added to base grains, the vicinity of each apex portion of the base grains is dissolved and the grains are somewhat rounded. When, successively, a silver nitrate solution and a bromide solution, or a silver nitrate solution and a mixed solution comprising a bromide solution and an iodide solution are added simultaneously, the grains further grow and dislocation is introduced in the vicinities of the apexes. With respect to this method, JP-A's-4-149541 and 9-189974 are available as references.

For attaining an effective dissolution according to the present embodiment, it is preferable that when the value obtained by multiplying, by 100, the quotient resulting from dividing the number of the whole iodide ions by the mol number of the total silver in the base grains is let be $I^2$ (mol %), the total amount of the iodide ions to be added in this embodiment satisfies the condition in which $(I^2-I^1)$ is 0 or more and 8 or less, and more preferably 0 or more and 4 or less, with respect to the silver iodide content of the base grains $I^1$ (mol %).

The lower the concentration of the iodide ions to be added in this embodiment, the more preferable. Specifically, the concentration is preferably 0.2 mol/L or less, and more preferably 0.1 mol/L or less. pAg during the addition of iodide ions is preferably 8.0 or more, and more preferably 8.5 or more.

Following the dissolution of the apex portions of the base grains by the addition of iodide ion to the base grains, the grains are further grown so that dislocation is introduced in the vicinities of the apexes by the addition of a silver nitrate solution or the simultaneous addition of a silver nitrate solution and a bromide solution or a silver nitrate solution and a mixed solution comprising a bromide solution and an iodide solution.

The second embodiment, the method comprising adding a silver salt solution and an iodide salt solution simultaneously will be described below. By rapidly adding a silver salt solution and an iodide salt solution to base grains, it is possible to epitaxially generate silver iodide or a silver halide having a high silver iodide content at apex portions of the grains. At this time, the addition rates of the silver salt solution and the iodide salt solution are preferably 0.2 min. or more and 0.5 min. or less, more preferably 0.5 min. or more and 2 min. or less. This method is disclosed in JP-A-4-149541 and therefore the publication is available as a reference.

Following the dissolution of the apex portions of the base grains by the addition of iodide ion to the base grains, the grains are further grown so that dislocation is introduced in the vicinities of the apexes by the addition of a silver nitrate solution or the simultaneous addition of a silver nitrate solution and a bromide solution or a silver nitrate solution and a mixed solution comprising a bromide solution and an iodide solution.

The third embodiment, the method using a silver halide solvent will be described below.

When a silver halide solvent is added to a dispersion medium containing base grains and then a silver salt solution and an iodide salt solution are added simultaneously, silver iodide or a silver halide having a high silver iodide content preferentially grows at apex portions of the base grains dissolved with the silver halide solvent. In this operation, it is not necessary to add the silver salt solution or the iodide salt solution rapidly. This method is disclosed in JP-A-4-149541 and therefore the publication is available as a reference.

Following the dissolution of the apex portions of the base grains by the addition of iodide ion to the base grains, the grains are further grown so that dislocation is introduced in the vicinities of the apexes by the addition of a silver nitrate solution or the simultaneous addition of a silver nitrate solution and a bromide solution or a silver nitrate solution and a mixed solution comprising a bromide solution and an iodide solution.

Next, the forth embodiment, the method via halogen conversion will be described.

This is a method in which an epitaxially growing site director (hereinafter, referred to as a site director), such as a sensitizing dye disclosed in JP-A-58-108526 and a water-soluble iodide, is added to base grains so that epitaxial of silver chloride is formed at the apex portions of the base grains and then iodide ions are added so that the silver chloride is halogen converted into silver iodide or silver halide having a high silver iodide content. As the site director, sensitizing dyes, a water-soluble thiocyanate ion and water-soluble iodide ion can be used, and the iodide ion is preferable. The iodide ion is used in an amount of 0.0005 to 1 mol %, and preferably 0.001 to 0.5 mol % of the base grains.

A halide conversion is described in e.g., U.S. Pat. No. 4,142,900. The details of selectively converting silver chloride that was epitaxially grown at apex portions of the base grains into iodide ions are described in JP-A-4-149541.

Following the above mentioned halogen conversion of the silver chloride epitaxially grown at apex portions of the base grains into a silver iodide phase caused by the addition of iodide ions, the grains are further grown so that dislocation is introduced in the vicinities of the apexes by the addition of a silver nitrate solution or the simultaneous addition of a silver nitrate solution and a bromide solution or a silver nitrate solution and a mixed solution comprising a bromide solution and an iodide solution.

It is preferable that there are dislocation lines in the portion of step (b2). The dislocation lines are preferably present in the vicinities of the apex portions of tabular grains.

Next, step (b3) will be described.

About the epitaxial formation of silver halide to base grains, U.S. Pat. No. 4,435,501 discloses that silver salt epitaxial can be formed at selected sites, e.g., apex portions or corner of base grains, by a site director such as iodide ions, aminoazaindene or spectral sensitizing dyes adsorbed to the surface of the base grains. In JP-A-8-69069, the enhancement of sensitivity is attained by forming silver salt epitaxial at selected sites in extremely thin tabular grains and subjecting the epitaxial phase to optimum chemical sensitization. Also in the present invention, it is very preferable to enhance the sensitivity of the base grains of the present invention using these methods. As the site director, aminoazaindene or spectral sensitizing dyes may be used and iodide ions or thiocyanate ions may also be used. These may be properly used depending on the purposes, or may be used in combination. By varying the addition amounts of the sensitizing dyes, sensitizing ions and thiocyanate ions, the site for forming silver salt epitaxial can be limited to the main plane portions, or corner portions of base grains. The addition amount of the iodide ions is 0.0005 to 1.0 mol %, preferably 0.001 to 0.5 mol % to the silver amount of the base grains. Further the amount of the thiocyanate ions is 0.01 to 0.2 mol %, preferably 0.02 to 0.1 mol % of the silver mount of the base grains. After the addition of the site director, the silver salt solution and halide solution are added to form epitaxial. The temperature at which silver salt epitaxial is formed is preferably 40 to 70° C., and more preferably 45 to 60° C. At this time, pAg is preferably 7.5 or less, and more preferably 6.5 or less. By using the site directors epitaxial of silver salt can be formed on corner portions or edge portions of the base grain. The thus obtained emulsion may be enhanced its sensitivity by being subjected to chemical sensitization selectively in its epitaxial phase as in JP-A-8-69069, and also may be further grown by means of simultaneous addition of a silver salt solution and a halide salt solution following the silver salt epitaxial formation. As the aqueous halide salt solution to be added in this treatment, a bromide salt solution, or a mixed solution comprising a bromide salt solution and an iodide salt solution is preferable. In the treatment, the temperature is preferably 40 to 80° C., and more preferably 45 to 70° C. At this time, pAg is preferably 5.5 or more and 9.5 or less, and more preferably 6.0 or more and 9.0 or less.

The epitaxial formed in step (b3) is characterized by projecting outside the base grains formed in step (a). The composition of epitaxial is preferably AgCl, AgBrCl, AgBrClI, AgBrI, AgI, AgSCN, or the like. It is more preferable to introduce a "dopant (metal complex)" such as those disclosed in JP-A-8-69069, to an epitaxial layer. The position of epitaxial growth may be at least a part of the corner portions, the edge portions and the main plane portions of the base grains and also may be spread over two or more portions. It is preferable that the shapes wherein the epitaxial is only at corner portions, or only at edge portions or both corner and edge portions.

No dislocation lines are required to be present in the portion of step (b3), but it is more preferable that there is a dislocation line. It is preferable for dislocation lines to be present in the connecting portion between a base grain and an epitaxial growth portion or in an epitaxial portion. Preferable number of the dislocation lines are those as described above.

It is preferable that the system is doped with a hexacyanometal complex during the formation of an epitaxial portion. Of hexacyanometal complexes, those containing iron, ruthenium, osmium, cobalt, rhodium, iridium or chromium are preferable. The addition amount of such a metal complex is preferably with in the range of from $10^{-9}$ to $10^{-2}$ mol per mol of silver halide, and more preferably within the range of from $10^{-8}$ to $10^{-4}$ mol per mol of silver halide. The metal complex may be added after being dissolved in water or an organic solvent. The organic solvent preferably has a miscibility with water. Examples of the organic solvent includes alcohol, ether, glycol, ketone, ester and amide.

As the metal complexes, hexa-cyanometal complexes represented by the following formula (A) is especially preferable. The hexa-cyano metal complex has advantages of attaining high-sensitive photosensitive material, and suppressing fogging from arising even when a raw photosensitive material is stored for a long period of time.

$$[M(CN)_6]^{n-} \quad (A)$$

wherein M represents iron, ruthenium, osmium, cobalt, rhodium, iridium or chromium, and n represent 3 or 4.

Specific examples of the hexa-cyano metal complexes are set forth below:

$$[Fe(CN)_6]^{4-} \quad (A\text{-}1)$$

$$[Fe(CN)_6]^{3-} \quad (A\text{-}2)$$

$$[Ru(CN)_6]^{4-} \quad (A\text{-}3)$$

$$[Os(CN)_6]^{4-} \quad (A\text{-}4)$$

$$[Co(CN)_6]^{3-} \quad (A\text{-}5)$$

$$[Rh(CN)_6]^{3-} \quad (A\text{-}6)$$

$$[Ir(CN)_6]^{3-} \quad (A\text{-}7)$$

$$[Cr(CN)_6]^{4-} \quad (A\text{-}8)$$

For the counter cations of the hexa-cyano complex, those easily miscible with water, and suitable for precipitation procedure of a silver halide emulsion are preferably used. Examples of the counter ions includes alkali metal ions (e.g. sodium ion, potassium ion, rubidium ion, cesium ion and lithium ion), ammonium ion and alkylammonium ion.

A description will be made to an emulsion (the third emulsion) that can be used in the present invention, that is, tabular silver halide grains having (100) faces as their parallel main planes and constituted by silver iodobromide or silver chloroiodobromide whose chloride content is 10 mol % or less.

The third emulsion comprises tabular grains in which 50 to 100%, preferably 70 to 100%, and more preferably 90 to 100%, of the total projected area is occupied by tabular grains having (100) faces as main planes and having an aspect ratio of 2 or more. The grain thickness is preferably in the range of 0.01 to 0.10 μm, more preferably 0.02 to 0.08 μm, and most preferably 0.03 to 0.07 μm. The aspect ratio is preferably in the range of 2 to 100, more preferably 3 to 50, and most preferably 5 to 30. The variation coefficient of grain thickness is preferably 30% or less, more preferably 25% or less, and most preferably 20% or less. The smaller this variation coefficient, the higher the monodispersity of grain thickness. Further, the average equivalent sphere diameter of the emulsion grains is preferably less than 0.35 μm.

The silver halide composition of the (100) tabular grains is silver iodobromide or silver chloroiodobromide having a silver chloride content of less than 10 mol %. Furthermore, other silver salts, such as silver rhodanide, silver sulfide, silver selenide, silver telluride, silver carbonate, silver phosphate and an organic acid salt of silver, may be contained in the form of other separate grains or as parts of silver halide grains.

The X-ray diffraction method is known as means for investigating the halogen composition of AgX crystals. The X-ray diffraction method is described in detail in, for example, Kiso Bunseki Kagaku Koza 24 (Fundamental Analytical Chemistry Course 24) "X-sen Kaisetu (X-ray Diffraction)". In the standard method, Kβ radiation of Cu is used as a radiation source, and the diffraction angle of AgX (420) face is determined by the powder method.

The halogen composition structure of (100) tabular grains according to the present invention is not limited. Examples thereof include grains having a core/shell double structure wherein the halogen compositions of the core and the shell are different from each other and grains having a multiple structure composed of a core and two or more shells. The core is preferably constituted of silver bromide, to which, however, the core of the present invention is not limited. With respect to the composition of the shell, it is preferred that the silver iodide content be higher therein than in the core.

It is preferred that the (100) tabular grains have an average silver iodide content of 2.3 mol % or more and an average silver iodide content, at the surface of grains, of 8 mol % or more. Further, the variation coefficient of the silver iodide contents among the grains is more preferably less than 30%. The surface silver iodide content, can be measured by the above mentioned XPS.

The (100) tabular grains generally have a main plain of rectangular shape, but the corner thereof may be truncated or rounded, or the side face of the grain may be (111) plane.

With respect to the (100) tabular grains, the ratio of (100) faces to surface crystal habits is 80% or more, preferably 90% or more. A statistical estimation of the ratio can be performed by the use of an electron micrograph of grains. When the (100) tabular face ratio of AgX grains of an emulsion is nearly 100%, the above estimate can be ascertained by the following method.

It is preferable that an electron-capturing zone is introduced to the (100) tabular grains by doping multivalent metal ions during grain formation. The electron-capturing zone means a portion in which the multivalent metal ion-containing concentration is $1\times10^{-5}$ to $1\times10^{-3}$ mol/mol of silver where the multivalent metal ions are doped, and occupying 5% to 30% of the grain volume. The multivalent metal ion-containing concentration is more preferably $5\times10^{-5}$ to $5\times10^{-4}$ mol/mol.

It is necessary for the multivalent metal ion-containing concentration to be homogeneous. The term homogeneous means the introduction of the multivalent metal ions into grains is conducted in a constant amount per unit silver amount, and the multivalent ions are introduced to a reaction vessel for grain formation simultaneously with that of silver nitrate to be used for the grain formation. During this, a halide solution may be added simultaneously. A compound containing the multivalent metal ion of the invention may be added as an aqueous solution. Alternatively, fine grains to which a compound to become the multivalent ion is doped or adsorbed are prepared and added.

The electron-capturing zone may be present at any portion of in the grain. Further, two or more electron-capturing zones may be present in the grain.

A description will be made to the fourth emulsion that can be used in the photosensitive material of the present invention, that is, tabular silver halide grains having (111) faces or (100) faces as parallel main planes, having an aspect ratio of 2 or more and containing silver chloride in an amount of at least 80 mol % (hereinafter referred to as a high silver chloride).

Special measures must be implemented for producing high silver chloride (111) grains. Use may be made of the method of producing high silver chloride tabular grains with the use of ammonia as described in U.S. Pat. No. 4,399,215 to Wey. Also, use may be made of the method of producing high silver chloride tabular grains with the use of a thiocyanate as described in U.S. Pat. No. 5,061,617 to Maskasky. Further, use may be made of the following methods of incorporating additives (crystal habit-controlling agents):

| Patent No. | crystal habit-controlling agent | Inventor |
|---|---|---|
| U.S. Pat. No. 4,400,463 | azaindene + thioether peptizer | Maskasky |
| U.S. Pat. No. 4,783,398 | 2,4-dithiazolidinone | Mifune et al. |
| U.S. Pat. No. 4,713,323 | aminopyrazolopyrimidine | Maskasky |
| U.S. Pat. No. 4,983,508 | bispyridinium salt | Ishiguro et al. |
| U.S. Pat. No. 5,185,239 | triaminopyrimidine | Maskasky |
| U.S. Pat. No. 5,178,997 | 7-azaindole compound | Maskasky |
| U.S. Pat. No. 5,178,998 | xanthine | Maskasky |
| JP-A-64-70741 | dye | Nishikawa et al. |
| JP-A-3-212639 | aminothioether | Ishiguro |
| JP-A-4-283742 | thiourea derivative | Ishiguro |
| JP-A-4-335632 | triazolium salt | Ishiguro |
| JP-A-2-32 | bispyridinium salt | Ishiguro et al. |
| JP-A-8-227117 | monopyridinium salt | Ozeki et al. |

With respect to the formation of (111) tabular grains, although various methods of using crystal habit-controlling agents are known as listed in the above table, the compounds (compound examples 1 to 42) described in JP-A-2-32 are preferred, and the crystal habit-controlling agents 1 to 29 described in JP-A-8-227117 are especially preferred. However, the present invention is in no way limited to these.

The (111) tabular grains are obtained by forming two parallel twinned crystal faces. The formation of such twin faces is influenced by the temperature, dispersion medium (gelatin), halide concentration, etc., so that appropriate conditions must be set on these. In the presence of a crystal habit-controlling agent at the time of nucleation, the gelatin concentration is preferably in the range of 0.1 to 10%. The chloride concentration is 0.01 mol/liter or more, preferably 0.03 mol/liter (liter hereinafter referred to as "L") or more.

Nuclei of tabular grains are formed at the initial stage of nucleation. However, a multiplicity of non-tabular grain nuclei are contained in the reaction vessel immediately after the nucleation. Therefore, such a technology that, after the nucleation, ripening is carried out to thereby cause only tabular grains to remain while other grains are eliminated is required. When the customary Ostwald ripening is performed, nuclei of tabular grains are also dissolved and eliminated, so that the number of nuclei of tabular grains is reduced with the result that the size of obtained tabular grains is increased. In order to prevent this, a crystal habit-controlling agent is added. In particular, the simultaneous use of gelatin phthalate enables increasing the effect of the crystal habit-controlling agent and thus enables preventing the dissolution of tabular grains. The pAg during the ripening is especially important, and is preferably in the range of 60 to 130 mV with silver/silver chloride electrodes.

The thus formed nuclei are subjected to physical ripening and are grown in the presence of a crystal habit-controlling agent by adding a silver salt and a halide thereto. In the system, the chloride concentration is 5 mol/L or less, preferably in the range of 0.05 to 1 mol/L. The temperature for grain growth, although can be selected from among 10 to 90° C., is preferably in the range of 30 to 80° C.

The total addition amount of crystal habit-controlling agent is preferably $6\times10^{-5}$ mol or more, more preferably in the range of $3\times10^{-4}$ to $6\times10^{-2}$ mol, per mol of silver halides of completed emulsion. The timing of addition of the crystal habit-controlling agent can be at any stage from the silver halide grain nucleation to physical ripening and during the grain growth. After the addition, the formation of (111) faces is started. Although the crystal habit-controlling agent may be placed in the reaction vessel in advance, in the formation of tabular grains of small size, it is preferred that the crystal habit-controlling agent be placed in the reaction vessel simultaneously with the grain growth so that the concentration thereof is increased.

When the amount of dispersion medium used at nucleation is short in growth, it is needed to compensate for the same by an addition. It is preferred that 10 to 100 g/L of gelatin be present for growth. The compensatory gelatin is preferably gelatin phthalate or gelatin trimellitate.

Now, the high silver chloride (100) tabular grains will be described. The high silver chloride (100) tabular grains are tabular grains having (100) faces as main planes. The shape of these main planes may be those whose apex is truncated or rounded. The grain side face may be (111) plane.

The formation of tabular high silver chloride emulsion grains having (100) main planes is performed by adding an aqueous solution of silver salt and an aqueous solution of halide to a dispersion medium such as an aqueous solution of gelatin under agitation and mixing them together. For example, JP-A's-6-301129, 6-347929, 9-34045 and 9-96881 disclose such a method that, at the formation, making silver iodide or iodide ions, or silver bromide or bromide ions, exist to thereby produce strain in nuclei due to a difference in size of crystal lattice from silver chloride so that a crystal defect imparting anisotropic growability, such as spiral dislocation, is introduced. When the spiral dislocation is introduced, the formation of two-dimensional nuclei at the surface is not rate-determining under low supersaturation conditions with the result that the crystallization at the surface is advanced. Thus, the introduction of spiral dislocation leads to the formation of tabular grains. Herein, the low supersaturation conditions preferably refer to 35% or less, more preferably 2 to 20%, of the critical addition. Although the crystal defect has not been ascertained as being a spiral dislocation, it is contemplated that the possibility of spiral dislocation is high from the viewpoint of the direction of dislocation introduction and the impartation of anisotropic growability to grains. It is disclosed in JP-A's-8-122954 and 9-189977 that, for reducing the thickness of tabular grains, retention of the introduced dislocation is preferred.

Moreover, the method of forming the (100) tabular grains by adding a (100) face formation accelerator is disclosed in JP-A-6-347928, in which use is made of imidazoles and 3,5-diaminotriazoles, and JP-A-8-339044, in which use is made of polyvinyl alcohols.

The silver chloride content of the above high silver chloride grains having (111) or (100) faces as main planes is preferably 90 mol % or more, and it is more preferable that 95 mol % or more thereof consist of silver chloride. The grains of the present invention preferably have a so-termed core/shell structure consisting of a core portion and a shell portion surrounding the core portion. Preferably, 90 mol % or more-of the core portion consists of silver chloride. The core portion may further consist of two or more portions whose halogen compositions are different from each other. The volume of the shell portion is preferably 50% or less, more preferably 20% or less, of the total grain volume. The silver halide composition of the shell portion is preferably silver iodochloride or silver iodobromochloride. The shell portion preferably contains 0.5 to 13 mol %, more preferably 1 to 13 mol %, of iodide. The silver iodide content of a whole grain is preferably 5 mol % or less, more preferably 1 mol % or less. Also, it is preferred that the silver bromide content be higher in the shell portion than in the core portion. The silver bromide content of a whole grain is preferably 20 mol % or less, more preferably 5 mol % or less.

The average grain size (average equivalent sphere diameter) of the high silver chloride grains, although not particularly limited, is preferably in the range of 0.1 to 0.8 μm, more preferably 0.1 to 0.6 μm. The tabular grains have the average equivalent circle diameter of 0.2 to 1.0 μm. The thickness is preferably 0.2 μm or less, more preferably 0.1 μm or less, and most preferably 0.06 μm or less. 50% or more, in terms of a ratio to total projected area of all the grains, are occupied by silver halide grains having the average aspect ratio of 2 or more, preferably ranging from 5 to 20.

The grain size distribution of silver halide grains of the present invention, although may be polydisperse or monodisperse, is preferably monodisperse. In particular, the variation coefficient of equivalent circle diameters of tabular grains occupying 50% or more of the total projected area is preferably 20% or less.

When the crystal habit-controlling agent is present on the grain surface after the grain formation, it exerts influence on the adsorption of sensitizing dye and the development. Therefore, it is preferred to remove the crystal habit-controlling agent after the grain formation. However, when the crystal habit-controlling agent is removed, it is difficult for the (111) tabular grains of high silver chloride content to maintain the (111) faces under ordinary conditions. Therefore, it is preferable to retain the grain configuration by substitution with a photographically useful compound such as a sensitizing dye. This method is described in, for example, JP-A's-9-80656 and 9-106026, and U.S. Pat. Nos. 5,221,602, 5,286,452, 5,298,387, 5,298,388 and 5,176,992.

The crystal habit-controlling agent is desorbed from grains by the above method. The desorbed crystal habit-controlling agent is preferably removed out of the emulsion by washing. The washing can be performed at such temperatures that the gelatin generally used as gelatin is not solidified. For the washing, use can be made of various known techniques such as the flocculation method and the ultrafiltration method. The washing temperature is preferably 40° C. or higher. The desorption of the crystal habit-controlling agent from grains is accelerated at low pH values. Therefore, the pH of the washing step is preferably lowered as far as excess aggregation of grains does not occur.

In the above high silver chloride grains, VIII group metals in the periodic table, that is, ions of metal selected from osmium, iridium, rhodium, platinum, ruthenium, palladium, cobalt, nickel and iron or complex ion thereof may be used alone or in combination. Further, a plurality of these metals may be used.

The above metal ion-providing compound may be added, during silver halide grain formation, into an aqueous gelatin solution serving as a dispersing medium, an aqueous solution of halide, an aqueous solution of silver halide or another aqueous solution.

Alternatively the metal ion-providing compound may be incorporated into the silver halide grains of the invention by means of previously adding the compound to a silver halide emulsion in the form of silver halide fine grains to which the metal ions are incorporated, and the emulsion is caused to dissolve. When the metal ion are incorporated into the grains, it may be done at any time of before grain formation, during grain formation and immediately after grain formation. The addition timing may be varied depending on to which position of the grain the metal ions are added in an amount of how much. The metal ions are localized to a surface layer corresponding to 50% or less in terms of the grain volume from the silver halide grain surface in an amount preferably of 50 mol % or more, more preferably of 80 mol % or more, much more preferably of 100 mol % of the total metal ion-providing compound used. The volume of this surface layer is preferably 30% or less. To localize the metal ions at the surface layer is advantageous for enhancing the internal speed thereby to attain high speed. For incorporating the metal ion-providing compound concentrated at the surface layer of the silver halide grain as mentioned above, the metal ion-providing compound is supplied together with the addition of an aqueous solution of water soluble silver salt and an aqueous solution of halide for the formation of the surface layer after the silver halide grain (core) without the surface layer portion is formed.

In addition to the VIII group metals, various multivalent metal ion impurities may be introduced into the high silver chloride emulsion in the course of the emulsion grain formation or physical ripening. The addition amount of these compounds varies depending on purposes, but preferably $10^{-9}$ to $10^{-2}$ per mol of silver halide.

The general aspects of the emulsions or the present invention will be described below.

The silver halide emulsion may contain a compound capable of undergoing a one-electron oxidation to thereby form a one-electron oxidation product thereof, wherein the one-electron oxidation product is capable of releasing one or more electrons.

The compound whose one-electron oxidation product is capable of releasing one or more electrons includes compounds selected from the following type 1 and type 2.

Type 1

A compound capable of undergoing a one-electron oxidation to thereby form a one-electron oxidation product thereof, wherein the one-electron oxidation product is capable of releasing further one or more electrons accompanying a subsequent bond cleavage reaction; and Type 2

A compound capable of undergoing a one-electron oxidation to thereby form a one-electron oxidation product thereof, wherein the one-electron oxidation product is capable of releasing further one electron accompanying a subsequent bond cleavage reaction.

First, the compound of type 1 will be described.

Among the compounds of type 1, examples of the compounds capable of undergoing a one-electron oxidation to thereby form a one-electron oxidation product thereof, wherein the one-electron oxidation product is capable of releasing further one electron accompanying a subsequent bond cleavage reaction are compounds described as "one photon two electrons sensitizers" or "deprotonating electron-donating sensitizers" in the patent publications and specifications of, for example, JP-A-9-211769 (compounds PMT-1 to S-37 listed in Tables E and F on pages 28 to 32), JP-A-9-211774, JP-A-11-95355 (compounds INV 1 to 36), Japanese Patent Application KOHYO Publication 2001-500996 (compounds 1 to 74, 80 to 87 and 92 to 122), U.S. Pat. Nos. 5,747,235 and 5,747,236, EP 786692A1 (compounds INV 1 to 35), EP 893732A1 and U.S. Pat. Nos. 6,054,260 and 5,994,051, the entire contents of which are incorporated herein by reference. Preferable scopes of these compounds are the same as the preferable scopes described in the referred patent specifications.

Further, as the compound capable of undergoing a one-electron oxidation to thereby form a one-electron oxidation product thereof, wherein the one-electron oxidation product is capable of releasing further one or more electrons accompanying a subsequent bond cleavage reaction includes compounds represented by the general formula (1) (having the same meaning as the general formula (1) described in JP-A-2003-114487), the general formula (2) (having the same meaning as the general formula (2) described in JP-A-2003-114487), the general formula (3) (having the same meaning as the general formula (1) described in JP-A-2003-114488), the general formula (4) (having the same meaning as the general formula (2) described in JP-A-2003-114488) the general formula (5) (having the same meaning as the general formula (3) described in JP-A-2003-114488), the general formula (6) (having the same meaning as the general formula (1) described in JP-A-2003-75950), the general formula (7) (having the same meaning as the general formula (2) described in JP-A-2003-75950), the general formula (8) (having the same meaning as the general formula (1) described in Japanese Patent Application No. 2003-25886), and compounds represented by the general formula (9) (having the same meaning as the general formula (3) described in Japanese Patent Application No. 2003-33446) included among the compounds capable of undergoing the chemical reaction of the formula (1) (having the same meaning as the chemical reaction formula (1) described in Japanese Patent Application No. 2003-33446, the entire contents of which are incorporated herein by reference. Preferable scopes of these compounds are the same as the preferable scopes described in the referred patent specifications.

General formula (1)

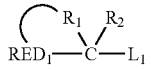

General formula (2)

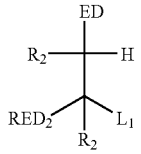

General formula (3)

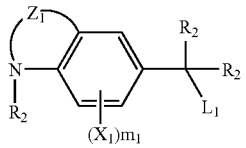

General formula (4)

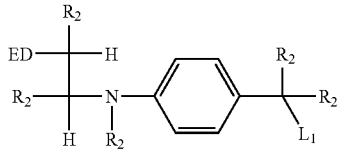

General formula (5)

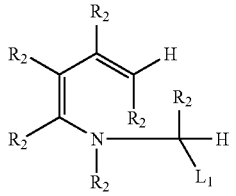

General formula (6)

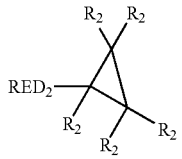

General formula (7)

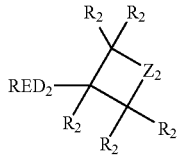

General formula (8)

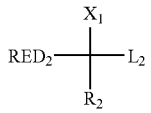

Chemical reaction (1)

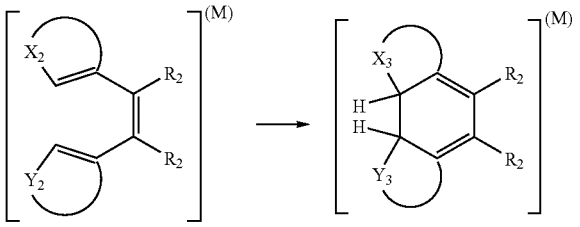

-continued

General formula (9)

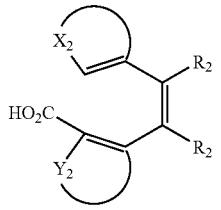

In the formulae, $RED_1$ and $RED_2$ represents a reducing group. $R_1$ represents a nonmetallic atomic group capable of forming, together with carbon atom (C) and $RED_1$, a cyclic structure corresponding to a tetrahydro form, or octahydro form of a 5-membered or 6-membered aromatic ring (including an aromatic heterocycle). $R_2$ represents a hydrogen atom or substituent. When a plurality of R2's exist in one molecular, these may be the same or different to each other. $L_1$ represents a split-off group. ED represents an electron-donating group. $Z_1$ represents an atomic group capable of forming a 6-membered ring together with the nitrogen atom and the two carbon atoms of the benzene ring. $X_1$ represents a substituent (e.g., alkoxy, aryloxy, heterocyclic oxy, alkylthio, arylthio, heterocyclic thio, alkylamino, arylamino, or heterocyclicamino). $m_1$ represents an integer of 0 to 3. $Z_2$ represents —$CR_{11}R_{12}$—, —$NR_{13}$— or —O—. Each of $R_{11}$ and $R_{12}$ represents a hydrogen atom or substituent. $R_{13}$ represents a hydrogen atom, alkyl group, aryl group or heterocyclic group. $L_2$ represents a carboxylic group, a salt thereof or hydrogen atom. $Y_2$ represents a group capable of forming together with C═C a 5-membered or 6-membered aryl group or heterocyclic group. $X_3$ and $Y_3$ each represent a group capable of forming together with C—C a 5-membered or 6-membered cyclic aliphatic hydrocarbon group or heterocyclic group. M represents a radical, radical cation or cation.

Now the compound of type 2 will be described.

Among the compounds of type 2, examples of the compounds capable of undergoing a one-electron oxidation to thereby form a one-electron oxidation product thereof, wherein the one-electron oxidation product is capable of releasing further one or more electron accompanying a subsequent bond cleavage reaction are compounds represented by the general formula (19) (having the same meaning as the general formula (1) of JP-A-2003-140287), compounds represented by the general formula (11) (having the same meaning as the general formula (2) described in Japanese Patent Application No. 2003-33446) included among the compounds capable of undergoing the chemical reaction of the formula (1) (having the same meaning as the chemical reaction formula (1) described in Japanese Patent Application No. 2003-33446), the entire contents of which are incorporated herein by reference. Preferable scopes of these compounds are the same as the preferable scopes described in the referred patent specifications.

General formula (10)

-continued

Chemical reaction (1)

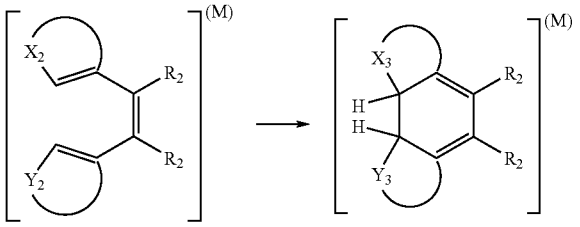

General formula (11)

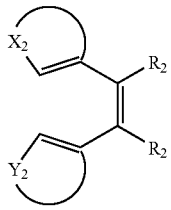

In the formulae, X represent a reducing group capable of undergoing one-electron oxidation. Y represent a reactive group having a carbon-carbon double bond moiety, carbon-carbon triple bond moiety, aromatic moiety or benzo-condensed nonaromatic heterocyclic group, and capable of reacting with a one-electron oxidation product formed as a result of a one-electron oxidation of X to thereby form a new bond. L2 represents a linking group which links between X and Y. $R_2$ represents a hydrogen atom or substituent. When there are a plurality of R2's in one molecular these may be the same or different to each other. $X_2$ represents a group capable of forming a 5-membered heterocycle together with C═C. $Y_2$ represents a group capable of forming a 5-membered or 6-membered aryl group or heterocyclic group together with C═C. $X_3$ and $Y_3$ each represent a group capable of forming together with C—C a 5-membered or 6-membered cyclic aliphatic hydrocarbon group or heterocyclic group. M represents a radical, radical cation or cation.

Among the compounds of types 1 and 2, "a compound having a adsorptive group to silver halide in a molecular" or "a compound having a partial structure of a spectrally sensitizing dye in a molecular" is preferable. Representative ones of the adsorptive group to silver halide are the groups described in the specification on page 16, right column, line 1 to page 17, right column line 12 of JP-A-2003-156823. The partial structure of the spectrally sensitizing dye is the structure described on page 17, right column, line 34 to page 18, left column, line 6 of the same specification.

As the compounds of types 1 and 2 "a compound having at least one adsorptive group to silver halide in a molecular" is preferable. "A compound having at least two adsorptive groups to silver halide in a molecular" is more preferable. When there are two or more adsorptive groups in a single molecular these adsorptive groups may be the same or different to each other.

As the adsorptive groups preferred ones are nitrogen-containing heterocyclic groups substituted with mercapto (e.g., a 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazolium-3-thiolate group), or a nitrogen-containing heterocyclic group having an —NH— group capable of forming an iminosilver (>NAg) as a partial structure of the heterocycle (e.g., a benzotriazole group, benzimidazole group or indazole group). More preferably, the adsorptive group is a 5-mercaptotetrazole group, 3-mercapto-1,2,4-triazole group or benzotriazole group. Most preferably, the adsorptive group is a 3-mercapto-1,2,4-triazole group or 5-mercaptotetrazole group.

Among the compounds of the present invention, those having, in its molecule, two or more mercapto groups as partial structures are also especially preferred. Herein, the mercapto group (—SH) may become a thione group when it can be tautomerized. Preferable examples of such compounds possessing in its molecule two or more adsorptive groups as a partial structure (e.g., dimercapto substituted nitrogen-containing heterocyclic group) are 2,4-dimercaptopyrizine group, 2,4-dimercaptotriazine group, and 3,5-dimercapto-1,2,4-triazole group.

A quaternary salt structure of nitrogen or phosphor may be preferably used as the adsorptive group. The quaternary salt structure of nitrogen specifically is an ammonio group (e.g., trialkylammonio group, dialkylaryl(or heteroaryl)ammonio group, alkyldiaryl(or heteroaryl) ammonio group) or a group containing a nitrogen-containing group including a quaternary nitrogen atom. The quaternary salt structure of phosphor specifically is a phosphonio group (e.g., trialkylphosphonio, dialkylaryl(or heteroaryl) phosphonio, alkyldiaryl(or heteroaryl) phosphonio group, or triaryl(or heteroaryl) phosphonio). A quaternary salt structure of nitrogen is more preferably used as the adsorptive group, a 5-membered or 6-membered nitrogen-containing aromatic heterocyclic group including a quaternary nitrogen atom is much more preferably used. A pyridinio, quinolinio or isoquinolinio is especially preferably used. These nitrogen-containing heterocyclic group including a quaternary nitrogen atom may have a substituent.

As an example of a counter anion of the quaternary salt, halide ion, carboxylate ion, sulfonate ion, sulfate ion, perchlorite ion, carbonate ion, nitrate ion, $BF_4^-$, $PF_6^-$ or $Ph_4B$ may be mentioned. When a group having a negative charge is present in carboxylate an etc., in a molecular, a intra molecular salt may be formed together with it. As a counter anion that is not present in a molecular, chloride ion, bromide ion, or methansulfonate ion is especially preferable.

Preferable examples of the compound represented by types 1 and 2 having a quaternary salt structure of phosphor or nitrogen as an adsorptive group are represented by general formula (X)

$$(P\text{-}Q_1\text{-})_i\text{—}R(\text{-}Q_2\text{—}S)_j \qquad \text{General formula (X)}$$

In general formula (X), P and R each independently represent a quaternary salt structure of nitrogen or phosphor that is not a partial structure of a sensitizing dye. $Q_1$ and $Q_2$ each independently represent a linking group, specifically a simple bond, alkylene, arylene, heterocyclic group, —O—, —S—, —$NR_N$—, —C(═O)—, —$SO_2$—, —SO— or —P(═O)— alone or combination of these groups. Herein, $R_N$ represents a hydrogen atom, alkyl group, aryl group or heterocyclic group. S represents a residue of the compound represented by type 1 or 2 from which an atom is removed. Each of i and j is an integer of 1 or more, and selected from the scope in which i+j is 2 to 6. Preferably, i is 1 to 3, and j is 1 to 2. More preferably, i is 1 or 2 and j is 1. Especially preferably, i is 1 and j is 1. The compounds represented by the general formula (X) are those having the total carbon atoms within the scope of preferably 10 to 100, more preferably 10 to 70, much more preferably 11 to 60 and especially preferably 12 to 50.

The compound of type 1 and type 2 may be used at any time during emulsion preparation or in photosensitive material manufacturing step, for example, during grain formation, at desalting step, at the time of chemical sensitization, or before coating. The compound may be added separately in a plurality of times during the steps. Preferable addition timing is from the completion of grain formation to before a desalting step, at the time of chemical sensitization (immediately before the initiation of chemical sensitization to immediately after the completion thereof), or before coating. More preferable addition timing is at chemical sensitization or before coating.

The compound of type 1 and type 2 may preferable be added by dissolving it to a water or water-soluble solvent such as methanol, ethanol or a mixture of solvents. When the compound is added to water, if the solubility of the compound increases in a case where pH is raised or lowered, the compound may be added to the solvent by raising or lowering the pH thereof.

It is preferable that the compound of type 1 and types 2 is used in an emulsion layer, but the compound may be added in a protective layer or interlayer together with the emulsion layer, thereby making the compound diffuse during coating. The addition time of the compound of the invention is irrespective of before or after the addition time of a sensitizing dye. Each of the compounds is preferably contained in a silver halide emulsion layer in an amount of $1\times10^{-9}$ to $5\times10^{-2}$ mol, more preferably $1\times10^{-8}$ to $2\times10^{-3}$ mol pre mol of silver halide.

As a protective colloid and as a binder of other hydrophilic colloid layers that are used when the emulsion of the present invention is prepared, gelatin is used advantageously, but another hydrophilic colloid can also be used.

Use can be made of, for example, a gelatin derivative, a graft polymer of gelatin with another polymer, a protein, such as albumin and casein; a cellulose derivative, such as hydroxyethylcellulose, carboxymethylcellulose, and cellulose sulfate ester; sodium alginate, a saccharide derivative, such as a starch derivative; and many synthetic hydrophilic polymers, including homopolymers and copolymers, such as a polyvinyl alcohol, a polyvinyl alcohol partial acetal, a poly-N-vinylpyrrolidone, a polyacrylic acid, a polymethacrylic acid, a polyacrylamide, a polyvinylimidazole and a polyvinylpyrazole.

As an example of gelatin lime-processed gelatin, acid-processed gelatin or enzyme-processed gelatin such as hose described in Bull. Soc. Sci. Photo, Japan, No. 16, p.30 (1966) may be used. Gelatin hydrolysis product or enzymatically decomposed product may also be used. Preferably, succinated gelatin or trimellitated gelatin in which 95% or more amino groups are modified, or oxidation-processed gelatin. Low molecular weight gelatin or low molecular weight oxidation-processed gelatin may also be used.

Further, gelatin containing 30 or more, preferably 35 or more of components having a molecular weight of 280,000 may be used. Lime-processed gelatin consists, on the basis of it molecular weight, of sub-α (low molecular weight), α (molecular weight about 100,000), β (molecular weight about 200,000), γ (molecular weight about 300,000) and large macromolecular fraction (void: molecular weight larger than 300,000). The ratio of each component or molecular weight distribution is determined by the Puggy's method as internationally defined. More detailed description and preparation method are disclosed in JP-A-11-237704.

The emulsion of the present invention is preferably washed with water for desalting, and dispersed in to newly prepared protective colloid. The protective colloid used in this case may be hydrophilic colloid and gelatin mentioned above. It is preferable to use gelatin whose molecular weight distribution including 30% or more, preferably 35% or more of the components having molecular weight of 280,000 or more. The temperature at which the washing with water is carried out can be selected in accordance with the purpose, and preferably the temperature is selected in the range of 5° C. to 50° C. The pH at which the washing with water is carried out can be selected in accordance with the purpose, and preferably the pH is selected in the range of 2 to 10, and more preferably in the range of 3 to 8. The pAg at which the washing with water is carried out can be selected in accordance with the purpose, and preferably the pAg is selected in the range of 5 to 10. As a method of washing with water, it is possible to select from the noodle washing method, the dialysis method using a diaphragm, the centrifugation method, the coagulation sedimentation method, and the ion exchange method. In the case of the coagulation sedimentation method, selection can be made from, for example, the method wherein sulfuric acid salt is used, the method wherein an organic solvent is used, the method wherein a water-soluble polymer is used, and the method wherein a gelatin derivative is used.

Reduction sensitization preferable performed in the present invention can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to combine two or more of these methods. Among these, the method of adding reduction sensitizers is preferred in that the level of reduction sensitization can be finely adjusted.

As examples of the reduction sensitizer stannous chloride, ascorbic acid and its derivatives, hydroquinone and its derivatives, catechol and is derivatives, hydroxylamine and its derivatives, amines and polyamines, hydrazine and its derivatives, para-phenylenediamin and its derivatives, formamidinesulfinic acid(thiourea dioxide), a silane compound, and a borane compound, can be mentioned. In reduction sensitization of the present invention, it is possible to selectively use these reduction sensitizers or to use two or more types of compounds together. Regarding the methods for performing the reduction sensitization, those disclosed in U.S. Pat. Nos. 2,518,698, 3,201,254, 3,411,917, 3,779,777, 3,930,867, may be used. Regarding the methods for using the reduction sensitizer, those disclosed in JP-B's-57-33572 and 58-1410, JP-A-57-179835, may be used. Preferable compounds as the reduction sensitizer are catechol and its derivatives, hydroxylamine and its derivatives, and formamidinesulfinic acid(thiourea dioxide). Although the addition amount of reduction sensitizers must be so selected as to meet the emulsion manufacturing conditions, a proper amount is $10^{-7}$ to $10^{-1}$ mol per mol of a silver halide.

The reduction sensitizer is added during grain formation by dissolving thereof to water, or organic solvents such as alcohols, glycols, ketones, esters, and amides.

Examples of the silver halide solvents which can be employed in the present invention include (a) organic thioethers described in U.S. Pat. Nos. 3,271,157, 3,531,289, and 3,574,628, JP-A's-54-1019 and 54-158917, (b) thiourea derivatives described in, for example, JP-A's-53-82408, 55-77737 and 55-2982, (c) silver halide solvents having a thiocarbonyl group interposed between an oxygen or sulfur atom and a nitrogen atom, described in JP-A-53-144319, (d) imidazoles described in JP-A-54-100717, (e) ammonia and (f) thiocyanates.

Thiocyanates, ammonia and tetramethylthiourea can be mentioned as especially preferred silver halide solvents. The amount of added solvent, although varied depending on the type thereof, is, if thiocyanate is use, preferably in the range of $1\times10^{-4}$ to $1\times10^{-2}$ mol per mol of silver halide.

In the preparation of the emulsion of the present invention, it is preferable to make salt of metal ion exist, for example, during grain formation, desalting, or chemical sensitization, or before coating in accordance with the intended use. The metal ion salt is preferably added during grain formation when doped into grains, and after grain formation and before completion of chemical sensitization when used to decorate the grain surface or used as a chemical sensitizer. The salt can be doped in any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide, hexa-coordinated complex salt, or tetra-coordinated complex salt. Examples are $CdBr_2$, $CdCl_2$, $Cd(NO_3)_2$, $Pb(NO_3)_2$, $Pb(CH_3COO)_2$, $K_4[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in an appropriate solvent, such as water, methanol or acetone, and added in the form of a solution. To stabilize the solution, an aqueous hydrogen halogenide solution (e.g., HCl or HBr) or an alkali halide (e.g., KCl, NaCl, KBr, or NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, or KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se and Te, cyanate, thiocyanate, selenocyanate, carbonate, phosphate, or acetate may be present.

The silver halide grains which can be used for the photosensitive material of the present invention can be subjected to at least one of chalcogen sensitization such as sulfur sensitization, selenium sensitization and tellurium sensitization, noble metal sensitization such as gold sensitization and palladium sensitization, and reduction sensitization, in a desired step in the process for preparation of the silver halide emulsion. Two or more kinds of sensitization are preferably used in combination. Various types of emulsion can be prepared according to in which step chemical sensitization is performed. The types include a type in which a chemical sensitizing core is embedded in each grain, a type in which a chemical sensitizing core is embedded in a position close to a surface of each grain, and a type in which a chemical sensitizing core is formed on a surface of each grain. The location of a chemical sensitizing core of the emulsion which can be used for the photosensitive material of the present invention can be selected according to the object. Generally, preferable is the case where at least one kind of chemical sensitizing core is formed in the vicinity of a surface of each grain.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

As a sulfur sensitizer, hypo, thiurea compounds, rhodanine compounds and sulfur-containing compound as described in U.S. Pat. Nos. 3,857,711, 4,266,018 and 4,054,457. Chemical sensitization may be performed in the presence of so to call a chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

Gold sensitization is used in combination for the emulsion of the present invention. Preferable amount of gold sensitizer is $1\times10^{-4}$ to $1\times10^{-7}$ mol, more preferably $1\times10^{-5}$ to $5\times10^{-7}$ mol per mol of silver halide.

Selenium sensitizing is a preferable sensitizing method for the emulsion of the present invention. In the selenium sensitization, known labile selenium sensitizers may be used. Specifically, selenium compounds such as colloidal metal selenium, selenoureas (e.g., N,N-dimethylselenourea, N,N-diethylselsnourea), selenoketones, and selenamides. Selenium sensitization is sometimes preferable to be used in combination with sulfur sensitization or noble metal sensitization or both of sulfur and noble metal sensitization.

An oxidizer capable of oxidizing silver is preferably used during the process of producing the emulsion for use in the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2].6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen releasing compounds (e.g., N-bromosuccinimide, chloramine T and chloramine B).

Oxidizers preferred in the present invention are inorganic oxidizers selected from among ozone, hydrogen peroxide and adducts threreof, halogen elements and thiosulfonates and organic oxidizers selected from among quinones. The embodiment wherein the above-mentioned reduction sensitizer and the oxidizer to silver are used in combination is preferable. A method of performing reduction sensitization after the oxidizer is used, or the reversed method thereof, or a method of making both sensitizer and oxidizer co-exist can be used by selection. These method can be performed in a grain formation step or chemical sensitization step by selection.

Photographic emulsions used in the present invention can contain various compounds in order to prevent fog during the preparing process, storage, or photographic processing of a sensitized material, or to stabilize photographic properties. That is, it is possible to add many compounds known as antifoggants or stabilizers, e.g., thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxazolinethione; and azaindenes such as triazaindenes, tetrazaindenes (particularly 4-hydroxy-substituted(1,3,3a,7)tetrazaindenes), and pentazaindenes. For example, compounds described in U.S. Pat. Nos. 3,954,474 and 3,982,947 and JP-B-52-28660 can be used. One preferred compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes. The above antifoggants and etc., are preferable as the silver halide adsorptive compounds.

It is also preferable to perform sensitization by using organic electron-donating compounds comprising an electron-donating group and a leaving group such as described in U.S. Pat. Nos. 5,747,235 and 5,747,236, EP's 786692A1, 893731A1, and 893732A1 and WO 99/05570, the entire contents of which are incorporated herein by reference.

One or more light-sensitive layers may be provided on a support in the present invention. The light-sensitive layer is not limited to one side of the support, but may be provided on both sides of the support. The photosensitive-layer of the invention may be used in black-and-white silver halide photosensitive materials (e.g., X-ray photosensitive material, lith-type photosensitive material, and black-and-white negative film for photographing), and color photosensitive materials (e.g., color negative film, color reversal film, and color paper). Further, the light-sensitive layer may also be used in diffusion transfer photosensitive materials (e.g., color diffusion transfer element, silver salt diffusion transfer element), heat-development photosensitive materials (including black-and-white and color).

Color photosensitive materials will be described in detail below, but the present invention is not limited to these.

The silver halide photographic material is only required to be provided with at least one of a blue-sensitive layer, a green-sensitive layer and a red-sensitive layer, on a support. The number of layers and order thereof of the material is not particularly limited. As an typical example, a silver halide photositive material provided with at least one unit of silver halide emulsion layers each having the same color-sensitivity but different in light-sensitivity, on a support, can be mentioned. The silver halide emulsion layers are a unit light-sensitive layer sensitive to one of blue light, green light and red light. In a multi-layered silver halide color photographic material, the unit light-sensitive layers are usually arranged in an order of a red-sensitive layer, a green-sensitive-layer, and a blue-sensitive layer on a support in this order from the one closest to the support. However, the arrangement order may be reversed depending on the purpose of the photographic material. Further, the arrangement order in which a different light-sensitive layer is sandwiched between the same color sensitive layers may be acceptable.

A non light-sensitive layer, such as a inter layer for each layer, can be formed between the silver halide light-sensitive layers and as the uppermost layer and the lowermost layer.

These intermediate layers may contain couplers and DIR compounds described in JP-A's-61-43748, 59-113438, 59-113440, 61-20037 and 61-20038, the entire contents of which are incorporated herein by reference, and may contain color-mixing inhibitor as usually may be.

As for a plurality of silver halide emulsion layers constituting respective unit light-sensitive layer, a two-layered structure of high- and low-speed emulsion layers can be preferably used as described in DE (German Patent) 1,121,470 or GB 923,045, the entire contents of which are incorporated herein by reference. Usually, preferable arrangement of high- and low-speed emulsion layers is in this order so as to the speed becomes lower toward the support, and a non light-sensitive layer may be arranged between each silver halide emulsion layers. Also, as described in JP-A's-57-112751, 62-200350, 62-206541 and 62-206543, the entire contents of which are incorporated herein by reference, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, the entire contents of which are incorporated herein by reference, layers can be arranged from the farthest side from a support in the order of blue-sensitive layer/GH/RH/GL/RL. Furthermore, as described in JP-A's-56-25738 and 62-63936, the entire contents of which are incorporated herein by reference, layers can be arranged from the farthest side from a support in the order of blue-sensitive layer/GL/RL/GH/RH.

As described in JP-B-49-15495, the entire contents of which are incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464, the entire contents of which is incorporated herein by reference.

In addition, the order of high-speed emulsion layer/low-speed emulsion layer/medium-speed emulsion layer or low-speed emulsion layer/medium-speed emulsion layer/high-speed emulsion layer can be adopted.

Furthermore, the arrangement can be changed as described above even when four or more layers are formed.

Various layer configurations and arrangements can be selected depending on the purpose of each photosensitive material, as mentioned above.

The above various additives can be used in the photosensitive material according to the present technology, to which other various additives can also be added in conformity with the object.

These additives are described in detail in Research Disclosure Item 17643 (December 1978), Item 18716 (November 1979) and Item 308119 (December 1989), the entire contents of which are incorporated herein by reference. A summary of the locations where they are described will be listed in the following table.

| | Types of additives | RD17643 | RD18716 | RD308119 |
|---|---|---|---|---|
| 1 | Chemical-sensitizers | page 23 | page 648 right column | page 996 |
| 2 | Sensitivity increasing agents | | page 648 right column | |

-continued

| | Types of additives | RD17643 | RD18716 | RD308119 |
|---|---|---|---|---|
| 3 | Spectral sensitizers, super-sensitizers | pages 23–24 | page 648, right column to page 649, right column | page 996, right column to page 998, right column |
| 4 | Brighteners | page 24 | | page 998 right column |
| 5 | Antifoggants, and stabilizers | pages 24–25 | page 649 right column | page 998, right column to page 1000, right column |
| 6 | Light absorbents, filter dyes, ultraviolet absorbents | pages 25–26 | page 649, right column to page 650, left column | page 1003, left column to page 1003, right column |
| 7 | Stain preventing agents | page 25, right column | page 650, left to right columns | page 1002, right column |
| 8 | Dye image stabilizers | page 25 | | page 1002, right column |
| 9 | Film hardeners | page 26 | page 651, left column | page 1004, right column to page 1005, left column |
| 10 | Binders | page 26 | page 651, left column | page 1003, right column to page 1004, right column |
| 11 | Plasticizers, lubricants | page 27 | page 650, right column | page 1006, left to right columns |
| 12 | Coating aids, surfactants | pages 26–27 | page 650, right column | page 1005, left column to page 1006, left column |
| 13 | Antistatic agents | page 27 | page 650, right column | page 1006, right column to page 1007, left column |
| 14 | Matting agents | | | page 1008, left column to page 1009, left column |

In order to inhibit deterioration in photographic properties due to formaldehyde gas, a compound capable of reacting with and solidifying formaldehyde as disclosed in U.S. Pat. Nos. 4,411,987 and 4,435,503 can be incorporated in the photosensitive material.

Various color couples may be used in the present invention, and the specific examples thereof are described in the patents described in the patents described in the aforementioned Research Disclosure No. 17643, VII-C to G and No. 307105, VII-C to G.

Preferred yellow couplers are those described in, for example, U.S. Pat. Nos. 3,933,051, 4,022,620, 4,326,024, 4,401,752 and 4,248,961, JP-B-58-10739, British Patent Nos. 1,425,020 and 1,476,760, U.S. Pat. Nos. 3,973,968, 4,314,023 and 4,511,649, and European Patent No. 249, 473A.

Particularly preferred magenta couplers are 5-pyrazolone and pyrazoloazole compounds. Particularly preferred are those described in U.S. Pat. Nos. 4,310,619 and 4,351,897, European Patent No. 73,636, U.S. Pat. Nos. 3,061,432 and 3,725,067, Research Disclosure No. 24220 (June, 1984), JP-A-60-33552, Research Disclosure No. 24230 (June, 1984), JP-A's-60-43659, 61-72238, 60-35730, 55-118034 and 60-185951, U.S. Pat. Nos. 4,500,630, 4,540,654 and 4,556,630, and International Publication No. WO 88/04795.

The cyan couplers usable in the present invention are phenolic and naphtholic couplers. Particularly preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Unexamined Published Application No. 3,329,729, European Patent Nos. 121,365A and 249, 453A, U.S. Pat. Nos. 3,446,622, 4,333,999, 4,775,616, 4,451,559, 4,427,767, 4,690,889, 4,254,212 and 4,296,199, and JP-A-61-42658.

Typical examples of the polymerized color-forming couplers are described in, for example, U.S. Pat. Nos. 3,451, 820, 4,080,211, 4,367,282, 4,409,320 and 4,576,910, British Patent No. 2,102,137 and European Patent No. 341,188A.

The couplers capable of forming a colored dye having a suitable diffusibility are preferably those described in U.S. Pat. No. 4,366,237, British Patent No. 2,125,570, European Patent No. 96,570 and West German Patent (Publication) No. 3,234,533.

Colored couplers used for compensation for unnecessary absorption of the colored dye are preferably those described in Research Disclosure No. 17643, VII-G and No. 307105, VII-G, U.S. Pat. No. 4,163,670, JP-B-57-39413, U.S. Pat. Nos. 4,004,929 and 4,138,258 and British Patent No. 1,146, 368. Other couplers preferably used herein include couplers capable of compensating for an unnecessary absorption of the colored dye with a fluorescent dye released during the coupling as described in U.S. Pat. No. 4,774,181 and couplers having, as a removable group, a dye precursor group capable of forming a dye by reacting with a developing agent as described in U.S. Pat. No. 4,777,120.

Further, compounds that release a photographically useful residue during a coupling reaction are also preferably usable in the present invention. DIR couplers which release a development inhibitor are preferably those described in the patents shown in the above described RD 17643, VII-F and No. 307105, VII-F as well as those descried in JP-A's-57-151944, 57-154234, 60-184248, 63-37346 and 63-37350 and U.S. Pat. Nos. 4,248,962 and 4,782,012.

The couplers which release a nucleating agent or a development accelerator in the image-form in the development step are preferably those described in British Patent Nos. 2,097,140 and 2,131,188 and JP-A's-59-157638 and 59-170840. Further, compounds capable of releasing a fogging agent, development accelerator, solvent for silver halides, etc. upon the oxidation-reduction reaction with an oxidate of a developing agent as described in JP-A's-60-107029, 60-252340, 1-44940 and 1-45687 are also preferred.

Other compounds usable for the photosensitive material according to the present invention include competing couplers described in U.S. Pat. No. 4,130,427, polyequivalent couplers described in U.S. Pat. Nos. 4,283,472, 4,338,393 and 4,310,618, DIR redox compound-releasing couplers, DIR coupler-releasing couplers, DIR coupler-releasing redox compounds and DIR redox-releasing redox compounds described in JP-A's-60-185950 and 62-24252, couplers which release a dye that restores the color after coupling-off as described in European Patent Nos. 173,302 A and 313,308 A, ligand-releasing couplers described in U.S. Pat. No. 4,555,477, leuco dye-releasing couplers described in JP-A-63-75747 and fluorescent dye-releasing couplers described in U.S. Pat. No. 4,774,181.

The couplers used in the present invention can be incorporated into the photosensitive material by various known dispersion methods.

High-boiling solvents used for an oil-in-water dispersion method are described in, for example, U.S. Pat. No. 2,322,027.

The high-boiling organic solvents having a boiling point under atmospheric pressure of at least 175° C. and usable in the oil-in-water dispersion method include, for example, phthalates (such as dibutyl phthalate, dicyclohexyl phthalate, di-2-ethylhexyl phthalate, decylphthalate, bis(2,4-di-t-amylphenyl) phthalate, bis(2,4-di-t-amylphenyl) isophthalate and-bis(1,1-diethylpropyl)phthalate), phosphates and phosphonates (such as triphenyl phosphate, tricresyl phosphate, 2-ethylhexyldihenyl phosphate, tricyclohexyl phosphate, tri-2-ethylhexyl phosphate, tridodecyl phoshate, tributoxyethyl phosphate, trichloropropyl phosphate and di-2-ethylhexylphenyl phosphate), benzoates (such as 2-ethylhexyl benzoate, dodecyl benzoate and 2-ethylhexyl-p-hydroxybenzoate), amides (such as N,N-di ethyldodecaneamide, N,N-diethyllaurylamide and N-tetradecylpyrrolidone), alcohols and phenols (such as isostearyl alcohol and 2,4-di-tert-amylphenol), aliphatic carboxylates (such as bis(2-ethylhexyl) sebacate, dioctyl azelate, glycerol tributyrate, isostearyl lactate and trioctyl citrate), aniline derivatives [such as N,N-dibutyl-2-butoxy-5-tert-octylaniline] and hydrocarbons (such as paraffin, dodecylbenzene and diisopropylnaphthalene). Co-solvents usable in the present invention include, for example, organic solvents having a boiling point of at least about 30° C., preferably 50 to about 160° C. Typical examples of them include ethyl acetate, butyl acetate, ethyl propionate, methyl ethyl ketone, cyclohexanone, 2-ethoxyethyl acetate and dimethylformamide.

The steps and effects of the latex dispersion method and examples of the latices usable for the impregnation are described in, for example, U.S. Pat. No. 4,199,363 and West German Patent Application (OLS) Nos. 2,541,274 and 2,541,230.

The color photosensitive material used in the present invention preferably contains phenethyl alcohol or an antiseptic or mold-proofing agent described in JP-A's-63-257747, 62-272248 and 1-80941 such as 1,2-benzoisothiazolin-3-one, n-butyl p-hydroxybenzoate, phenol, 4-chloro-3,5-dimethylphenol, 2-phenoxyethanol or 2-(4-thiazolyl) benzimidazole.

The present invention is applicable to various color photosensitive materials such as ordinary color negative films, cinema color negative films, reversal color films for slides or televisions, color papers, positive color films and reversal color papers. The present invention may be particularly preferably used as color dupe films.

Suitable supports usable in the present invention are described, for example, on page 28 of the above-described RD. No. 17643, from right column, page 647 to left column, page 648 of RD. No. 18716 and on page 879 of RD. No. 307105.

The photosensitive material of the present invention has a total thickness of the hydrophilic colloidal layers on the emulsion layer-side of 28 μm or below, preferably 23 μm or below, more preferably 18 μm or below and particularly 16 μm or below. The film-swelling rate $T_{1/2}$ is preferably 30 sec or below, more preferably 20 sec or below. The thickness is determined at 25° C. and at a relative humidity of 55% (2 days). The film-swelling rate $T_{1/2}$ can be determined by a method known in this technical field. For example, it can be determined with a swellometer described on pages 124 to 129 of A. Green et al., "Photogr. Sci. Eng.", Vol. 19, No. 2. $T_{1/2}$ is defined to be the time required for attaining the thickness of a half (½) of the saturated film thickness (the saturated film thickness being 90% of the maximum thickness of the film swollen with the color developer at 30° C. for 3 minute 15 seconds).

The film-swelling rate $T_{1/2}$ can be controlled by adding a hardener to gelatin used as the binder or by varying the time conditions after the coating.

The photosensitive material used in the present invention preferably has a hydrophilic colloid layer (in other words, back layer) having total thickness of 2 to 20 μm on dry basis on the opposite side to the emulsion layer. The back layer preferably contains the above-described light absorber, filter dye, ultraviolet absorber, antistatic agent, hardener, binder, plasticizer, lubricant, coating aid, surfactant, etc. The swelling rate of the back layer is preferably 150 to 500%.

The color photosensitive material according to the present invention may be developed by a conventional method described in aforementioned RD. No. 17643, pages 28 to 29, ditto No. 18716, page 651, left to right columns, and ditto No. 30705, pages 880 to 881.

The color developer to be used in the development of the photosensitive material of the present invention is preferably an alkaline aqueous solution containing as a main component an aromatic primary amine color developing agent. As such a color developing agent there can be effectively used an aminophenolic compound. In particular, p-phenylenediamine compounds are preferably used. Typical examples of such p-phenylenediamine compounds include 3-methyl-4-amino-N,N-diethylaniline, 3-methyl-4-amino-N-ethyl-N-β-hydroxy-ethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluenesulfonates thereof. Particularly preferred among these compounds are 3-methyl-4-amino-N-ethyl-N-β-hydroxyethylaniline sulfate. These compounds can be used in combination of two or more thereof depending on the purpose of application.

The color developer normally contains a pH buffer such as carbonate, borate and phosphate of an alkali metal or a development inhibitor or fog inhibitor such as chlorides, bromides, iodides, benzimidazoles, benzothiazoles and mercapto compounds. If desired, the color developer may further contain various preservatives such as hydroxylamine, diethylhydroxylamine, sulfites, hydrazines (e.g., N,N-biscarboxymethylhydrazine), phenylsemicarbazides, tri-ethanolamine and catecholsulfonic acids, organic solvents such as ethylene glycol and diethylene glycol, development accelerators such as benzyl alcohol, polyethylene glycol, quaternary ammonium salts, and amines, color-forming couplers, competing couplers, auxiliary developing agents such as 1-phenyl-3-pyrazolidone, viscosity-imparting agents, various chelating agents exemplified by aminopolycarboxylic acids, aminopolyphosphonic acids, alkylphosphonic acids, and phosphonocarboxylic acids (e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid), and salts thereof).

Further, when reversal processing is to be performed on the photographic material, color development is usually performed after black-and-white development. As the black-and-white developer, known black-and-white developers can be used singly or in combination, which include dihydroxybenzenes, such as hydroquinone, 3-pyrazolidones, such as 1-phenyl-3-pyrazolidone, or aminophenols, such as N-methyl-p-aminophenol. Theses black-and-white developers usually have a pH of from 9 to 12. The replenishment rate of the developer is usually 3 L or less per $m^2$ of the photosensitive material, though depending on the type of the color photographic material to be processed. The replenishment rate may be reduced to 500 milliliter/$m^2$ or less by decreasing the bromide ion concentration in the replenisher (hereinafter milliliter is also referred to as "mL"). If the replenishment rate is reduced, the area of the processing tank in contact with air is preferably reduced to inhibit the evaporation and air oxidation of the processing solution.

The area of the photographic processing solution in contact with air in the processing tank can be represented by an opening rate as defined by the following equation:

Opening rate=[area of processing solution in contact with air ($cm^2$)/[volume of processing solution ($cm^3$)]

The opening rate as defined above is preferably in the range of 0.1 or less, more preferably 0.001 to 0.05. Examples of methods for reducing the opening rate include a method which comprises putting a cover such as floating lid on the surface of the processing solution in the processing tank, a method as disclosed in JP-A-1-82033 utilizing a mobile lid, and a slit development method as disclosed in JP-A-63-216050. The reduction of the opening rate is preferably effected in both color development and black-and-white development steps as well as all the subsequent steps such as bleach, blix, fixing, washing and stabilization. The replenishment rate can also be reduced by a means for suppressing accumulation of the bromide ion in the developing solution.

The period for the color development processing usually sets between 2 to 5 min, the processing time can be shortened further by setting high pH and temperature, and using high concentration color developer.

The photographic emulsion layer that has been color-developed is normally subjected to bleach. Bleach may be effected simultaneously with fixation (i.e., blix), or these two steps may be carried out separately. For speeding up of processing, bleach may be followed by blix. Further, any of an embodiment wherein two blix baths connected in series are used, an embodiment wherein blix is preceded by fixation, and an embodiment wherein blix is followed by bleach may be selected arbitrarily according to the purpose. Bleaching agents to be used include compounds of polyvalent metals, e.g., iron (III), peroxides, quinones, and nitro compounds. Typical examples of these bleaching agents are organic complex salts of iron (III) with, e.g., aminopolycarboxylic acids such as ethylenediaminetetraacetic acid, diethylenetriaminepentaacetic acid, cyclohexanediaminetetraacetic acid, methyliminodiacetic acrid, 1,3-diaminopropanetetraacetic acid and glycol ether diaminetetraacetic acid, or citric acid, tartaric acid, malic acid, etc. Of these, aminopolycarboxylic acid-iron (III) complex salts such as ethylenediaminetetraacetato iron (III) complex salts and 1,3-diaminopropanetetraacetato iron (III) complex salts are preferred in view of speeding up of processing and conservation of the environment. In particular, aminopolycarboxylic acid-iron (III) complex salts are useful in both of a bleaching solution and a blix solution. The pH value of a bleaching solution or blix solution comprising such an antinopolycarboxylic acid-iron (III) complex salts is normally in the range of 4.0 to 8. For speeding up of processing, the processing can be effected at an even lower pH value.

The bleaching bath, blix bath or a prebath thereof can contain, if desired, a bleaching accelerator. Examples of useful bleaching accelerators include compounds containing a mercapto group or a disulfide group as described in U.S. Pat. No. 3,893,858, West German Patents 1,290,812 and 2,059,988, JP-A's-53-32736, 53-57831, 53-37418, 53-72623, 53-95630, 53-95631, 53-104232, 53-124424, 53-141623, and 53-28426 and Research Disclosure No. 17129 (July 1978), thiazolidine derivatives as described in JP-A-51-140129, thiourea derivatives as described in JP-B-45-8506, JP-A's-52-20832, and 53-32735 and U.S. Pat. No. 3,706,561, iodides as described in West German Patent 1,127,715 and JP-A-58-16235, polyoxyethylene compounds as described in West German Patents 966,410 and 2,748,430, polyamine compounds as described in JP-B-45-8836, compounds as described in JP-A's-49-40943, 49-59644, 53-94927, 54-35727, 55-26506 and 58-163940, and bromine ions. Preferred among these compounds are compounds containing a mercapto group or disulfide group because of their great acceleratory effects. In particular, the compounds disclosed in U.S. Pat. No. 3,893,858, West German Patent 1,290,812 and JP-A-53-95630 are preferred. The compounds disclosed in U.S. Pat. No. 4,552,834 are also preferred. These bleaching accelerators may be incorporated into the photosensitive material. These bleaching accelerators are particularly effective for blix of color photosensitive materials for picture taking.

The bleaching solution or blix solution preferably contains an organic acid besides the above mentioned compounds for the purpose of inhibiting bleach stain. A particularly preferred organic acid is a compound with an acid dissociation constant (pKa) of 2 to 5. In particular, acetic acid, propionic acid, hydroxyacetic acid, etc. are preferred.

Examples of fixing agents to be contained in the fixing solution or blix solution include thiosulfates, thiocyanates, thioethers, thioureas, and a large amount of iodides. The thiosulfites are normally used. In particular, ammonium thiosulfate can be most widely used. Further, thiosulfates are preferably used in combination with thiocyanates, thioether compounds, thioureas, etc. As preservatives of the fixing or blix bath there can be preferably used sulfites, bisulfites, carbonyl bisulfite adducts or sulfinic acid compounds as described in European Patent 294769A. The fixing solution or blix solution preferably contains aminopolycarboxylic acids or organic phosphonic acids for the purpose of stabilizing the solution.

In the present invention, compounds having pKa of 6.0 to 9.0 are preferably added to the fixing solution or a bleach-fixing solution in order to pH adjustment. Preferably, imidazoles such as imidazole, 1-methylimidazole, 1-ethylimidazole, and 2-methylimidazole are added in an amount of 0.1 to 10 mol/L.

The total time required for desilvering step is preferably as short as possible so long as no maldesilvering occurs. The desilvering time is preferably in the range of 1 to 3 minutes, more preferably 1 to 2 minutes. The processing temperature is in the range of 25° C. to 50° C., preferably 35° C. to 45°

C. In the preferred temperature range, the desilvering rate can be improved and stain after processing can be effectively inhibited.

In the desilvering step, the agitation is preferably intensified as much as possible. Specific examples of such an agitation intensifying method include a method as described in JP-A-62-183460 which comprises jetting the processing solution to the surface of the emulsion layer in the photosensitive material, a method as described in JP-A-62-183461 which comprises improving the agitating effect by a rotary means, a method which comprises improving the agitating effect by moving the photosensitive material with the emulsion surface in contact with a wiper blade provided in the bath so that a turbulence occurs on the emulsion surface, and a method which comprises increasing the total circulated amount of processing solution. Such an agitation improving method can be effectively applied to the bleaching bath, blix bath or fixing bath. The improvement in agitation effect can be considered to expedite the supply of a bleaching agent, fixing agent or the like into emulsion film, resulting in an improvement in desilvering rate. The above mentioned agitation improving means can work more effectively when a bleach accelerator is used, remarkably increasing the bleach acceleration effect and eliminating the inhibition of fixing by the bleach accelerator.

The automatic developing machine to be used in the processing of the photosensitive material of the present invention is preferably equipped with a photosensitive material conveying means as disclosed in JP-A's-60-191257, 60-191258 and 60-191259. As described in above JP-A-60-191257, such a conveying means can remarkably reduce the amount of the processing solution carried from a bath to its subsequent bath, providing a high effect of inhibiting deterioration of the properties of the processing solution. This effect is remarkably effective for the reduction of the processing time or the amount of replenisher required at each step.

It is usual that the thus desilvered silver halide color photographic material of the present invention are subjected to washing and/or stabilization. The quantity of water to be used in the washing can be selected from a broad range depending on the characteristics of the photosensitive material (for example, the kind of materials such as couplers, etc.), the end use of the photosensitive material, the temperature of washing water, the number of washing tanks (number of stages), the replenishment system (e.g., counter-current system or concurrent system), and other various factors. Of these factors, the relationship between the number of washing tanks and the quantity of water in a multi-stage counter-current system can be obtained according to the method described in "Journal of the Society of Motion Picture and Television Engineers", vol. 64, pp. 248–253 (May 1955).

According to the multi-stage counter-current system described in the above reference, although the requisite amount of water can be greatly reduced, bacteria would grow due to an increase of the retention time of water in the tank, and floating masses of bacteria stick to the photosensitive material. In the processing for the color photosensitive material of the present invention, in order to cope with this problem, the method of reducing calcium and magnesium ion concentrations described in JP-A-62-288838 can be used very effectively. Further, it is also effective to use isothiazolone compounds or thiabenzazoles as described in JP-A-57-8542, chlorine type bactericides, e.g., chlorinated sodium isocyanurate, benzotriazole, and bactericides described in Hiroshi Horiguchi, "Bokinbobaizai no kagaku", published by Sankyo Shuppan, (1986), Eisei Gijutsu Gakkai (ed.), "Biseibutsu no mekkin, sakkin, bobigijutsu", Kogyogijutsukai, (1982), and Nippon Bokin Bobi Gakkai (ed.), "Bokin bobizai jiten" (1986).

The washing water has a pH value of from 4 to 9, preferably from 5 to 8 in the processing for the photosensitive material of the present invention. The temperature of the water and the washing time can be selected from broad ranges depending on the characteristics and end use of the photosensitive material, but usually ranges from 15° C. to 45° C. in temperature and from 20 seconds to 10 minutes in time, preferably from 25° C. to 45° C. in temperature and from 30 seconds to 5 minutes in time. The photosensitive material of the present invention may be directly processed with a stabilizer in place of the washing step. For the stabilization, any of the known techniques as described in JP-A's-57-8543, 58-14834 and 60-220345 can be used.

The aforesaid washing step may be followed by stabilization in some cases. For example, a stabilizing bath containing a dye stabilizer and a surface active agent as is used as a final bath for color photosensitive materials for picture taking can be used. Examples of such a dye stabilizer include aldehydes such as formalin and glutaraldehyde, N-methylol compounds, hexamethylenetetramine and aldehyde-bisulfite adducts. This stabilizing bath may also contain various chelating agents or antifungal agents.

The overflow accompanying replenishment of the washing bath and/or stabilizing bath can be reused in other steps such as desilvering.

In a processing using an automatic developing machine, if the above mentioned various processing solutions are subject to concentration due to evaporation, the concentration is preferably corrected for by the addition of water.

The silver halide color photosensitive material of the present invention may contain a color developing agent for the purpose of simplifying and expediting processing. Such a color developing agent is preferably used in the form of various precursors, when it is contained in the photosensitive material. Examples of such precursors include indoaniline compounds as described in U.S. Pat. No. 3,342,597, Schiff's base type compounds as described in U.S. Pat. No. 3,342,599, and Research Disclosure Nos. 14,850 and 15,159, and aldol compounds as described in Research Disclosure No. 13,924, metal complexes as described in U.S. Pat. No. 3,719,492, and urethane compounds as described in JP-A-53-135628.

The silver halide color photosensitive material of the present invention may optionally comprise various 1-phenyl-3-pyrazolidones for the purpose of accelerating color development. Typical examples of such compounds are described in JP-A's-56-64339, 57-144547 and 58-115438.

In the present invention, the various processing solutions are used at a temperature of 10° C. to 50° C. The standard temperature range is normally from 33° C. to 38° C. However, a higher temperature range can be used to accelerate processing, reducing the processing time. On the contrary, a lower temperature range can be used to improve the picture quality or the stability of the processing solutions.

Further, the silver halide photosensitive material of the invention may be applied to heat-development photosensitive material as described, for example, in U.S. Pat. No. 4,500,626, and JP-A's-60-133449, 59-218443 and 61-238056, and European Patent 210 660A2.

Further, the silver halide color photographic photosensitive material of the invention can exhibit advantages easily when it is applied to lens-fitted film unit described, for example, in Jap. Utility Model KOKOKU Publication Nos. 2-32615 and 3-39784, which is effective.

EXAMPLE

The present invention will be specifically described by examples below. However, the present invention is not limited to there examples.

Example 1

Using an emulsion containing tabular silver iodobromide grains which contain 4.7 mol % of iodide sensitized with sulfur, selenium and gold and which have an average main plane projected area equivalent circular diameter of 2.4 μm and an average thickness of 0.12 μm, evaluation in color format was conducted. The emulsions were prepared by suitably selecting, combining, and/or varying the contents described in the main text and/or examples of the patents cited below.

The structure and chemical sensitization of the emulsions were selected based on the contents described in the publications or specifications of European Patent Publication No. (hereinafter referred to as EP) 573649B1; Japanese Patent No. 2912768; JP-A's-11-249249, 11-295832, and 11-72860; U.S. Pat. Nos. 5,985,534, and 5,965,343; Japanese Patent Nos. 3002715, 3045624 and 3045623; JP-A-2000-275771; U.S. Pat. No. 6,172,110; JP-A's-2000-321702, 2000-321700, and 2000-321698; U.S. Pat. No. 6,153,370; JP-A's-2001-92064; 2000-92059, and 2001-147501; U.S. Pat. No. 2001/0,006,768A1; JP-A's-2001-228572, 2001-255613, and 2001-264911; U.S. Pat. No. 6,280,920B1; JP-A's-2001-264912, and 2001-281778; U.S. Pat. Nos. 6,287,753B1, 2002/0,006,590A1, 5,919,611, 2001/0,031,434A1, and the like.

The methods of manufacturing emulsions described in the various publications and specifications of: Japanese Patent No. 2878903; JP-A's-11-143002, 11-143003, and 11-174612; U.S. Pat. Nos. 5,925,508, and 5,955,253; JP-A-11-327072; U.S. Pat. No. 5,989,800; Japanese Patent Nos. 3005382, 3014235; EP 0431585B1; U.S. Pat. No. 6,040,127A; Japanese Patent Nos. 3049647, 3045622, 3066692; EP 0563708B1; Japanese Patent No. 3091041; JP-A's-2000-338620, 2001-83651, 2001-75213, and 2001-100343; U.S. Pat. No. 6,251,577B1; EP 0563701B1; JP-A-2001-281780; and U.S. Pat. No. 2001/0,036,606A1.

This emulsion was heated to 50° C. and a first sensitizing dye and, if any, a second sensitizing dye were added in the form of a solid microdispersion in gelatin sol. Regarding the kind and amount of the dyes, see Table 4. After 15 minutes, potassium nitrate (8.3 mmol/mol-Ag) was added and a mixture of chloroauric acid (1.37 mg/mol-Ag) and potassium thiocyanate (2.13 mg/mol-Ag), sodium thiosulfate (1.73 mg/mol-Ag) and pentafluorophenyldiphenylphosphine selenide ($4.0\times10^{-6}$ mol/mol-Ag) were further added. Thereafter 2-diethylamino-4,6-bis(hydroxyamino)-1,3,5-triazole (0.26 g/mol-Ag) was added. After additional 10 minutes, 1-p-carboxyphenyl-2-mercapto-1,3,4-triazole ($8.2\times10^{-6}$ mol/mol-Ag) was added. Following an optimal chemical sensitization through a 60-minute ripening, 1-p-carboxyphenyl-2-mercaptotetrazole (0.37 mmol/mol-Ag) was added. Subsequently, a third sensitizing dye and a fourth sensitizing dye, whose kind and amount are summarized in Table 4, were added in this sequence and the mixture was held at 50° C. for 15 minutes.

To the emulsion thus prepared, potassium iodide (0.53 mmol/mol-Ag) in water, distilled water, gelatin gel and 7-hydroxy-5-methyl-1,2,4-triazaindolidine (0.65 mmol/mol-Ag) were added. Then, to the thus obtained emulsion were added an emulsified product 1-A (the emulsified product 1-A had γ value of 0.406) and thickener composed of sodium p-sulfostyrene homopolymer (0.10 g/mol-Ag) having an average molecular weight of about 750,000. The emulsified product 1-A was prepared by emulsifying and dispersing a solution of 3-benzyl-4-ethoxy-1-(1-p-methoxybenzoyl-(2-chloro-5-dodecyloxycarbonylanilino)carbonylmethyl)hydantoin and 1-(pivaloyl-{2-chloro-5-[4-(2,4-di-tert-pentylphenoxy)butyrylamino]anilinocarbonyl}methyl) pheno xycarbonyl-substituted benzotriazole, which are yellow dye-forming couplers, dissolved in a mixture of ethyl acetate and tricresyl phosphate, into a gelatin solution containing a surfactant (triisopropylnaphthalenesulfonic acid sodium salt), thereby to prepare a completed emulsion (the thus prepared completed emulsion before coating had γ value of 0.423). On an undercoated cellulose triacetate film support, a protective layer containing a surfactant, a film hardener 1,2-bis(vinylsulfonylacetylamino)ethane and the aforementioned thickener and gelatin, were formed on the upper side of the support by simultaneous application (this coated sample had γ of 0.446). Accordingly, Samples 1-1 to 1-10 set forth in Tables 4 and 5 were prepared.

Further, samples 1-11 and 1-12 were prepared in exactly the same manner except that the above emulsified product into which the yellow dye-forming couplers are emulsified and dispersed was replace with the following emulsified products 1-B and 1-C, respectively, as set forth in Tables 4 and 5.

(Preparation of Emulsion 1-B)

Ultrafiltration was conducted to the emulsion 1-A. That is, to 1 kg of the emulsified product 1-A water was properly added at every time when permeate became 500 mL until the permeate became 10 L. The temperature during the ultrafiltration was maintained at 40° C. The ultrafiltration module used in a ultrafiltration apparatus was hollow fiber membrane SLP-1053 manufactured by (molecular cut off: 10,000)). The reflow rate at this time was 5 L/min, the supplying pressure was 0.03 Mpa, the reflow pressure was 0.01 Mpa and the permeation pressure was 0 Mpa. The permeation rate was set at 40 to 60 ml/min. Emulsified product 1-B was obtained as mentioned above. The γ of the emulsified product 1-B was 0.274.

(Preparation of emulsion 1-C)

Ion exchange resin AMBERLITE IRA-900 in an amount of 100 g was gradually added to 1 kg of the emulsified product 1-A while stirring at 40° C. Then, the stirring was continued at 40° C. for 120 min, followed by removal of the ion exchange resin by filtration, thereby the emulsified product 1-C was obtained. The γ of the emulsified product 1-C was 0.097.

Further, a part of the emulsion applied was sampled and subjected to centrifugal sedimentation at 40° C. and at 4000 rpm for 20 minutes.

Following removal of the supernatant, the centrifugal precipitate was lightly washed with a small amount of lukewarm water at about 35° C. and then freeze dried. A central portion of a resulting silver iodobromide pellet was sampled and was dissolved in a 2:1:1 mixed solution of 10% sodium thiosulfate/dimethylformamide (DMF)/methanol. Then, the adsorbed dyes were isolated and quantitatively determined by high performance liquid chromatography as described previously. The results are shown in Table 4.

For the prepared samples 1-10 to 1-12, the γ values of the coated samples, the γ values of the completed emulsion and the γ values of the used emulsified product are summarized in Table 5.

TABLE 4

| Sample No. | First dye and addition amount (mmol/molAg) | Second dye and addition amount (mmol/molAg) | Third dye and addition amount (mmol/molAg) | Fourth dye and addition amount (mmol/molAg) | Adsorption ratio of third dye (%) | Adsorption ratio of gourth dye (%) | Remarks |
|---|---|---|---|---|---|---|---|
| | Adsorption ratio of sensitizing dye | | | | | | |
| 1-1 | SI-3 (0.96) | — | — | — | — | — | Comp. |
| 1-2 | SI-3 (0.96) | — | SII-1 (0.96) | SI-2 (0.48) | 22 | 85 | Comp. |
| 1-3 | SI-3 (0.96) | — | SII-1 (0.48) | SI-2 (0.96) | 89 | 92 | Inv. |
| 1-4 | SI-3 (0.96) | — | SII-1 (0.48) | SI-2 (0.48) | 51 | 81 | Comp. |
| 1-5 | SI-3 (0.96) | — | SII-1 (0.64) | SI-2 (0.32) | 31 | 76 | Comp. |
| 1-6 | SI-3 (0.96) | — | SII-1 (0.32) | SI-2 (0.64) | 90 | 95 | Inv. |
| 1-7 | SI-3 (0.96) | — | SII-1 (0.43) | SI-2 (0.53) | 91 | 89 | Inv. |
| 1-8 | SI-1 (0.58) | SI-3 (0.38) | — | — | | | Comp. |
| 1-9 | SI-1 (0.58) | SI-3 (0.58) | SII-1 (0.64) | SI-7 (0.32) | 30 | 74 | Comp. |
| 1-10 | SI-1 (0.58) | SI-3 (0.58) | SII-1 (0.32) | SI-7 (0.64) | 85 | 94 | Inv. |
| 1-11 | SI-1 (0.58) | SI-3 (0.58) | SII-1 (0.32) | SI-7 (0.64) | 91 | 95 | Inv. |
| 1-12 | SI-1 (0.58) | SI-3 (0.58) | SII-1 (0.32) | SI-7 (0.64) | 93 | 95 | Inv. |

TABLE 5

| Sample No. | γ of Coated sample | γ of completed emulsion | γ of emulsified product |
|---|---|---|---|
| | The γ values of prepared sample, completed emulsion and emulsified product | | |
| 1-10 | 0.446 | 0.423 | 0.406 |
| 1-11 | 0.314 | 0.291 | 0.274 |
| 1-12 | 0.138 | 0.114 | 0.097 |

The sample applied was exposed to light from a tungsten light source at a color temperature of 4800K for 0.01 second through a sharp cut filter SC-39 available from Fuji Photo Film Co., Ltd. (which transmits light of a wavelength longer than 390 nm) and a wedge filter. Then the samples were processed by the flowing development processing method. The methods of densitometric measurement and specific photographic sensitivity determination are in accordance with JIS K 7614-1981 and the same as those described in JP-A-63-226650.

The speed measured is shown in Table 6.

The development was done as follows by using an automatic processor FP-350 manufactured by Fuji Photo Film Co., Ltd (until the accumulated replenishing amount becomes three times the mother tank solution).

(Processing Steps)

| Step amount* | Time | Temperature | Replenishing |
|---|---|---|---|
| Color development | 2 min 45 sec | 38° C. | 45 mL |
| Bleaching | 1 min 00 sec | 38° C. | 20 mL<br>All of the overflow of the bleach solution was flown to the tank of bleach-fix |
| Bleach-fix | 3 min 15 sec | 38° C. | 30 mL |
| Washing (1) | 40 sec | 35° C. | Counter current flow from (2) to (1) |
| Washing (2) | 1 min 00 sec | 35° C. | 30 mL |
| Stabilization | 40 sec | 38° C. | 20 mL |
| Drying | 1 min 15 sec | 55° C. | |

*The replenishment rate is a value per 1.1 m of a 35-mm wide photosensitive material (equivalent to one role of 24 Ex. film).

The composition of each processing solution was as follows.

| (Color developer) | Tank solution (g) | Replenisher (g) |
|---|---|---|
| Diethylenetriaminepentaacetic acid | 1.0 | 1.1 |
| 1-Hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-(β-hydroxyethyl)amino]-2-methylaniline sulfate | 4.5 | 5.5 |
| Water to make | 1.0 L | 1.0 L |
| pH (adjusted by the use of potassium hydroxide and sulfuric acid) | 10.05 | 10.10 |

| (Bleach solution) Common to tank solution and replenisher | (unit: g) |
|---|---|
| Fe(III) ammonium ethylenediaminetetraacetate Dihydrate | 120.0 |
| Disodium ethylenediaminetetraacetate | 10.0 |
| Ammonium bromide | 100.0 |
| Ammonium nitrate | 10.0 |
| Bleach accelerator $(CH_3)_2N—CH_2—CH_2—S—S—CH_2—CH_2—N(CH_3)_2 \cdot 2HCl$ | 0.005 mol |
| Aqueous ammonia (27%) | 15.0 ml |
| Water to make | 1.0 L |
| pH (adjusted by the use of aqueous ammonia and nitric acid) | 6.3 |

| (Bleach-fix sol) | Tank solution (g) | Replenisher (g) |
|---|---|---|
| Fe(III) ammonium ethylenediaminetetraacetate Dihydrate | 50.0 | — |
| Disodium ethylenediaminetetraacetate | 5.0 | 2.0 |
| Sodium sulfite | 12.0 | 20.0 |

-continued

| | | |
|---|---|---|
| Aqueous solution of ammonium thiosulfate (700 g/L) | 240.0 mL | 400.0 mL |
| Aqueous ammonia (27%) | 6.0 mL | — |
| Water to make | 1.0 L | 1.0 L |
| pH (adjusted by aqueous ammonia and acetic acid) | 7.2 | 7.3 |

(Washing Water)

Tap water was passed through a mixed-bed column filled with H-type strongly acidic cation exchange resin (Amberlite IR-120B produced by Rohm & Haas Co.) and OH-type strongly basic anion exchange resin (Amberlite IR-400 produced by the same maker) so as to set the concentration of calcium and magnesium ions at 3 mg/L or less. Subsequently, 20 mg/L of sodium dichloroisocyanurate and 0.15 g/L of sodium sulfate were added. The pH of the solution ranged from 6.5 to 7.5.

| (Stabilizer) Common to tank solution and replenisher | (unit: g) |
|---|---|
| Sodium p-toluenesulfinate | 0.03 |
| Polyoxyethylene-p-monononylphenyl ether (av. polymerization degree: 10) | 0.2 |
| Disodium Ethylenediaminetetraacetic acid | 0.05 |
| 1,2,4-Triazole | 1.3 |
| 1,4-Bis(1,2,4-triazol-1-ylmethyl)piperazine | 0.75 |
| Water to make | 1.0 L |
| pH | 8.5 |

The absorption was measured by means of an automatic recording spectrophotometer HITACHI 3500 modified so that a sample can be set in an integrating sphere. The result of the relative value of an absorption area intensity in the wavelength region longer than 390 nm including the absorption by silver halide in the wavelength region longer than 390 nm is shown in Table 6.

TABLE 6

Relative absorptivity and relative speed

| Sample No. | First dye and addition amount (mmol/molAg) | Second dye and addition amount (mmol/molAg) | Third dye and addition amount (mmol/molAg) | Fourth dye and addition amount (mmol/molAg) | Relative value of absorption area intensity | Relative speed | Remarks |
|---|---|---|---|---|---|---|---|
| 1-1 | SI-3 (0.96) | — | — | — | 100 | 100 | Comp. Control of I-1 to I-7 |
| 1-2 | SI-3 (0.96) | — | SII-1 (0.96) | SI-2 (0.48) | 132 | 123 | Comp. |
| 1-3 | SI-3 (0.96) | — | SII-1 (0.48) | SI-2 (0.96) | 167 | 151 | Inv. |
| 1-4 | SI-3 (0.96) | — | SII-1 (0.48) | SI-2 (0.48) | 132 | 120 | Comp. |
| 1-5 | SI-3 (0.96) | — | SII-1 (0.64) | SI-2 (0.32) | 122 | 115 | Comp. |
| 1-6 | SI-3 (0.96) | — | SII-1 (0.32) | SI-2 (0.64) | 146 | 138 | Inv. |
| 1-7 | SI-3 (0.96) | — | SII-1 (0.43) | SI-2 (0.53) | 144 | 135 | Inv. |
| 1-8 | SI-1 (0.58) | SI-3 (0.38) | — | — | 100 | 100 | Comp. Control of I-8 to I-10 |
| 1-9 | SI-1 (0.58) | SI-3 (0.58) | SII-1 (0.64) | SI-7 (0.32) | 122 | 112 | Comp. |
| 1-10 | SI-1 (0.58) | SI-3 (0.58) | SII-1 (0.32) | SI-7 (0.64) | 144 | 132 | Inv. |
| 1-11 | SI-1 (0.58) | SI-3 (0.58) | SII-1 (0.32) | SI-7 (0.64) | 166 | 154 | Inv. |
| 1-12 | SI-1 (0.58) | SI-3 (0.58) | SII-1 (0.32) | SI-7 (0.64) | 176 | 169 | Inv. |

The λmax of the outer dye layer of above samples (both the samples of the present invention and for comparison) were shorter wavelength than the λmax of the inner dye layer. The λmax of the fluorescent emission of the outer dye layer were within ±25 nm of the λmax of the inner dye layer. The spectra of the fluorescent emission of the outer dye layer satisfactory overlap with the absorption spectra of the inner dye layer.

As is apparent from the examples shown in Tables 4 and 6, the present invention brings about high absorptivity and speed The examples provided in Tables 4 and 5 show that even a color coupler emulsified product, which is essential in the production of color photosensitive material, is made exist, the present invention can yield a high absorptivity and a high speed even if the emulsion of color couplers, which is essential in the preparation of a color photosensitive material, is co-present.

As the tables show, in the constitution of the present invention, especially the cation dye added as the third dye exhibits a high adsorption, which results in a high absorptivity. However, the adsorption of the anion dye added as the fourth dye was also higher than conventional one. Although not show in the tables, in the publicly known systems in which cation dye is added more than anion dye for an outer dye layer, a cation dye is also adsorbed correspondingly if a color coupler emulsion is absent. In some examples, adsorption was obtained more than the present invention. However, when a color coupler emulsion is added, a cation dye is instantly desorbed and at the same time the absorption also decreases greatly. Therefore, it has been believed that a stable multi-layered dye adsorption system having a high absorption intensity is impossible.

Even if an anion dye is used in an inner dye layer as in the present invention, use of anion dye more than cation dye in an outer dye layer is required for realizing a stable multi-layered dye adsorption even in the co-presence of a color coupler emulsified product.

Further, when the γ value in a unit weight or a unit area of the emulsified product and/or the completed emulsion and/or the coated emulsion were controlled, percentage of completion of the multi-layered dye adsorption was enhanced, and the advantage (speed) was also enhanced accordingly.

Example 2

Using an emulsion containing tabular silver iodobromide grains which contain 4.6 mol % of iodide sensitized with sulfur, selenium and gold and which have an average main plane projected area equivalent circular diameter of 3.2 μm and an average thickness of 0.10 μm, evaluation in color format was conducted. This emulsion was prepared in accordance with the method described in Example 1.

This emulsion was heated to 51° C. and a first sensitizing dye and, if any, a second sensitizing dye were added in the form of a solid microdispersion in gelatin sol. Regarding the kind and amount of the dyes, see Table 7. After 15 minutes, potassium nitrate (8.5 mmol/mol-Ag) was added and a mixture of chloroauric acid (1.58 mg/mol-Ag) and potassium thiocyanate (2.45 mg/mol-Ag), sodium thiosulfate (1.99 mg/mol-Ag) and pentafluorophenyldiphenylphosphine selenide ($4.6\times10^{-6}$ mol/mol-Ag) were further added. Thereafter 2-diethylamino-4,6-bis(hydroxyamino)-1,3,5-triazole (0.29 g/mol-Ag) was added. After additional 10 minutes, 1-p-carboxyphenyl-2-mercapto-1,3,4-triazole. ($9.4\times10^{-6}$ mol/mol-Ag) was added. Following an optimal chemical sensitization through a 60-minute ripening, 1-p-carboxyphenyl-2-mercaptotetrazole (0.43 mmol/mol-Ag) was added. Subsequently, the resulting mixture was cooled to 40° C. and a third sensitizing dye and a fourth sensitizing dye, whose kind and amount are summarized in Table 7, were added thereto in this sequence and the mixture was held for 15 minutes. To the emulsified product thus prepared, distilled water, gelatin gel, sodium bromide (0.93 mmol/mol-Ag) in water and 7-hydroxy-5-methyl-1,2,4-triazaindolidine (1.10 mmol/mol-Ag) were added. Then, in the case where the absorption peak wavelength in the longest wavelength region of an emulsion caused by a sensitizing dye was shorter than 599 nm, to the above emulsion were added an emulsified product (the emulsified product used here is one prepared by applying it to ultrafiltration in the same manner as for the emulsified product 1-B used in the above Example 1, and the γ value there of was 0.244) and thickener composed of sodium p-sulfostyrene homopolymer (0.10 g/mol-Ag) having an average molecular weight of about 750,000. The emulsified product was prepared by emulsifying and dispersing a solution of a terpolymer of N-{1-(2,4,5-trichlorophenyl)-4-pyrazolylpyrazolin-4-on-3-yl}methacrylamide, which is a magenta dye-forming coupler, butyl acrylate and styrene dissolved in a mixture of ethyl acetate and tricresyl phosphate, into a gelatin solution containing a surfactant and a thickener composed of sodium p-sulfostyrene homopolymer (0.10 g/mol-Ag) having an average molecular weight of about 750,000 were applied simultaneously on an undercoated cellulose triacetate film support while a protective layer the same as that of Example 1 was formed on the upper side of the support. In the case where the absorption peak wavelength in the longest wavelength region is longer than 600 nm, another emulsified product (the emulsified product used here is one prepared by applying it to ultrafiltration in the same manner as for the emulsified product 1-B used in the above Example 1, and the γ value there of was 0.195) and the above mentioned thickener were applied simultaneously on an undercoated cellulose triacetate film support while a protective layer the same as that of Example 1 was formed on the upper side of the support. The emulsified product was prepared by emulsifying and dispersing a solution of 5-isobutoxycarbonylamino-2-(3-(2,4-di-tert-pentylphenoxy)propylaminocarbonyl)-1-naphtol and 5-isobutoxycarbonylamino-2-(3-dodecyloxypropylaminocarbonyl)-1-naphtol, which are cyan dye-forming coupler, dissolved in a mixture of ethyl acetate and tricresyl phosphate into a gelatin solution containing a surfactant (triisopropylnaphthalenesulfonic acid sodium salt). The γ values of these coated samples were within the scope of 0.28–0.29.

The adsorption amount of the added sensitizing dye was measured in the same method as that described in Example 1 and the result is shown in Table 7.

The speed was also determined in the same method as that described in Example 1 except only that the sharp cut filter SC-39 was changed to a sharp cut filter SC-50 available from Fuji Photo Film Co., Ltd. (which transmits light of a wavelength longer than 500 nm). The speed measured is shown in Table 8.

A relative value of an absorption area intensity was also measured in the same method as that described in Example 1. The area intensity of the absorption by a sensitizing dye in the wavelength region longer than 500 nm was measured and its relative value is shown in Table 8. Further, an absorption intensity after preserving a sample at 50° C. at 80% RH for three days was measured and the absorption intensity by the outer dye was determined through subtraction of the absorption intensity by the inner dye. For each sample, a relative value with respect to the absorption intensity of the outer dye of the sample stored at 25° C. below zero is shown in Table 8.

A stable multi-layered dye adsorption system cannot be constituted based on a simple but shallow idea that because the electrostatic attraction interaction is to be utilized, the outer dye should be a cation dye if the inner dye is an anion

TABLE 7

Adsorption ratio of sensitizing dye

| Sample No. | First dye and addition amount (mmol/molAg) | Second dye and addition amount (mmol/molAg) | Third dye and addition amount (mmol/molAg) | Fourth dye and addition amount (mmol/molAg) | Adsorption ratio of third dye (%) | Adsorption ratio of fourth dye (%) | Remarks |
|---|---|---|---|---|---|---|---|
| 2-1 | SI-11 (0.61) | SI-20 (0.31) | — | — | — | — | Comp. |
| 2-2 | SI-11 (0.61) | SI-20 (0.31) | SII-12 (0.74) | SI-14 (0.18) | 16 | 78 | Comp. |
| 2-3 | SI-11 (0.61) | SI-20 (0.31) | SII-12 (0.46) | SI-14 (0.46) | 62 | 76 | Comp. |
| 2-4 | SI-11 (0.61) | SI-20 (0.31) | SII-12 (0.42) | SI-14 (0.50) | 87 | 90 | Inv. |
| 2-5 | SI-11 (0.61) | SI-20 (0.31) | SII-12 (0.31) | SI-14 (0.61) | 88 | 94 | Inv. |
| 2-6 | SI-13 (0.55) | SI-19 (0.37) | — | — | — | — | Comp. |
| 2-7 | SI-13 (0.55) | SI-19 (0.37) | SII-15 (1.06) | SI-13 (0.16) | 10 | 72 | Comp. |
| 2-8 | SI-13 (0.55) | SI-19 (0.37) | SII-15 (0.69) | SI-13 (0.53) | 47 | 74 | Comp. |
| 2-9 | SI-13 (0.55) | SI-19 (0.37) | SII-15 (0.55) | SI-13 (0.67) | 86 | 88 | Inv. |
| 2-10 | SI-13 (0.55) | SI-19 (0.37) | SII-15 (0.41) | SI-13 (0.81) | 85 | 94 | Inv. |
| 2-11 | SI-13 (0.55) | SI-19 (0.37) | SII-15 (1.06) | SI-17 (0.16) | 10 | 81 | Comp. |
| 2-12 | SI-13 (0.55) | SI-19 (0.37) | SII-15 (0.41) | SI-17 (0.81) | 85 | 93 | Inv. |
| 2-13 | SI-30 (0.86) | SI-38 (0.15) | — | — | — | — | Comp. |
| 2-14 | SI-30 (0.86) | SI-38 (0.15) | SII-34 (1.01) | SI-26 (0.25) | 15 | 68 | Comp. |
| 2-15 | SI-30 (0.86) | SI-38 (0.15) | SII-34 (1.01) | SI-26 (1.01) | 49 | 78 | Comp. |
| 2-16 | SI-30 (0.86) | SI-38 (0.15) | SII-34 (0.57) | SI-26 (0.68) | 75 | 82 | Inv. |
| 2-17 | SI-30 (0.86) | SI-38 (0.15) | SII-34 (0.39) | SI-26 (0.86) | 87 | 85 | Inv. |
| 2-18 | SI-30 (0.86) | SI-38 (0.15) | SII-34 (0.77) | SI-26 (1.24) | 79 | 78 | Inv. |
| 2-19 | SI-30 (0.86) | SI-38 (0.15) | SII-34 (0.65) | SI-26 (1.37) | 82 | 83 | Inv. |

TABLE 8

Relative absorptivity and relative speed of samples

| Sample No. | Third dye and addition amount (mmol/molAg) | Fourth dye and addition amount (mmol/molAg) | Relative value of absorption area intensity | Relative speed | Relative absorption intensity after storage of 50° C., 80% RH of 3 dyas | Remarks |
|---|---|---|---|---|---|---|
| 2-1 | — | — | 100 (Control of 2-1 to 2-5) | 100 (Control of 2-1 to 2-5) | 98 | Comp. |
| 2-2 | SII-12 (0.74) | SI-14 (0.18) | 114 | 105 | 64 | Comp. |
| 2-3 | SII-12 (0.46) | SI-14 (0.46) | 141 | 123 | 53 | Comp. |
| 2-4 | SII-12 (0.42) | SI-14 (0.50) | 158 | 138 | 83 | Inv. |
| 2-5 | SII-12 (0.31) | SI-14 (0.61) | 166 | 151 | 91 | Inv. |
| 2-6 | — | — | 100 (Control of 2-6 to 2-12) | 100 (Control of 2-6 to 2-12) | 97 | Comp. |
| 2-7 | SII-15 (1.06) | SI-13 (0.16) | 106 | 100 | 32 | Comp. |
| 2-8 | SII-15 (0.69) | SI-13 (0.53) | 136 | 120 | 43 | Comp. |
| 2-9 | SII-15 (0.55) | SI-13 (0.67) | 167 | 145 | 86 | Inv. |
| 2-10 | SII-15 (0.41) | SI-13 (0.81) | 176 | 155 | 89 | Inv. |
| 2-11 | SII-15 (1.06) | SI-17 (0.16) | 107 | 102 | 44 | Comp. |
| 2-12 | SII-15 (0.41) | SI-17 (0.81) | 178 | 162 | 93 | Inv. |
| 2-13 | — | — | 100 (Control of 2-13 to 2-19) | 100 (Control of 2-13 to 2-19) | 98 | Comp. |
| 2-14 | SII-34 (1.01) | SI-26 (0.25) | 112 | 105 | 48 | Comp. |
| 2-15 | SII-34 (1.01) | SI-26 (1.01) | 178 | 145 | 51 | Comp. |
| 2-16 | SII-34 (0.57) | SI-26 (0.68) | 162 | 148 | 85 | Inv. |
| 2-17 | SII-34 (0.39) | SI-26 (0.86) | 171 | 155 | 93 | Inv. |
| 2-18 | SII-34 (0.77) | SI-26 (1.24) | 211 | 178 | 91 | Inv. |
| 2-19 | SII-34 (0.65) | SI-26 (1.37) | 223 | 191 | 93 | Inv. |

The results shown in the above table clearly shows that, when an anion dye is used in an inner dye layer, the constitution of the present invention in which an anion dye is added more than a cation dye in an outer dye layer is superior to the conventional constitution in which a cation dye is mainly used in an outer dye layer for utilizing the electrostatic attraction interaction to an inner dye.

dye. That a color coupler emulsified product easily desorbs a dye if the dye is a cationic cyanine dye even if the dye is one adsorbing directly to silver halide is a fact well known to persons skilled in the art. A similar fact is found in multi-layered dye adsorption systems. When only a cation dye is used as the dye for the outer dye layer, if a color coupler emulsified product is added, most of the cation dye molecules will desorb within a short period of time. However, a multi-layered adsorption having such a stability as to be resistant to a color coupler emulsified product can be realized through the use of both cation and anion dyes in a proportion such that the anion dye is more than the other in the outer dye layer. Even in such a constitution, a stable adsorption is successfully obtained against an expectation that an electrostatic attraction to the anion dye in the inner layer will be weakened corresponding to the reduction in the cation dye and an unstable adsorption system will be formed.

As shown in Table 8, the excellence of the constitution of the present invention in comparison to the conventional constitutions can be understood well if a sample is stored at high temperature and high humidity.

Example 3

1) Support

The support that was used in this example was prepared as follows:

100 weight parts of polyethylene-2,6-naphthalate polymer, and 2 weight parts of Tinuvin P. 326 (trade name, manufactured by Ciba-Geigy Co.), as an ultraviolet absorbing agent, were dried, then melted at 300° C.; subsequently they were extruded through a T-type die, and stretched 3.3 times lengthwise at 140° C., and then 3.3 times width wise at 130° C.; and further they were thermally fixed for 6 seconds at 250° C., thereby a PEN (polyethylene naphthalate) film having a thickness of 90 μm was obtained. To the PEN film, appropriate amounts of a blue dye, a magenta dye, and a yellow dye (I-1, I-4, I-6, I-24, I-26, I-27, and II-5, as described in JIII Journal of Technical Disclosure: No. 94-6023) were added. Further, this film was wound around a stainless steel core (spool) having a diameter of 20 cm, and thermal history was imparted thereto at 110° C. for 48 hours, to obtain a support having suppressed core-set-curl.

2) Coating of Undercoat Layer

The two surfaces of the above support were subjected to corona discharge, UV discharge, and glow discharge. After that, each surface of the support was coated with an undercoat solution (10 mL/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C).

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/m$^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of Magnetic Recording Layer

A bar coater was used to coat the surface with 0.06 g/m$^2$ of cobalt-γ-iron oxide (specific area 43 m$^2$/g, major axis 0.14 μm, minor axis 0.03 μm, saturation magnetization 89 Am$^2$/kg, $Fe^{+2}/Fe^{+3}$=6/94, the surface was treated with 2 wt % of iron oxide by aluminum oxide silicon oxide) coated with 3-poly(polymerization degree 15)oxyethylene-propyloxytrimethoxysilane (15 wt %), together with 1.2 g/m$^2$ of diacetylcellulose (iron oxide was dispersed by an open kneader and sand mill), by using 0.3 g/m$^2$ of $C_2H_5C(CH_2OCONH{-}C_6H_3(CH_3)NCO)_3$ as a hardener and acetone, methylethylketone, and cyclohexane as solvents, thereby forming a 1.2-μm thick magnetic recording layer. 10 mg/m$^2$ of silica grains (0.3 μm) were added as a matting agent, and 10 mg/m$^2$ of aluminum oxide (0.15 μm) coated with 3-poly (polymerization degree 15)oxyethylene-propyloxytrimethoxysilane (15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 Am$^2$/kg, 7.3×10$^4$ A/m, and 65%, respectively.

3-3) Preparation of Slip Layer

The surface was then coated with diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 mg/m$^2$ of silica grains (0.3 μm) were added as a matting agent, and 15 mg/m$^2$ of aluminum oxide (0.15 μm) coated with 3-poly(polymerization degree 15)oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmø stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of Light-Sensitive Layer

Next, on the opposite side of the support of the back layer obtained by the above, layers of the following compositions were coated in a superposed manner to prepare a color negative photosensitive material of Sample 301. Samples 302–313 were prepared by replacing Em-A described in Example 1 and used in the 14th layer of Sample 301 with Em-AP1 to Em-AP4 and Em-ARP1, Em-ARP2, Em-ARP9 and Em-ARP10, and the reducing compound $B_2$-2 or $B_8$-10 of the present invention was additionally added to the 14th layer (the added reducing compound and addition amount are shown in Table 6).

Composition of Light-Sensitive Layers

Main materials used for the layers are classified into the following:

| | | | |
|---|---|---|---|
| ExC: | cyan coupler | UV: | ultraviolet absorbent |
| ExM: | magenta coupler | HBS: | high-boiling organic solvent |
| ExY: | yellow coupler | H: | gelatin hardener |

(Specific compounds are shown in the following description. Numerical values are described after the symbols, and their chemical formulae are shown thereafter.)

The figures corresponding to respective components indicate coating amounts in terms of $g/m^2$. With respect to silver halide, the figures indicate a coating amount in terms of silver.

| | |
|---|---|
| 1st layer (First antihalation layer) | |
| Black colloidal silver silver | 0.10 |
| Gelatin | 0.66 |
| ExM-1 | 0.048 |
| Cpd-2 | 0.001 |
| F-8 | 0.001 |
| HBS-1 | 0.090 |
| HBS-2 | 0.010 |
| 2nd layer (Second antihalation layer) | |
| Black colloidal silver silver | 0.10 |
| Gelatin | 0.80 |
| ExM-1 | 0.057 |
| ExF-1 | 0.002 |
| F-8 | 0.001 |
| HBS-1 | 0.090 |
| HBS-2 | 0.010 |
| 3rd Layer (Intermediate Layer) | |
| ExC-2 | 0.010 |
| Cpd-1 | 0.086 |
| UV-2 | 0.029 |
| UV-3 | 0.052 |
| UV-4 | 0.011 |
| HBS-1 | 0.100 |
| Gelatin | 0.60 |
| 4th Layer (Low-speed red-sensitive emulsion layer) | |
| Em-M silver | 0.42 |
| Em-N silver | 0.52 |
| Em-O silver | 0.10 |
| ExC-1 | 0.222 |
| ExC-2 | 0.010 |
| ExC-3 | 0.072 |
| ExC-4 | 0.148 |
| ExC-5 | 0.005 |
| ExC-6 | 0.008 |
| ExC-8 | 0.071 |
| ExC-9 | 0.010 |
| UV-2 | 0.036 |
| UV-3 | 0.067 |
| UV-4 | 0.014 |
| Cpd-2 | 0.010 |
| Cpd-4 | 0.012 |
| HBS-1 | 0.240 |
| HBS-5 | 0.010 |
| Gelatin | 1.50 |
| 5th layer (Medium-speed red-sensitive emulsion layer) | |
| Em-L silver | 0.38 |
| Em-M silver | 0.28 |
| ExC-1 | 0.111 |
| ExC-2 | 0.039 |
| ExC-3 | 0.018 |
| ExC-4 | 0.074 |
| ExC-5 | 0.019 |
| ExC-6 | 0.024 |

-continued

| | |
|---|---|
| ExC-8 | 0.010 |
| ExC-9 | 0.021 |
| Cpd-2 | 0.020 |
| Cpd-4 | 0.021 |
| HBS-1 | 0.129 |
| Gelatin | 0.85 |
| 6th layer (High-speed red-sensitive emulsion layer) | |
| Em-K silver | 1.40 |
| ExC-1 | 0.122 |
| ExC-6 | 0.032 |
| ExC-8 | 0.110 |
| ExC-9 | 0.005 |
| ExC-10 | 0.159 |
| Cpd-2 | 0.068 |
| Cpd-4 | 0.015 |
| HBS-1 | 0.440 |
| Gelatin | 1.51 |
| 7th layer (Intermediate layer) | |
| Cpd-1 | 0.081 |
| Cpd-6 | 0.002 |
| Solid disperse dye ExF-4 | 0.015 |
| HBS-1 | 0.049 |
| Poly(ethyl acrylate) latex | 0.088 |
| Gelatin | 0.80 |
| 8th layer (Interlayer effect-donating layer (Layer imparting interlayer effect to the red-sensitive layers)) | |
| Em-E silver | 0.40 |
| Cpd-4 | 0.010 |
| ExM-2 | 0.082 |
| ExM-3 | 0.006 |
| ExM-4 | 0.026 |
| ExY-1 | 0.010 |
| ExY-4 | 0.040 |
| ExC-7 | 0.007 |
| HBS-1 | 0.203 |
| HBS-3 | 0.003 |
| HBS-5 | 0.010 |
| Gelatin | 0.52 |
| 9th layer (Low-speed green-sensitive emulsion layer) | |
| Em-H silver | 0.15 |
| Em-I silver | 0.23 |
| Em-J silver | 0.26 |
| ExM-2 | 0.388 |
| ExM-3 | 0.040 |
| ExY-1 | 0.003 |
| ExY-3 | 0.002 |
| ExC-7 | 0.009 |
| HBS-1 | 0.337 |
| HBS-3 | 0.018 |
| HBS-4 | 0.260 |
| HBS-5 | 0.110 |
| Cpd-5 | 0.010 |
| Gelatin | 1.45 |
| 10th layer (Medium-speed green-sensitive emulsion layer) | |
| Em-G silver | 0.30 |
| Em-H silver | 0.12 |
| ExM-2 | 0.084 |
| ExM-3 | 0.012 |
| ExM-4 | 0.005 |
| ExY-3 | 0.002 |
| ExC-6 | 0.003 |
| ExC-7 | 0.007 |
| ExC-8 | 0.008 |
| HBS-1 | 0.096 |
| HBS-3 | 0.002 |
| HBS-5 | 0.002 |
| Cpd-5 | 0.004 |
| Gelatin | 0.42 |
| 11th layer (High-speed green-sensitive emulsion layer) | |
| Em-F silver | 1.20 |
| ExC-6 | 0.003 |
| ExC-8 | 0.010 |
| ExM-1 | 0.014 |

-continued

| | |
|---|---|
| ExM-2 | 0.023 |
| ExM-3 | 0.023 |
| ExM-4 | 0.005 |
| ExM-5 | 0.040 |
| ExY-3 | 0.003 |
| DA-1 | 0.013 |
| Cpd-3 | 0.004 |
| Cpd-4 | 0.007 |
| Cpd-5 | 0.010 |
| HBS-1 | 0.259 |
| Poly(ethyl acrylate) latex | 0.099 |
| Gelatin | 1.110 |
| 12th layer (Yellow filter layer) | |
| Cpd-1 | 0.088 |
| Oil-soluble dye ExF-2 | 0.051 |
| Solid disperse dye ExF-8 | 0.010 |
| HBS-1 | 0.049 |
| Gelatin | 0.54 |
| 13th Layer (Low-speed blue-sensitive emulsion layer) | |
| Em-B silver | 0.50 |
| Em-C silver | 0.15 |
| Em-D silver | 0.10 |
| ExC-1 | 0.024 |
| ExC-7 | 0.011 |
| ExY-1 | 0.002 |
| ExY-2 | 0.956 |
| ExY-4 | 0.091 |
| Cpd-2 | 0.037 |
| Cpd-3 | 0.004 |
| HBS-1 | 0.372 |
| HBS-5 | 0.047 |
| Gelatin | 2.00 |
| 14th layer (High-speed blue-sensitive emulsion layer) | |
| Em-A silver | 1.22 |
| ExY-2 | 0.235 |
| ExY-4 | 0.018 |
| Cpd-2 | 0.075 |
| Cpd-3 | 0.001 |
| HBS-1 | 0.087 |
| Gelatin | 1.30 |
| 15th layer (First protective layer) | |
| Silver iodide emulsion (0.07 μm) silver | 0.25 |
| UV-1 | 0.358 |
| UV-2 | 0.179 |
| UV-3 | 0.254 |
| UV-4 | 0.025 |
| F-11 | 0.008 |
| S-1 | 0.078 |
| ExF-5 | 0.0024 |
| Solid dispersion of ExF-6 | 0.0012 |
| ExF-7 | 0.0010 |
| HBS-1 | 0.175 |
| HBS-4 | 0.050 |
| Gelatin | 1.80 |

-continued

| | |
|---|---|
| 16th layer (Second protective layer) | |
| H-1 | 0.400 |
| B-1 (diameter: 1.7 μm) | 0.050 |
| B-2 (diameter: 1.7 μm) | 0.150 |
| B-3 | 0.050 |
| S-1 | 0.200 |
| Gelatin | 0.75 |

In addition to the above components, to improve the storage stability, processability, resistance to pressure, antiseptic and mildewproofing properties, the individual layers contained B-4 to B-6, F-1 to F-18, iron salt, lead salt, gold salt, platinum salt, palladium salt, iridium salt, ruthenium salt and rhodium salt.

Table 9 shows characteristics of silver halide emulsions Em-A to Em-O. These emulsions were prepared on the basis of the description of the detailed description and/or examples of the patents described below and suitably selecting therefrom, combining with each other and/or changing them.

The emulsion structure, chemical sensitization, spectral sensitization were in accordance especially with the described contents of the followings: EP 573, 649 B1, Japanese Patent No. 2912768, JP-A's 11-249249, 11-295832, and 11-72860, U.S. Pat. Nos. 5,985,534 and 5,965,343, Japanese Patent Nos. 3002715, 3045624, and 3045623, JP-A-2000-275771, U.S. Pat. No. 6,172,110, JP-A's-2000-321702, 2000-321700, and 2000-321698, U.S. Pat. No. 6,153,370, JP-A's-2001-92064, 2001-92064, 2000-92059, and 2001-147501, U.S. Pat. No. 2001-0,006,768A1, JP-As's-2001-228572, 2001-255613, and 2001-264911, U.S. Pat. No. 6,280,920B1, JP-A's-2001-264912, and 2001-281778, U.S. Pat. Nos. 6,287,753B1, 2002-0,006,590A1, 5,919,611, 2001-0,031,434A1 and the like.

The emulsion preparations were in accordance especially with the described contents of the followings: Japanese Patent No. 2878903, JP-A's-11-143002, 11-143003, and 11-174612, U.S. Pat. Nos. 5,925,508, and 5,955,253, JP-A11-327072, U.S. Pat. No. 5,989,800, Japanese Patent Nos. 3005382, and 3014235, EP 0431585B1, U.S. Pat. No. 6,040,127A, Japanese Patent Nos. 3049647, 3045622, and 3066692, EP 0563708B1, Japanese Patent No. 3091041, JP-A's-2000-338620, 2001-83651, 2001-75213, and 2001-100343, U.S. Pat. No. 6,251,577B1, EP 0563701B1, JP-A2001-281780, U.S. Pat. No. 2001-0,036,606A1 and the like.

TABLE 9

Characteristics of silver halide emulsions Em-1 to Em-O (1)

| Emulsion No. | Layer used | Grain shape | Average ESD (μm) | Average projected area diameter (μm) (COV (%)) | Average thickness (μm) (COV (%)) | Average aspect ratio | Ratio to the total projected area occupied by tabular grain (%) |
|---|---|---|---|---|---|---|---|
| Em-A | High speed blue-sensitive layer | (111) main plane tabular grain | 1.6 | 5.2 (26) | 0.101 (29) | 51 | 97 |
| Em-B | Low speed blue-sensitive layer | (111) main plane tabular grain | 0.9 | 2.3 (19) | 0.092 (23) | 25 | 99 |
| Em-C | Low speed blue-sensitive layer | (111) main plane tabular grain | 0.5 | 0.9 (18) | 0.103 (19) | 8.7 | 99 |
| Em-D | Low speed blue-sensitive layer | (100) main plane cubic grain | 0.2 | 0.2 (7) | 0.200 (7) | 1 | 0 |

TABLE 9-continued

Characteristics of silver halide emulsions Em-1 to Em-O (1)

| Emulsion No. | Layer used | Grain shape | Average ESD (μm) | Average projected area diameter (μm) (COV (%)) | Average thickness (μm) (COV (%)) | Average aspect ratio | Ratio to the total projected area occupied by tabular grain (%) |
|---|---|---|---|---|---|---|---|
| Em-E | A layer inparting interlayer effect to red-sensitive layer | (111) main plane tabular grain | 1.1 | 3.0 (18) | 0.099 (16) | 30 | 96 |
| Em-F | High speed green-sensitive layer | (111) main plane tabular grain | 1.2 | 6.0 (18) | 0.032 (16) | 188 | 99 |
| Em-G | Medium speed green-sensitive layer | (111) main plane tabular grain | 0.9 | 3.8 (23) | 0.034 (17) | 112 | 99 |
| Em-H | Low and medium speed green-sensitive layers | (111) main plane tabular grain | 0.6 | 1.8 (20) | 0.044 (13) | 41 | 99 |
| Em-I | Low speed green-sensitive layer | (111) main plane tabular grain | 0.5 | 1.2 (21) | 0.058 (13) | 21 | 97 |
| Em-J | Low speed green-sensitive layer | (111) main plane tabular grain | 0.4 | 1.0 (17) | 0.043 (12) | 23 | 96 |
| Em-K | High speed red-sensitive layer | (111) main plane tabular grain | 1.2 | 5.4 (18) | 0.040 (15) | 135 | 99 |
| Em-L | Medium speed red-sensitive layer | (111) main plane tabular grain | 0.9 | 3.6 (23) | 0.038 (16) | 95 | 99 |
| Em-M | Low and medium speed red-sensitive layers | (111) main plane tabular grain | 0.6 | 1.5 (20) | 0.064 (12) | 23 | 97 |
| Em-N | Low speed red-sensitive layer | (111) main plane tabular grain | 0.4 | 0.9 (17) | 0.053 (11) | 17 | 96 |
| Em-O | Low speed red-sensitive layer | (111) main plane tabular grain | 0.3 | 0.7 (18) | 0.037 (10) | 19 | 96 |

COV = Coefficient of variation

TABLE 9 (2)

| Emulsion No. | Characteristics of grains ocuppieng 70% or more of the total projected area | Grain structure and ratio of silver amount (%) and halide composition (described from the center) Halide composition of epitaxial junction portion is shown in < > |
|---|---|---|
| Em-A | High densitiy dislocation lines are present at fronge portion | (1%)AgBr/(10%)$AgBr_{90}I_{10}$/(60%)$AgBr_{85}I_{15}$/(12%)AgBr/(4%)AgI/(13%)AgBr |
| Em-B | High densitiy dislocation lines are present at fronge portion | (1%)AgBr/(20%)$AgBr_{90}I_{10}$/(50%)$AgBr_{85}I_{15}$/(6%)AgBr/(3%)AgI/(19%)AgBr |
| Em-C | High densitiy dislocation lines are present at fringe portion and on main plane | (15%)AgBr/(40%)$AgBr_{97}I_3$/(10%)AgBr/(2%)AgI/(33%)AgBr |
| Em-D | No dislocation lines | (35%)AgBr/(25%)$AgBr_{90}I_{10}$/(1%)AgI/(39%)AgBr |
| Em-E | High densitiy dislocation lines are present at fronge portion | (8%)AgBr/(35%)$AgBr_{97}I_3$/(15%)AgBr/(4%)AgI/(38%)AgBr |
| Em-F | Hexagonal tabular complete epitaxial junction are present at six apexs | (7%)AgBr/(66%)$AgBr_{97}I_3$/(25%)$AgBr_{86}I_{14}$/(2%)<$AgBr_{60}Cl_{30}I_{10}$> |
| Em-G | Hexagonal tabular complete epitaxial junction are present at six apexs | (15%)AgBr/(67%)$AgBr_{97}I_3$/(15%)$AgBr_{93}I_7$/(3%)<$AgBr_{70}Cl_{25}I_5$> |
| Em-H | Hexagonal tabular complete epitaxial junction are present at six apexs | (15%)AgBr/(65%)$AgBr_{99}I_1$/(15%)$AgBr_{95}I_5$/(5%)<$AgBr_{80}Cl_{20}$> |
| Em-I | Hexagonal tabular complete epitaxial junction are present at six apexs | (82%)AgBr/(10%)$AgBr_{95}I_5$/(8%)<$AgBr_{75}Cl_{20}I_5$> |
| Em-J | Hexagonal tabular epitaxial junction is present at one apex | (78%)AgBr/(10%)$AgBr_{95}I_5$/(12%)<$AgBr_{75}Cl_{20}I_5$> |
| Em-K | Hexagonal tabular complete epitaxial junction are present at six apexs | (7%)AgBr/(66%)$AgBr_{97}I_3$/(25%)$AgBr_{86}I_{14}$/(2%)<$AgBr_{60}Cl_{30}I_{10}$> |
| Em-L | Hexagonal tabular complete epitaxial junction are present at six apexs | (15%)AgBr/(67%)$AgBr_{97}I_3$/(15%)$AgBr_{93}I_7$/(3%)<$AgBr_{70}Cl_{25}I_5$> |

TABLE 9 (2)-continued

| Emulsion No. | Characteristics of grains ocuppieng 70% or more of the total projected area | Grain structure and ratio of silver amount (%) and halide composition (described from the center) Halide composition of epitaxial junction portion is shown in < > |
|---|---|---|
| Em-M | Hexagonal tabular complete epitaxial junction are present at six apexs | (15%)AgBr/(65%)$AgBr_{99}I_1$/(15%)$AgBr_{95}I_5$/(5%)<$AgBr_{80}Cl_{20}$> |
| Em-N | Hexagonal tabular epitaxial junction is present at one apex | (78%)AgBr/(10%)$AgBr_{95}I_5$/(12%)<$AgBr_{75}Cl_{20}I_5$> |
| Em-O | Hexagonal tabular epitaxial junction is present at one apex | (78%)AgBr/(10%)$AgBr_{95}I_5$/(12%)<$AgBr_{70}Cl_{20}I_{10}$> |

TABLE 9 (3)

| Emulsion No. | Average I content (mol %) <COV (%)> | Surface I content (mol %) | Average Cl content (mol %) <COV (%)> | Surface Cl content (mol %) | Twin planed spacing (μm) <COV (%)> | Ratio of (100) face to side faces (%) |
|---|---|---|---|---|---|---|
| Em-A | 14 <17> | 8 | 0 | 0 | 0.013 <25> | 21 |
| Em-B | 12.5 <22> | 7 | 0 | 0 | 0.011 <18> | 32 |
| Em-C | 3.2 <15> | 2 | 0 | 0 | 0.011 <22> | 18 |
| Em-D | 3.5 <8> | 0.9 | 0 | 0 | — | — |
| Em-E | 5.1 <9> | 3.5 | 0 | 0 | 0.010 <22> | 3 |
| Em-F | 5.7 <9> | 12 | 0.6 <10 or less> | 2 | 0.008 <18> | 8 |
| Em-G | 3.2 <7> | 6 | 0.8 <10 or less> | 2 | 0.008 <18> | 10 |
| Em-H | 1.4 <7> | 4 | 1 <10 or less> | 3 | 0.008 <18> | 12 |
| Em-I | 0.9 <8> | 4 | 1.6 <10 or less> | 5 | 0.008 <18> | 25 |
| Em-J | 1.1 <8> | 4 | 2.4 <8> | 7 | 0.008 <18> | 17 |
| Em-K | 5.7 <9> | 12 | 0.6 <10 or less> | 2 | 0.008 <18> | 8 |
| Em-L | 3.2 <7> | 6 | 0.8 <10 or less> | 2 | 0.008 <18> | 10 |
| Em-M | 1.4 <7> | 4 | 1 <10 or less> | 3 | 0.008 <18> | 12 |
| Em-N | 1.1 <8> | 4 | 2.4 <8> | 7 | 0.008 <18> | 17 |
| Em-O | 1.7 <8> | 4 | 2.4 <8> | 7 | 0.008 <18> | 22 |

COV = Coefficient of variation

TABLE 9 (4)

| Emulsion No. | Sensitizing dye | Dopant | Chemical sensitization, antifoggant and etc. |
|---|---|---|---|
| Em-A | SI-1, SI-3 | $K_2IrCl_6$ | Contents described in the above patent specifications were suitably selected and combined |
| Em-B | ExS-1, SI-1 | $K_2IrCl_6$ | Contents described in the above patent specifications were suitably selected and combined |
| Em-C | ExS-1, SI-1 | $K_2RhCl_6$, $K_2IrCl_6$ | Contents described in the above patent specifications were suitably selected and combined |
| Em-D | ExS-1, SI-1 | $K_2IrCl_6$ | Contents described in the above patent specifications were suitably selected and combined |
| Em-E | SI-12, ExS-2 | $K_2IrCl_6$, $K_2IrCl_5(H_2O)$, $K_4Fe(CN)_6$ | Contents described in the above patent specifications were suitably selected and combined |
| Em-F | SI-12, SI-19, SI-21 | $K_2IrCl_6$, $K_2IrCl_5(H_2O)$, $K_4Ru(CN)_6$ | Contents described in the above patent specifications were suitably selected and combined |
| Em-G | SI-12, SI-19, SI-21, ExS-3, ExS-4 | $K_2IrCl_6$, $K_2IrCl_5(H_2O)$, $K_4Ru(CN)_6$ | Contents described in the above patent specifications were suitably selected and combined |
| Em-H | SI-12, SI-19, SI-21, ExS-3, ExS-4 | $K_2IrCl_6$, $K_2IrCl_5(H_2O)$, $K_4Ru(CN)_6$ | Contents described in the above patent specifications were suitably selected and combined |

TABLE 9 (4)-continued

| Emulsion No. | Sensitizing dye | Dopant | Chemical sensitization, antifoggant and etc. |
|---|---|---|---|
| Em-I | SI-12, SI-19, SI-21, ExS-3, ExS-4 | $K_2IrCl_6$, $K_2IrCl_5(H_2O)$, $K_4Ru(CN)_6$ | Contents described in the above patent specifications were suitably selected and combined |
| Em-J | SI-12, SI-19, SI-21, ExS-3, ExS-4 | $K_2IrCl_6$, $K_2IrCl_5(H_2O)$, $K_4Ru(CN)_6$ | Contents described in the above patent specifications were suitably selected and combined |
| Em-K | SI-30, SI-38 | $K_2IrCl_6$, $K_2IrCl_5(H_2O)$, $K_4Ru(CN)_6$ | Contents described in the above patent specifications were suitably selected and combined |
| Em-L | SI-30, SI-38, ExS-5 | $K_2IrCl_6$, $K_2IrCl_5(H_2O)$, $K_4Ru(CN)_6$ | Contents described in the above patent specifications were suitably selected and combined |
| Em-M | SI-30, SI-38, ExS-5 | $K_2IrCl_6$, $K_2IrCl_5(H_2O)$, $K_4Ru(CN)_6$ | Contents described in the above patent specifications were suitably selected and combined |
| Em-N | SI-30, SI-38, ExS-5 | $K_2IrCl_6$, $K_2IrCl_5(H_2O)$, $K_4Ru(CN)_6$ | Contents described in the above patent specifications were suitably selected and combined |
| Em-O | SI-30, SI-38, ExS-5 | $K_2IrCl_6$, $K_2IrCl_5(H_2O)$, $K_4Ru(CN)_6$ | Contents described in the above patent specifications were suitably selected and combined |

Note that among the emulsions, Emulsions A, B and E meet the emulsion requirements defined in originally filed claim 6. Further, emulsions F to O meet the emulsion requirements defined in originally filed claim 7.

Preparation of Dispersions of Organic Solid Disperse Dyes

ExF-4 was dispersed by the following method. That is, 21.7 mL of water, 3 mL of a 5% aqueous solution of p-octylphenoxyethoxyethoxyethanesulfonate soda, and 0.5 g of a 5% aqueous solution of p-octylphenoxypolyoxyethyleneether (polymerization degree 10) were placed in a 700-mL pot mill, and 5.0 g of the dye ExF-3 and 500 mL of zirconium oxide beads (diameter 1 mm) were added to the mill. The contents were dispersed for 2 hr. This dispersion was done by using a BO type oscillating ball mill manufactured by Chuo Koki K. K. The dispersion was extracted from the mill and added to 8 g of a 12.5% aqueous solution of gelatin. The beads were filtered away to obtain a gelatin dispersion of the dye. The average grain size of the fine dye grains was 0.44 μm.

Following the same procedure as above, solid dispersions ExF-8 was obtained. The average grain sizes of these fine dye grains was 0.24 μm. ExF-2 was dispersed by a micro-precipitation dispersion method described in Example 1 of EP549,489A. The average grain size was found to be 0.06 μm.

A solid dispersion ExF-6 was dispersed by the following method.

4000 g of water and 376 g of a 3% solution of W-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min.

Compounds used in the formation of each layer were as follows.

ExS-1

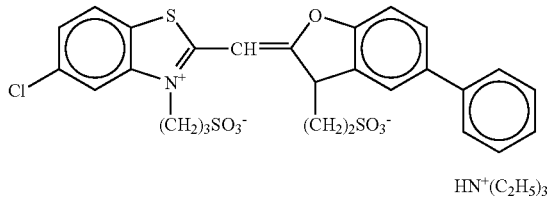

ExS-2

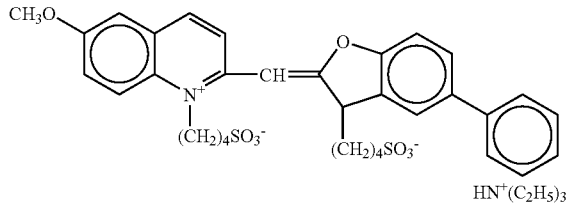

ExS-3

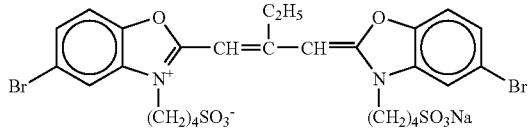

ExS-4

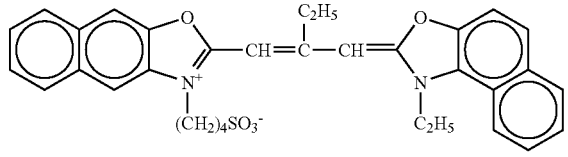

-continued
ExS-5
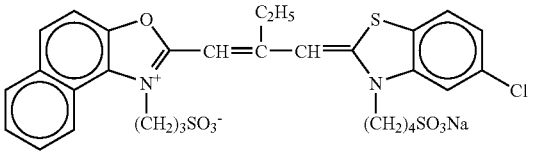
ExC-1
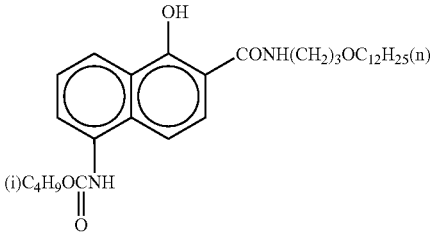
ExC-2
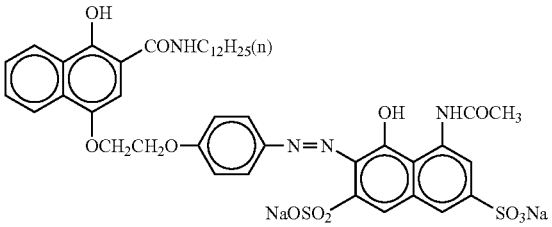
ExC-3
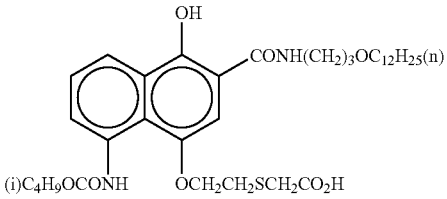
ExC-4
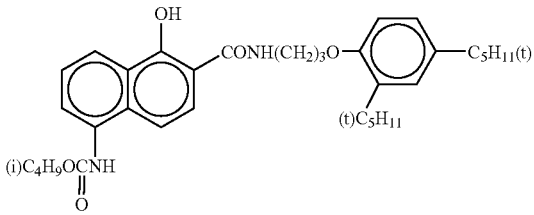
ExC-5
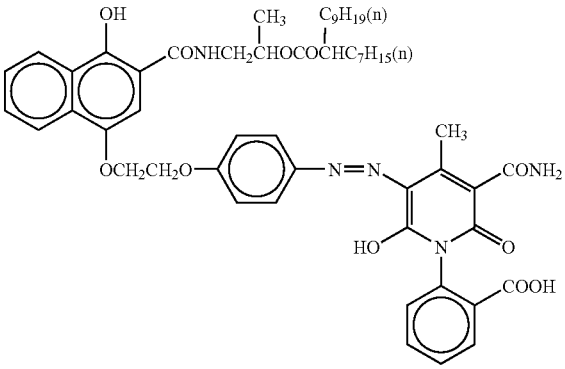
ExC-6
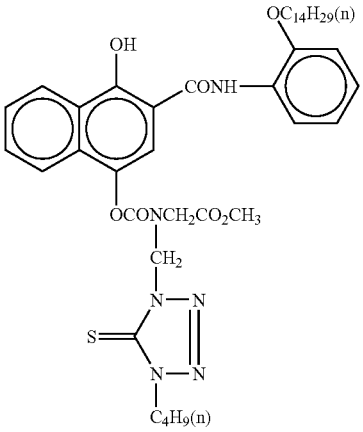

-continued
ExM-1
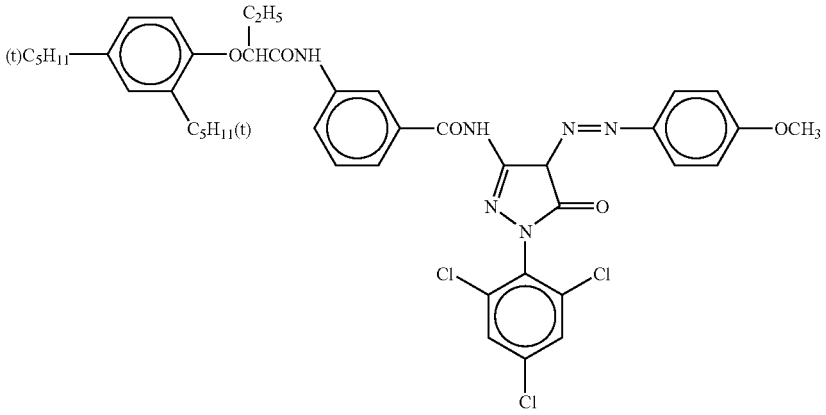
ExM-2
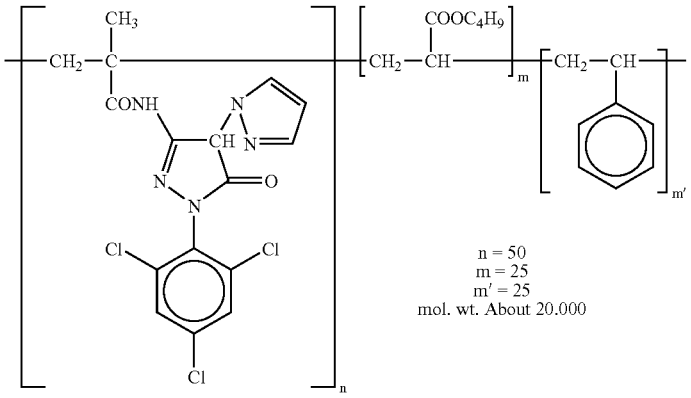
n = 50
m = 25
m′ = 25
mol. wt. About 20.000
ExM-3
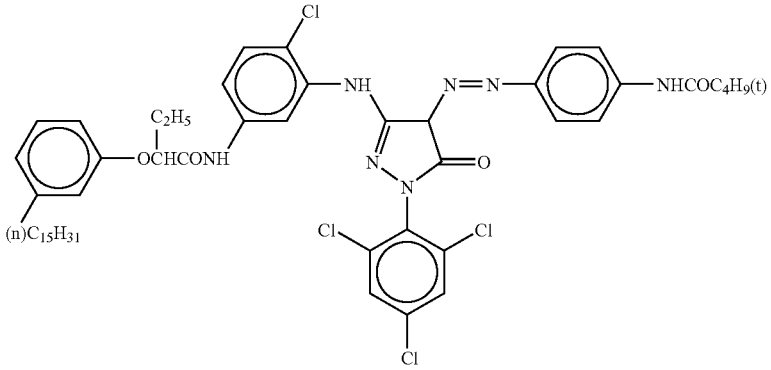
ExM-4
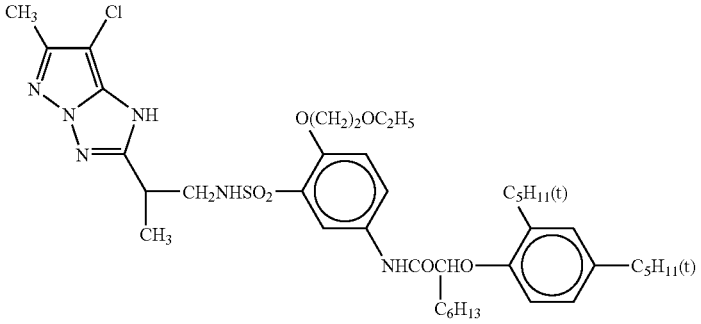

-continued
ExM-5
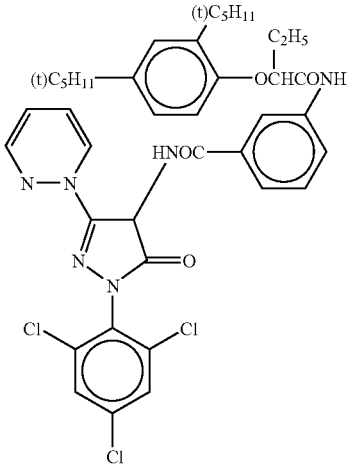
ExY-1
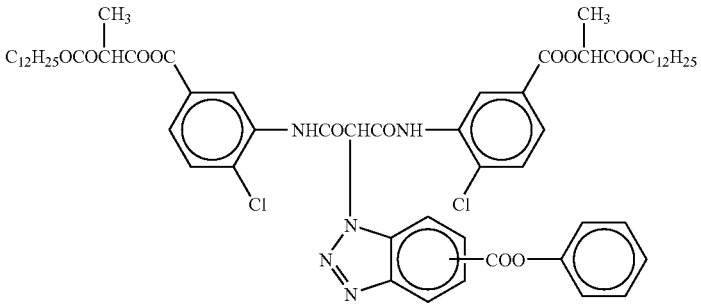
ExY-2
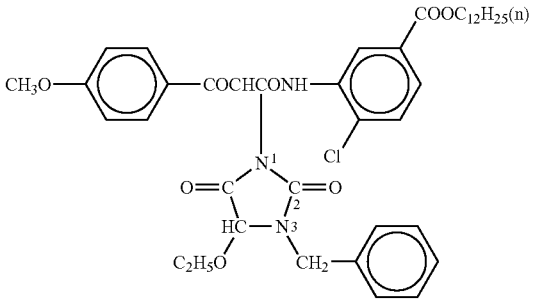
ExY-3
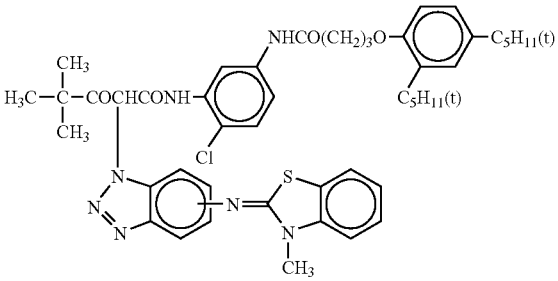
ExY-4
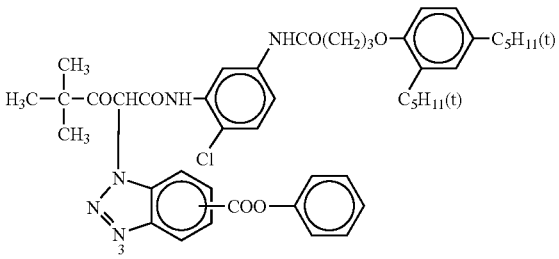
Cpd-1
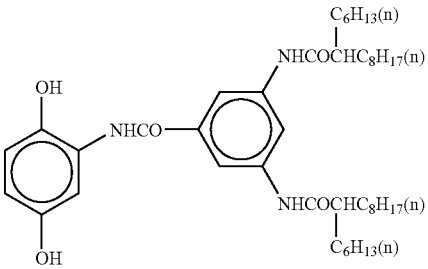
Cpd-2
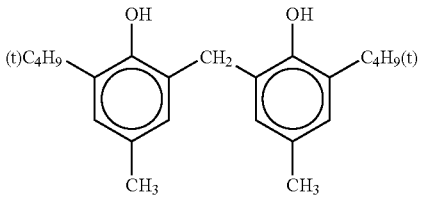
Cpd-3
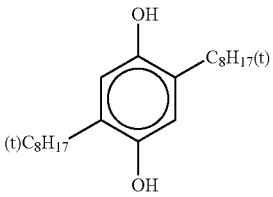

-continued
$(n)C_{14}H_{29}OCOCH_2CH_2CONOH$
$CH_3$
Cpd-4
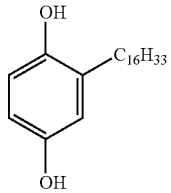
Cpd-5
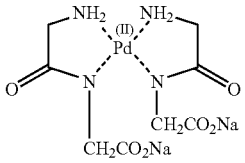
Cpd-6
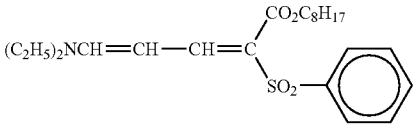
UV-1
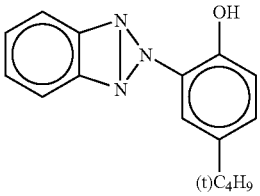
UV-2
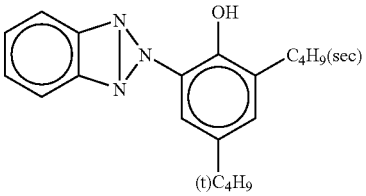
UV-3
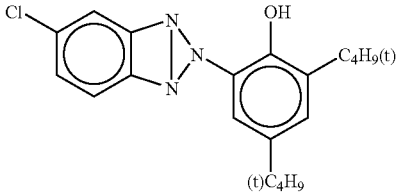
UV-4
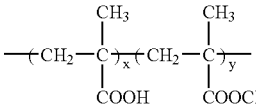
X/y = 10/90 (wt. ratio)
Av. mol. wt.: about 35,000
B-1
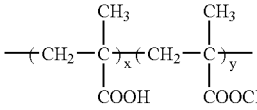
X/y = 40/60 (wt. ratio)
Av. mol. wt.: about 20,000
B-2
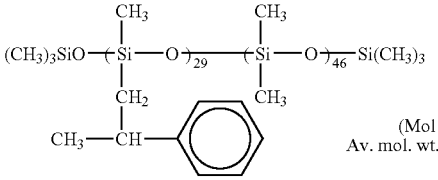
(Mol ratio)
Av. mol. wt. about 8,000
B-3
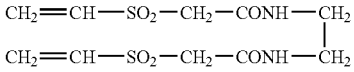
H-1
Tricresyl phosphate
HBS-1
Di-n-butyl phthalate
HBS-2
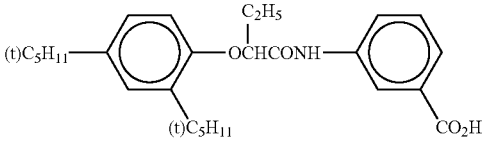
HBS-3
Tri(2-ethylhexyl) phosphate
HBS-4
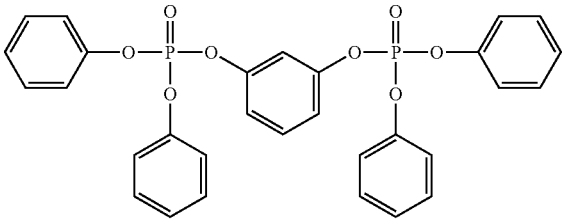
HBS-5

-continued
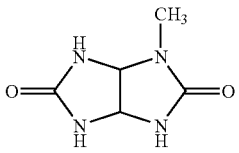
S-1
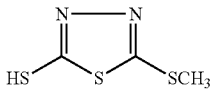
F-1
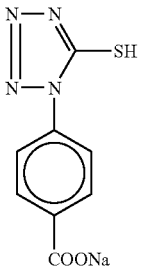
F-2
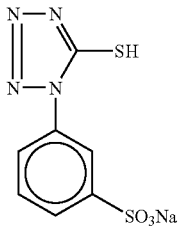
F-3
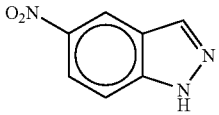
F-4
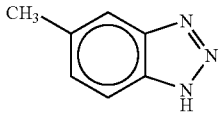
F-5
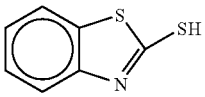
F-6
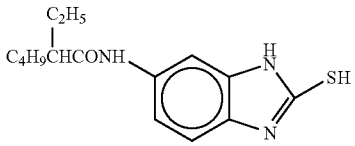
F-7
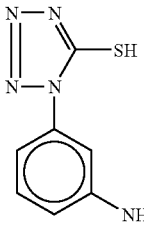
F-8
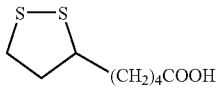
F-9
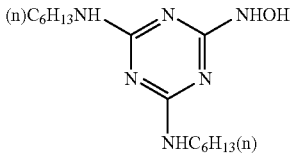
F-10
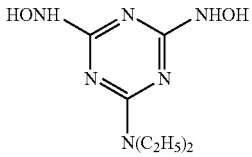
F-11
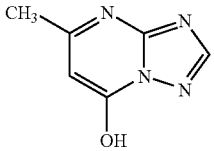
F-12
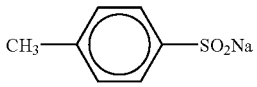
F-13
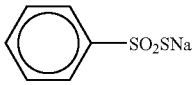
F-14
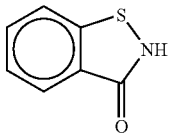
F-15
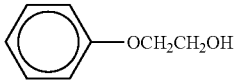
F-16
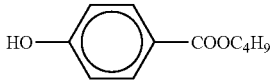
F-17

-continued
W-1
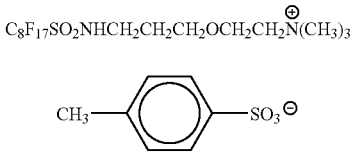
W-2
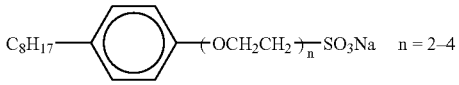
W-3
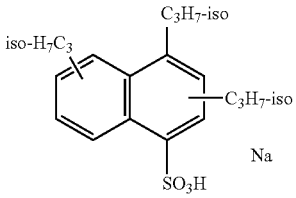
W-4
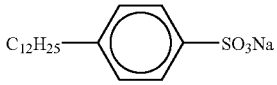
W-5
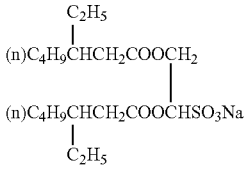
W-6
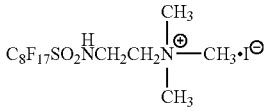
B-4
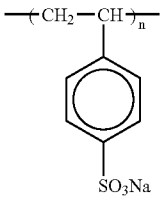
Av. mol. wt.: about 750,000
B-5
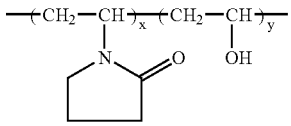
X/y = 70/30 (wt. ratio)
Av. mol. wt.: about 17,000
B-6
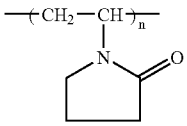
Av. mol. wt.: about 10,000
EXC-7
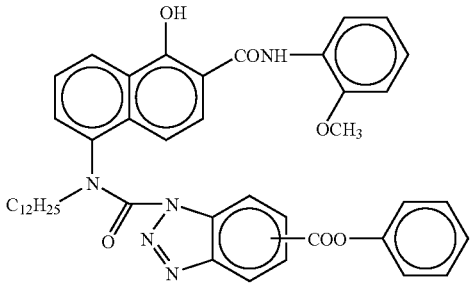
ExC-8
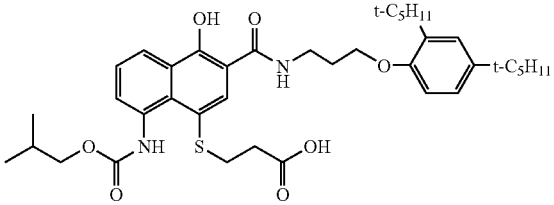
ExC-9
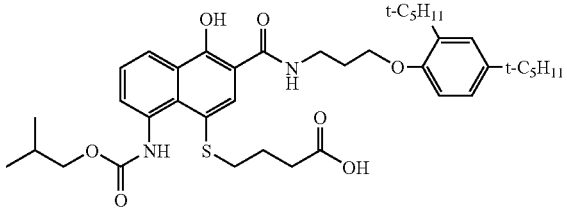
ExC-10
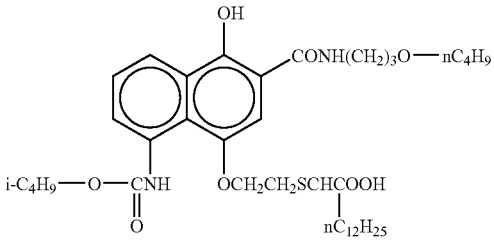
ExF-1
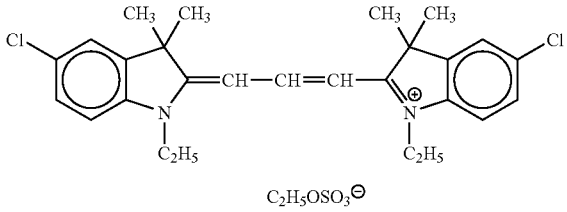

-continued
ExF-2
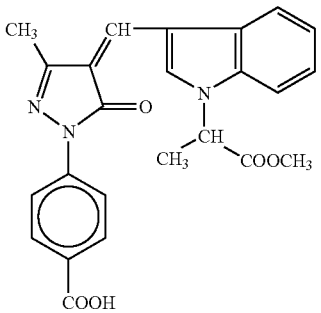
ExF-4
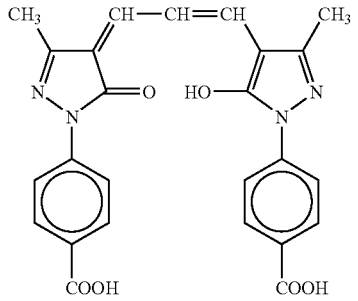
ExF-5
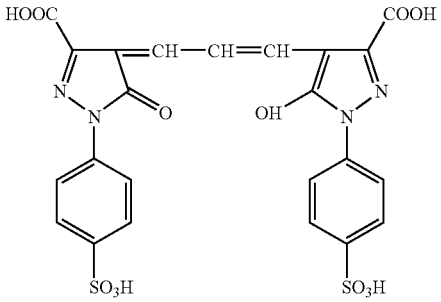
ExF-6
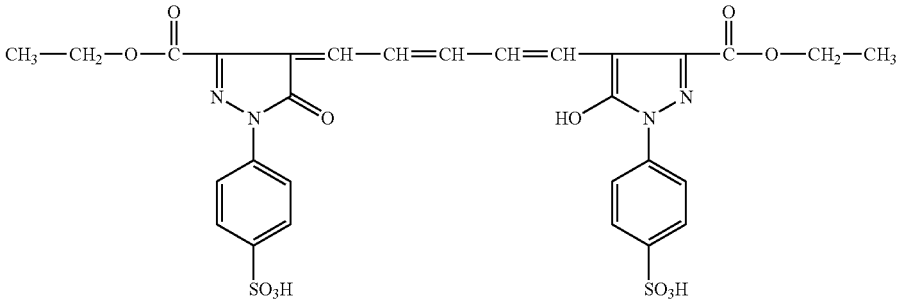
ExF-7
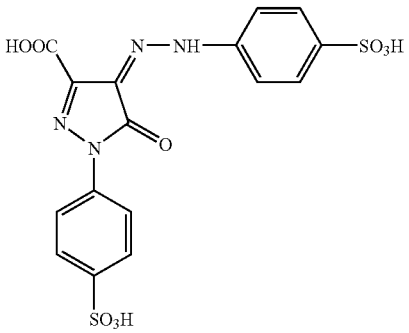
ExF-8
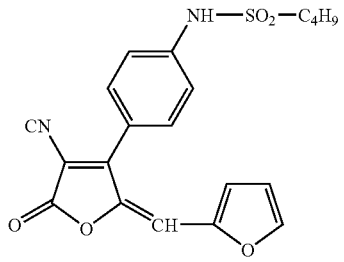

-continued

DA-1

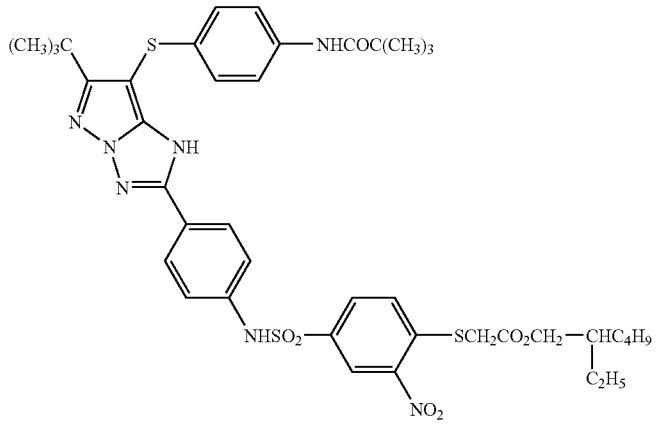

Subsequently, in the preparations of emulsion Em-K for the 6th layer (high speed red-sensitive emulsion layer), emulsion Em-F for the 11th layer (high speed green-sensitive emulsion layer) and emulsion Em-A for the 14th layer (high speed blue-sensitive emulsion layer), the sensitizing dyes shown in Table 10 as sensitizing dyes for an outer dye layer were added in the same manner as those described in Examples 1 and 2 in addition to the sensitizing dyes added in sample 3-1 (namely, in emulsion Em-K, SI-30 (1.98 mmol/mol-Ag) and SI-38 (0.49 mmol/mol-Ag); in emulsion Em-F, SI-12 (1.52 mmol/mol-Ag) and SI-19 (0.44 mmol/mol-Ag) and SI-21 (0.80 mmol/mol-Ag); in emulsion Em-A, SI-1 (0.70 mmol/mol-Ag) and SI-3 (0.30 mmol/mol-Ag)). Thus, samples 3-2 and 3-3 were prepared.

The interlayer constitution application samples 3-1 to 3-3 thus prepared were processed using test conditions, exposure, density measurement and specific photographic speed determination the same as those described in JP-A-63-226650 except the processing method shown below. Relative values of the specific photographic speed obtained are summarized in Table 11.

The method for determining the specific photographic speed according to the present invention is based on JIS K 7614-1981 except that development is completed within 30 minutes to 6 hours after sensitometric exposure, and that this development is done by FUJICOLOR processing formulation CN-16 described below. This method is substantially the same as the JIS determination method except the points mentioned above.

Development was performed as follows by using the FP-360B automatic processor manufactured by Fuji Photo Film Co., Ltd. Note that the FP-360B was modified such that the overflow solution of the bleaching bath was entirely discharged to a waste solution tank without being supplied to the subsequent bath. This FP-360B includes an evaporation correcting means described in JIII Journal of Technical Disclosure No. 94-4992.

The processing steps and the processing solution compositions are presented below.

(Processing Steps)

| Step | Time | Temperature | Replenishing rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60.0° C. | | |

*The replenishment rate was per 1.1 m of a 35-mm wide sensitized material (equivalent to one 24 Ex. 1)

The stabilizer and fixer were counterflowed from (2) to (1), and the overflow of washing water was entirely introduced to the fixing bath (2). Note that the amounts of the developer, bleaching solution, and fixer carried over to the bleaching step, fixing step, and washing step were 2.5 mL, 2.0 mL, and 2.0 mL, respectively, per 1.1 m of a 35-mm wide sensitized material. Note also that each crossover time was 6 sec, and this time was included in the processing time of each preceding step.

The aperture areas of the processor were 100 $cm^2$ for the color developer, 120 $cm^2$ for the bleaching solution, and about 100 $cm^2$ for the other processing solutions.

The compositions of the processing solutions are presented below.

| | Tank solution (g) | Replenisher (g) |
|---|---|---|
| (Color developer) | | |
| Diethylenetriamine pentaacetic acid | 3.0 | 3.0 |
| Disodium cathecol-3,5-disulfonate | 0.3 | 0.3 |
| Sodium sulfite | 3.9 | 5.3 |
| Potassium carbonate | 39.0 | 39.0 |
| Disodium-N,N-bis (2-sulfonatoethyl) hydroxylamine | 1.5 | 2.0 |
| Potassium bromide | 1.3 | 0.3 |

-continued

| | Tank solution (g) | Replenisher (g) |
|---|---|---|
| Potassium iodide | 1.3 mg | — |
| 4-hydroxy-6-methyl-1,3,3a,7-tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (controlled by potassium hydroxide and sulfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (controlled by ammonia water) | 4.6 | 4.0 |

(Fixing (1) Tank Solution)

A 5:95 (volume ratio) mixture of the above bleaching tank solution and the following fixing tank solution (pH 6.8).

| (Fixer (2)) | Tank solution (g) | Replenisher (g) |
|---|---|---|
| Aqueous ammonium thiosulfate solution (750 g/L) | 240 mL | 720 mL |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0 L | 1.0 L |
| pH (controlled by ammonia water and acetic acid) | 4.6 | 4.0 |

(Washing Water) Common to Tank Solution and Replenisher

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) common to tank solution and replenisher | (g) |
|---|---|
| Sodium p-toluenesulfinate | 0.03 |
| Polyoxyethylene-p-monononylphenylether (average polymerization degree 10) | 0.2 |
| 1,2-benzoisothiazoline-3-one·sodium | 0.10 |
| Disodium ethylenediaminetetraacetate | 0.05 |
| 1,2,4-triazole | 1.3 |
| 1,4-bis(1,2,4-triazole-1-isomethyl) piperazine | 0.75 |
| Water to make | 1.0 L |
| pH | 8.5 |

In the course of the sample preparation, a part of each of the completed emulsions obtained by addition, to the emulsions containing the aforementioned sensitizing dyes for the 6th, 11th and 14th layers, of other compounds including the aforementioned couplers was sampled and then measured for the adsorption amount of each of the added sensitizing dyes in accordance with the methods described in Examples 1 and 2.

Moreover, only the aforementioned completed emulsion was applied onto a colorless transparent support the same as that used in Example 1 simultaneously with a protective layer in accordance with the 16th layer (2nd protective layer) and the absorption was measured in accordance with the methods described in Examples 1 and 2. The absorption area intensity of a wavelength longer than 600 nm for the sample of the 6th layer, that of a wavelength longer than 500 nm for the sample of the eleventh layer, and that of a wavelength longer than 390 nm for the sample of the 14th layer are summarized in Table 11 as relative values to those of the 6th, 11th and 14th layers corresponding to sample 3-1.

TABLE 10

Relative absorption ratio and adsorption ratio of the outer layer dye

| Sample | Corresponding layer | First dye of the outer layer (mmol/molAg) | Second dye of the outer layer (mmol/molAg) | Relative absorption area intensity | Adsorption ratio of the first dye of the outer layer | Adsorption ratio of the second dye of the outer layer | Remarks |
|---|---|---|---|---|---|---|---|
| 3-1-K | The 6th layer | — | — | 100 (control) | — | — | Comp. |
| 3-2-K | The 6th layer | SII-34 (2.47) | SI-29 (1.24) | 162 | 24% | 76% | Comp. |
| 3-3-K | The 6th layer | SII-34 (1.24) | SI-29 (2.47) | 239 | 89% | 94% | Inv. |
| 3-1-F | The 11th layer | — | — | 100 (control) | — | — | Comp. |
| 3-2-F | The 11th layer | SII-11 (2.32) | SI-14 (0.99) | 146 | 22% | 78% | Comp. |
| 3-3-F | The 11th layer | SII-11 (1.32) | SI-14 (1.99) | 206 | 83% | 92% | Inv. |
| 3-1-A | The 14th layer | — | — | 100 (control) | — | — | Comp. |
| 3-2-A | The 14th layer | SII-1 (0.90) | SI-2 (0.45) | 166 | 31% | 84% | Comp. |
| 3-3-A | The 14th layer | SII-1 (0.45) | SI-2 (0.90) | 222 | 88% | 92% | Inv. |

TABLE 11

| Sensitometric evaluation of multi-layered construction color photosensitive material samples | | | | |
|---|---|---|---|---|
| Sample | Relative red region speed | Relative green region speed | Relative blue region speed | Remarks |
| 3-1 | 100 (control) | 100 (control) | 100 (control) | Comp. |
| 3-2 | 129 | 132 | 117 | Comp. |
| 3-3 | 195 | 178 | 148 | Inv. |

As is apparent at a first glance from the results set forth in Tables 10 and 11, the constitution of the present invention is an excellent technique, even when it is applied to a color photosensitive material constituted with multi layers, which is capable of leading to great increase in absorption intensity as a result of high adsorption ratio of the outer layer dye, and leading to high speed comparably.

Example 4

Sample 4-1 was prepared in the same manner as in the preparation of the sample 3-3 in the above Example 3, except that emulsified products (γ values were within the range of 0.157–0.244) which were prepared, in the preparation of all the color coupler emulsified products used in the sample 3-3, by disposing them to ultrafiltration in the same manner as in the preparation method of the emulsified product 1-B described in Example 1, was used. Further, sample 4-2 was prepared in the same manner as in the preparation of the sample 4-1, except that the color coupler emulsified products used in the 6th, 11th and 14th layers were replaced with others that were disposed to ion-exchange resin processing in the same manner as in the preparation of the emulsified product 1-C of Example 1, and the amounts of the surfactants used in the layers containing no silver halide were appropriately reduced.

The γ values of the coated samples prepared are listed in Table 12 together with that of the sample 3-3.

TABLE 12

| The γ values per unit area of multi-layered construction color photosensitive material sample | |
|---|---|
| Sample | Y |
| 3-3 | 0.463 |
| 4-1 | 0.220 |
| 4-2 | 0.105 |

The coated samples were subjected to the exposure to light, development and density measurement in exactly the same manner as in Example 3. Relative values of the obtained specific photographic speed are listed in Table 13. The relative values of red region speed, green region speed and blue region speed are those assuming those of the sample 3-3 as 100. Further, the similar evaluation to above was conducted for other samples stored at 50° C. and relative humidity of 65% for 14 days before subjecting them to exposure to light. The results after the storage are also listed in Table 14. The speed after the storage are shown in relative values assuming the speed of other samples stored at −25° C. as 100.

TABLE 13

| Sensitometric evaluation of multi-layered construction color photosensitive material sample | | | | | | | |
|---|---|---|---|---|---|---|---|
| | Red region | | Green region | | Blue region | | |
| Sample | Fog | Relative speed | Fog | Relative speed | Fog | Relative speed | Remarks |
| 3-3 | 0.15 | 100 | 0.14 | 100 | 0.15 | 100 | Inv. |
| 4-1 | 0.13 | 110 | 0.13 | 110 | 0.13 | 123 | Inv. |
| 4-2 | 0.14 | 110 | 0.13 | 107 | 0.13 | 132 | Inv. |

TABLE 14

| Sensitometric evaluation after storage of multi-layered construction color photosensitive material sample | | | | | | | |
|---|---|---|---|---|---|---|---|
| | Red region | | Green region | | Blue region | | |
| Sample | Fog | Relative speed | Fog | Relative speed | Fog | Relative speed | Remarks |
| 3-3 | 0.16 | 85 | 0.15 | 87 | 0.16 | 89 | Inv. |
| 4-1 | 0.14 | 95 | 0.13 | 98 | 0.13 | 98 | Inv. |
| 4-2 | 0.14 | 98 | 0.13 | 100 | 0.14 | 102 | Inv. |

As shown in Example 3, the sample 3-3 in which the outer layer dyes were in conformity to the constitution of the present invention resulted in a high increment in speed. In addition to that, controlling the γ value within a specific range attained a little more increment in speed. Although there is an impression of an apparently small width of the speed increment for the speed increment degree of the red speed and green speed, the speed of the sample 3-3 is very close to the speed that is attained theoretically, which means a further increment in speed. This further increment was an epoch-making.

In addition, controlling the γ value within the specific range remarkably increased storability.

Example 5

(5-1) A Method of Obtaining an Aqueous Solid Fine Dispersion of the Sensitizing Dye Used in this Example will be Described.

Preparation of Sensitizing Dye Dispersion 5-a for the Inner Dye Layer

To 1000 mL of water sensitizing dyes SI-11, SI-21, SI-39, ExS-3 and ExS-4 in amounts of 3.2 g, 3.2 g, 2.4 g, 15.1 g and 1.6 g, respectively, were added while stirring the mixture with a dissolver blade. A high speed stirring was continued more 2 hours at 50° C., followed by the addition of 100 g of gelatin and water to make the total volume to 1500 g.

Preparation of Sensitizing Dye Dispersion 5-b for the Outer Dye Layer

Preparation of an Emulsified Product Containing a Coupler

To 96 mL of water were added 1 g of sensitizing dye SII-11 and 2 g of sodium sulfate. To the mixture was added 200 g of zirconia beads having a diameter of 0.2 mm and dispersing the mixture was conducted at 45° C. for 2 hours. The zirconia beads were separated to obtain dye dispersion 5-b.

Preparation of Sensitizing Dye Dispersion 5-c for the Outer Dye Layer

To 85 mL of water were added 2 g of sensitizing dye SI-14. A high speed stirring was conducted using a dissolver blade at 55° C. for 1 hour. Then, 5 g of gelatin was added, and further 20 minutes stirring was conducted to obtain sensitizing dye dispersion 5-c.

(5-2) A Method of Preparing a Silver Halide Emulsion in which Sensitizing Dyes were Multi-Layeredly Adsorbed According to this Example of the Present Invention)

The same emulsion as Emulsion Em-F whose characteristics are shown in Table 3 of Example 9 was dissolved at 60° C., and the sensitizing dye dispersion 5-a mentioned above was added in an amount of 80% of the saturated dye amount. Sodium thiosulfate, N,N-dimethylselenourea, potassium thiocyanate and chlorauric acid were sequentially added to perform optimal gold-sulfur-selenium sensitization. Then, a compound M-2 was added as an antifoggant followed by lowering the temperature to 40° C.

The sensitizing dye dispersion 5-b was added in an amount of 50% of the saturated absorbing amount at 40° C. After 20 minutes, the sensitizing dye dispersion 5-c was added in an amount of 55% of the saturated absorbing amount. The thus prepared sensitizing dye multi-layeredly adsorbed emulsion was named emulsion 5-1.

(5-3) Preparation of Coated Samples and their Evaluation will be Described.

Preparation of an Emulsified Product Containing a Coupler

To 11 mL of tricresyl phosphate which is a high-boiling organic solvent and 30 mL of ethyl acetate were dissolved 10.6 g of 1-(2,4,6-trichlorophenyl)-3-{3-[2-(2,4-di-tert-pentylphenoxy)butylylamino]benzoylamino}-2-pyrazolin-5-on, which is a magenta dye-forming coupler. The resulting solution was mixed with an aqueous 5% gelatin solution and 5.61 g of triisopropylnaphthalenesulfonic acid sodium salt (W-3) which is a surfactant was added. Emulsifying dispersion of the mixture was conducted using a colloid mil to obtain the emulsified product 5-a.

Preparation of Emulsified Products 5-b and 5-c)

An emulsified product 5-b was obtained by subjected the emulsified product 5-a to the ultrafiltration in exactly the same manner as in the preparation of the emulsified product 1-B described in Example 1. An emulsified product 5-c was obtained by subjecting the emulsified product 5-a to ion-exchange resin processing in exactly the same manner as in the preparation of the emulsified product 1-c described in Example 1. The γ values of the thus obtained emulsified products 5-b and 5-c were 0.371 and 0.152, respectively.

Preparation of Coated Samples

The emulsion 5-1 and each of the above emulsified products 5-a to 5-c were mixed and stirred at 40° C. to obtain three kinds of completed emulsion. On the other hand for comparison, an emulsion 5-2 was also prepared in the same manner as in the emulsion 5-1 except that both of the sensitizing dye dispersions 5-b and 5-c for the outer dye layer were not used. This emulsion 5-2 was mixed with the above emulsified product 5-a and stirred at 40° C. similarly to also obtain a completed emulsion. These four kinds of the completed emulsions were left to stand while keeping them in the liquid state at 40° C. for 2 hours, and each of them were simultaneously coated on an undercoated cellulose triacetate film support with a gelatin solution containing, as a hardener, 2,4-dichloro-6-hydroxy-s-triazine sodium salt as a protective layer to prepare samples 5-1 to 5-4.

These samples were subjected to hardening processing under 40° C. and relative humidity of 70% for 14 days. Then, the samples were exposed to light for 1/100 sec through a continuous wedge and gelatin filter SC-50 manufactured by Fuji Photo Film Co. Ltd., used also in Example 2. The samples were subjected to the development processing in exactly the same manner described in Example 1. The development processed samples were evaluated with regard to photographic properties by measuring density with a green filter.

The same evaluation was conducted also for other samples stored before the exposure to light under the condition of 50° C. and relative humidity of 60% for 14 days to evaluate storability. The results of photographic properties are shown in Table 15 below. The speed is expressed in a relative value of reciprocal of an exposure amount required to reach fog density plus 0.2. In Table 15, relative values are shown assuming the relative speed of the sample 5-1 as 100.

TABLE 15

| | | | | Fresh | | After storage | | |
|---|---|---|---|---|---|---|---|---|
| Sample | Emulsion used | Emulsified product used | γ | Fog | Speed | Fog | Speed | Remarks |
| 5-1 | Emulsion 5-2 | Emulsified product 5-a | 0.510 | 0.22 | 100 | 0.31 | 98 | Comp. |
| 5-2 | Emulsion 5-1 | Emulsified product 5-a | 0.510 | 0.19 | 127 | 0.25 | 103 | Inv. |
| 5-3 | Emulsion 5-1 | Emulsified product 5-b | 0.371 | 0.14 | 226 | 0.16 | 222 | Inv. |
| 5-4 | Emulsion 5-1 | Emulsified product 5-c | 0.152 | 0.13 | 208 | 0.25 | 215 | Inv. |

When the γ value is as large as 0.510 as in the sample 5-2, the advantages of the present invention are reduced even if it is the sample of the present invention if the completed emulsion is left to stand for a long time in a dissolved state or the coated sample was stored under a high temperature and high humidity. Note that by the conventional technique the level of the advantages became lower than that of the sample 5-1 having no outer dye layer. Contrary to this, when the γ value was adjusted, such speed decrement was remarkably suppressed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide emulsion comprising silver halide grains each of which are covered with at least two dye layers in combination, wherein the at least two dye layers comprising:

(a) an inner dye layer adjoining to the silver halide grain, and containing at least one kind of spectrally sensitizing dye capable of spectrally sensitizing silver halide, and (b) an outer dye layer adjoining to the inner dye layer (a), and containing at least two kinds of dyes, and wherein the light absorption energy of the outer dye layer is equal to or higher than the light absorption energy of the inner dye layer, an energy-releasing wavelength of the outer dye layer overlaps with an energy-absorbing wavelength of the inner dye layer, the spectrally sensitizing dyes constituting the inner dye layer include an anion dye and/or a betaine dye, the at least two kinds of dyes constituting the outer dye layer include an anion cyanine dye and a cation dye, and the anion cyanine dye in the outer dye layer is more than the cation dye in the outer dye layer in terms of an addition amount and/or an adsorption amount and the net charge of the cation dye of the outer layer is +2 or more.

2. The silver halide emulsion according to claim 1 wherein the spectrally sensitizing dye constituting the inner dye layer is a cyanine dye exhibiting J band type absorption on the silver halide grain.

3. The silver halide emulsion according to claim 1 wherein both the cation dye and the anion dye constituting the outer dye layer are dyes exhibiting J band type absorption in an aqueous gelatin solution.

4. The silver halide emulsion according to claim 1 wherein both the cation dye and the anion dye constituting the outer dye layer are cyanine dyes.

5. The silver halide emulsion according to claim 1 wherein the silver halide grains comprise tabular silver halide grains.

6. The silver halide emulsion according to claim 5 wherein the tabular silver halide grains include tabular silver halide grains each containing a region having, along edges thereof, a maximum surface iodide concentration, and each containing another region having, at a corner thereof, a lower surface iodide concentration than the iodide concentration of the region having a maximum surface iodide concentration.

7. The silver halide emulsion according to claim 5 wherein 50% or more of the total projected area of all the silver halide grains are occupied by tabular grains each having (111) main planes, the tabular silver halide grains having an epitaxial junction portion, and the tabular silver halide grains having a latent image-forming chemical sensitization portion on the surfaces thereof, wherein the latent image-forming chemical sensitization portion contains at least one kind of the same silver salt as a silver salt forming the epitaxial junction portion, the latent image-forming chemical sensitization portion is located closest to a peripheral edge of the (111) main plane of the tabular grain, and the latent image-forming chemical sensitization portion is confined to a portion occupying less than 50% of an area of the main plane.

8. A silver halide emulsion prepared by mixing silver halide grains and a hydrophilic dispersion of a water-insoluble photographically useful compound, wherein each of the silver halide grains are covered with at least two dye layers in combination, wherein the at least two dye layers comprising:

(a) an inner dye layer adjoining to the silver halide grain, and containing at least one kind of spectrally sensitizing dye capable of spectrally sensitizing silver halide, and (b) an outer dye layer adjoining to the inner dye layer (a), and containing at least two kinds of dyes, wherein the light absorption energy of the outer dye layer is equal to or higher than the light absorption energy of the inner dye layer, and an energy-releasing wavelength of the outer dye layer overlaps with an energy-absorbing wavelength of the inner dye layer; and the hydrophilic dispersion of a water-insoluble photographically useful compound containing a surfactant and a high-boiling organic solvent, wherein a $\gamma$ value in the hydrophilic dispersion is 0.020 or more but less than 0.390 wherein the $\gamma$ value is a ratio of an amount of the surfactant to an amount of the high-boiling organic solvent.

9. The silver halide emulsion according to claim 8 wherein the $\gamma$ value in the silver halide emulsion is 0.020 or more but less than 0.390.

10. The silver halide emulsion according to claim 8 further having the features described in claim 1.

11. A method of preparing the silver halide emulsion according to claim 8 wherein the method comprises: dissolving the water-insoluble photographically useful compound into the high-boiling organic solvent to obtain a solution, and dispersing the solution and the surfactant to a hydrophilic colloid thereby to obtain the hydrophilic dispersion of a water-insoluble photographically useful compound.

12. The method of preparing the silver halide emulsion according to claim 11 wherein the method further comprises, for obtaining the hydrophilic dispersion of a water-insoluble photographically useful compound, performing ultrafiltration and/or ion exchange.

13. A silver halide photosensitive material having at least one emulsion layer containing the silver halide emulsion according to claim 1.

14. A silver halide photosensitive material having at least one emulsion layer containing the silver halide emulsion according to claim 8.

15. The silver halide photosensitive material according to claim 14 wherein the $\gamma$ value in an emulsion layer containing the silver halide emulsion is 0.020 or more but less than 0.390.

16. The silver halide photosensitive material according to claim 14 wherein the $\gamma$ value in the photosensitive material is 0.020 or more but less than 0.390.

* * * * *